US008325210B2

(12) United States Patent
Ohno

(10) Patent No.: US 8,325,210 B2
(45) Date of Patent: Dec. 4, 2012

(54) LIGHT-EMITTING DEVICE, DRIVING METHOD OF LIGHT-EMITTING DEVICE, PRINT HEAD AND IMAGE FORMING APPARATUS

(75) Inventor: Seiji Ohno, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 280 days.

(21) Appl. No.: 12/902,757

(22) Filed: Oct. 12, 2010

(65) Prior Publication Data

US 2011/0234739 A1 Sep. 29, 2011

(30) Foreign Application Priority Data

Mar. 29, 2010 (JP) ..... 2010-074551

(51) Int. Cl.
*B41J 2/435* (2006.01)
*B41J 2/45* (2006.01)
*B41J 2/47* (2006.01)

(52) U.S. Cl. ..... 347/224; 347/247; 347/238; 347/237

(58) Field of Classification Search ..... 347/224, 347/237, 238, 247
See application file for complete search history.

(56) References Cited

U.S. PATENT DOCUMENTS 5,177,405 A * 1/1993 Kusuda et al. ..... 315/169.1
2004/0046976 A1 3/2004 Ohno et al.
2007/0296803 A1 12/2007 Ohno et al.
2009/0166646 A1* 7/2009 Ohno ..... 257/88

FOREIGN PATENT DOCUMENTS

JP A-2002-137445 5/2002
JP A-2004-181741 7/2004

* cited by examiner

*Primary Examiner* — Manish S Shah
*Assistant Examiner* — Sarah Al Hashimi
(74) *Attorney, Agent, or Firm* — Oliff & Berridge, PLC

(57) ABSTRACT

A light-emitting device includes: light-emitting chips each including light-emitting elements and memory elements corresponding to each other, each memory element memorizing a light-emitting element to light up, each light-emitting chip being capable of lighting up the light-emitting elements in parallel; a unit to transmit an enable signal in common to light-emitting chips belonging to each of M groups obtained by dividing the light-emitting chips, the enable signal enabling selection of light-emitting elements to light up; a unit to transmit a write signal in common to light-emitting chips belonging to each of N classes obtained by dividing the light-emitting chips, the write signal setting memory elements corresponding to the light-emitting elements to light up, to a memory state or not, in the light-emitting chips where the selection is enabled; and a unit to transmit light-up signals for lighting up to light-emitting elements corresponding to memory elements in the memory state.

9 Claims, 17 Drawing Sheets

LIGHT-EMITTING DEVICE, DRIVING METHOD OF LIGHT-EMITTING DEVICE, PRINT HEAD AND IMAGE FORMING APPARATUS

CROSS REFERENCE TO RELATED APPLICATIONS

This application is based on and claims priority under 35 USC §119 from Japanese Patent Application No. 2010-74551 filed Mar. 29, 2010.

BACKGROUND

1. Technical Field

The present invention relates to a light-emitting device, a driving method of a light-emitting device, a print head and an image forming apparatus.

2. Related Art

In an electrophotographic image forming apparatus such as a printer, a copy machine or a facsimile machine, an image is formed on a recording sheet as follows. Firstly, an electrostatic latent image is formed on a uniformly charged photoconductor by causing an optical recording unit to emit light so as to transfer image information onto the photoconductor. Then, the electrostatic latent image is made visible by being developed with toner. Lastly, the toner image is transferred on and fixed to the recording sheet. In addition to an optical-scanning recording unit that performs exposure by laser scanning in the first scanning direction using a laser beam, a LED print head (LPH) using the following light-emitting device has been employed as such an optical recording unit in recent years in response to demand for downsizing the apparatus. This light-emitting device includes a large number of light-emitting diodes (LEDs), serving as light-emitting elements, arrayed in the first scanning direction.

SUMMARY

According to an aspect of the present invention, there is provided a light-emitting device including: plural light-emitting chips that each include plural light-emitting elements and plural memory elements provided respectively corresponding to the plural light-emitting elements, each of the memory elements memorizing a corresponding light-emitting element to be caused to light up, each of the plural light-emitting chips being capable of lighting up the light-emitting elements more than one, in parallel; an enable signal supply unit that transmits an enable signal in common to light-emitting chips belonging to each of M groups into which the plural light-emitting chips are divided, where M is an integer more than one, the enable signal enabling selection of light-emitting elements to be caused to light up among the plural light-emitting elements; a write signal supply unit that transmits a write signal in common to light-emitting chips belonging to each of N classes into which the plural light-emitting chips are divided, where N is an integer more than one, the write signal setting memory elements corresponding to the light-emitting elements to be caused to light up among the plural light-emitting elements, to any one of a memory state and a non-memory state, in the light-emitting chips in which the selection is enabled by the enable signal; and a light-up signal supply unit that transmits light-up signals for lighting up to light-emitting elements corresponding to memory elements in the memory state, for the plural light-emitting chips.

BRIEF DESCRIPTION OF THE DRAWINGS

An Exemplary embodiment of the present invention will be described in detail based on the following figures, wherein.

DETAILED DESCRIPTION

Hereinafter, a description will be given of an exemplary embodiment of the present invention in detail with reference to the accompanying drawings.

First Exemplary Embodiment

Figure 1:
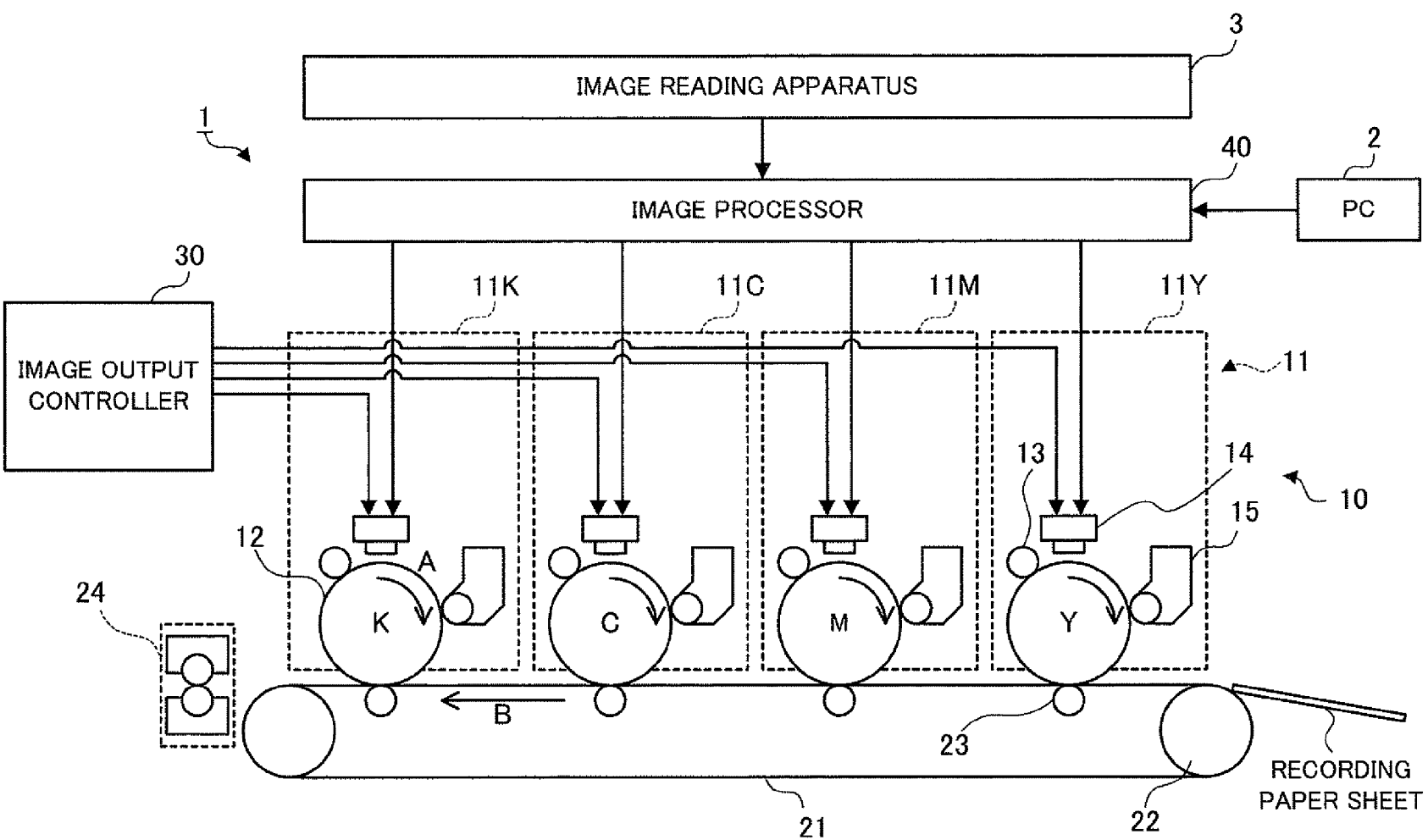
FIG. 1 is a diagram showing an example of an overall configuration of an image forming apparatus to which the first exemplary embodiment is applied.

FIG. 1 is a diagram showing an example of an overall configuration of an image forming apparatus 1 to which the first exemplary embodiment is applied. The image forming apparatus 1 shown in FIG. 1 is what is generally termed as a tandem image forming apparatus. The image forming apparatus 1 includes an image forming process unit 10, an image output controller 30 and an image processor 40. The image forming process unit 10 forms an image in accordance with different color image data. The image output controller 30 controls the image forming process unit 10. The image processor 40, which is connected to devices such as a personal computer (PC) 2 and an image reading apparatus 3, performs predefined image processing on image data received from the above devices.

The image forming process unit 10 includes image forming units 11 formed of plural engines arranged in parallel at intervals set in advance. The image forming units 11 are formed of four image forming units 11Y, 11M, 11C and 11K. Each of the image forming units 11Y, 11M, 11C and 11K includes a photoconductive drum 12, a charging device 13, a print head 14 and a developing device 15. On the photoconductive drum 12, which is an example of an image carrier, an electrostatic latent image is formed, and the photoconductive drum 12 retains a toner image. The charging device 13, as an example of a charging unit, charges the surface of the photoconductive drum 12 at a predetermined potential. The print head 14 exposes the photoconductive drum 12 charged by the charging device 13. The developing device 15, as an example of a developing unit, develops an electrostatic latent image formed by the print head 14. Here, the image forming units 11Y, 11M, 11C and 11K have approximately the same configuration excluding colors of toner put in the developing devices 15. The image forming units 11Y, 11M, 11C and 11K form yellow (Y), magenta (M), cyan (C) and black (K) toner images, respectively.

In addition, the image forming process unit 10 further includes a sheet transport belt 21, a drive roll 22, transfer rolls 23 and a fixing device 24. The sheet transport belt 21 transports a recording sheet as an example of a transferred body so that different color toner images respectively formed on the photoconductive drums 12 of the image forming units 11Y, 11M, 11C and 11K are transferred on the recording sheet by multilayer transfer. The drive roll 22 is a roll that drives the sheet transport belt 21. Each transfer roll 23, as an example of a transfer unit, transfers a toner image formed on the corresponding photoconductive drum 12 onto the recording sheet. The fixing device 24 fixes the toner images on the recording sheet.

In this image forming apparatus 1, the image forming process unit 10 performs an image forming operation on the basis of various kinds of control signals supplied from the image output controller 30. Under the control by the image output controller 30, the image data received from the personal computer (PC) 2 or the image reading apparatus 3 is subjected to image processing by the image processor 40, and then the resultant data is supplied to the corresponding image forming unit 11. Then, for example in the black (K) color image forming unit 11K, the photoconductive drum 12 is charged at a predetermined potential by the charging device 13 while rotating in an arrow A direction, and then is exposed by the print head 14 emitting light on the basis of the image data supplied from the image processor 40. By this operation, the electrostatic latent image for the black (K) color image is formed on the photoconductive drum 12. Thereafter, the electrostatic latent image formed on the photoconductive drum 12 is developed by the developing device 15, and accordingly the black (K) color toner image is formed on the photoconductive drum 12. Similarly, yellow (Y), magenta (M) and cyan (C) color toner images are formed in the image forming units 11Y, 11M and 11C, respectively.

The respective color toner images on the photoconductive drums 12, which are formed in the respective image forming units 11, are electrostatically transferred to the recording sheet supplied with the movement of the sheet transport belt 21 by a transfer electric field applied to the transfer rolls 23, in sequence. Here, the sheet transport belt 21 moves in an arrow B direction. By this operation, a synthetic toner image, which is superimposed color-toner images, is formed on the recording sheet.

Thereafter, the recording sheet on which the synthetic toner image is electrostatically transferred is transported to the fixing device 24. The synthetic toner image on the recording sheet transported to the fixing device 24 is fixed on the recording sheet through fixing processing using heat and pressure by the fixing device 24, and then is outputted from the image forming apparatus 1.

Figure 2:
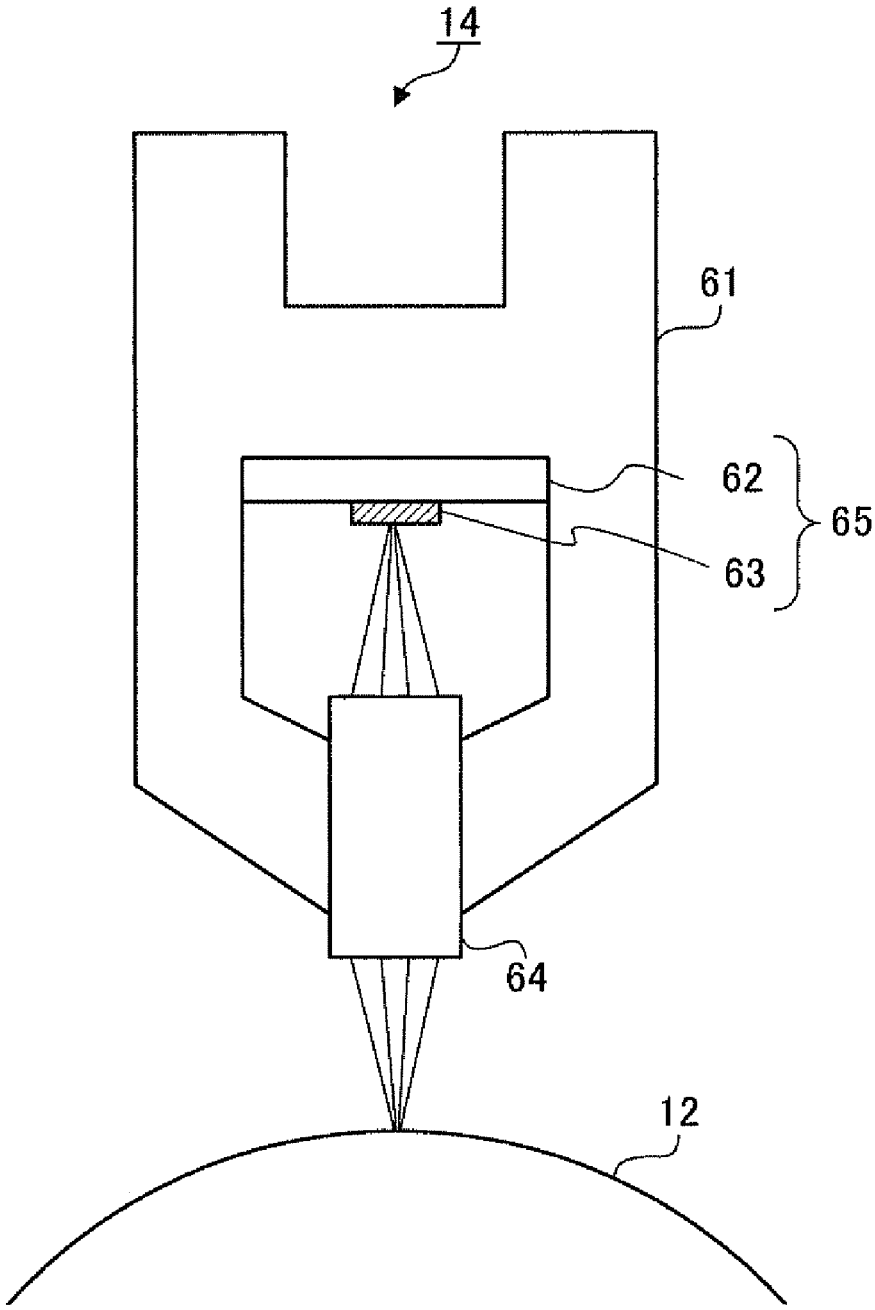
FIG. 2 is a cross-sectional view showing a configuration of the print head.

FIG. 2 is a cross-sectional view showing a configuration of the print head 14. The print head 14 includes a housing 61, a light-emitting device 65 and a rod lens array 64. The light-emitting device 65, as an example of an exposure unit, includes a light-emitting portion 63 formed of plural light-emitting elements (light-emitting thyristors in the first exemplary embodiment) that exposes the photoconductive drum 12. The rod lens array 64, as an example of an optical unit, focuses light emitted by the light-emitting portion 63 onto the surface of the photoconductive drum 12.

The light-emitting device 65 also includes a circuit board 62 on which the light-emitting portion 63, a signal generating circuit 100 (see FIG. 3 to be described later) driving the light-emitting portion 63, and the like are mounted.

The housing 61 is made of metal, for example, and supports the circuit board 62 and the rod lens array 64. The housing 61 is set so that the light-emitting points of the light-emitting elements in the light-emitting portion 63 are located on the focal plane of the rod lens array 64. In addition, the rod lens array 64 is arranged along an axial direction of the photoconductive drum 12 (the first scanning direction).

Figure 3:
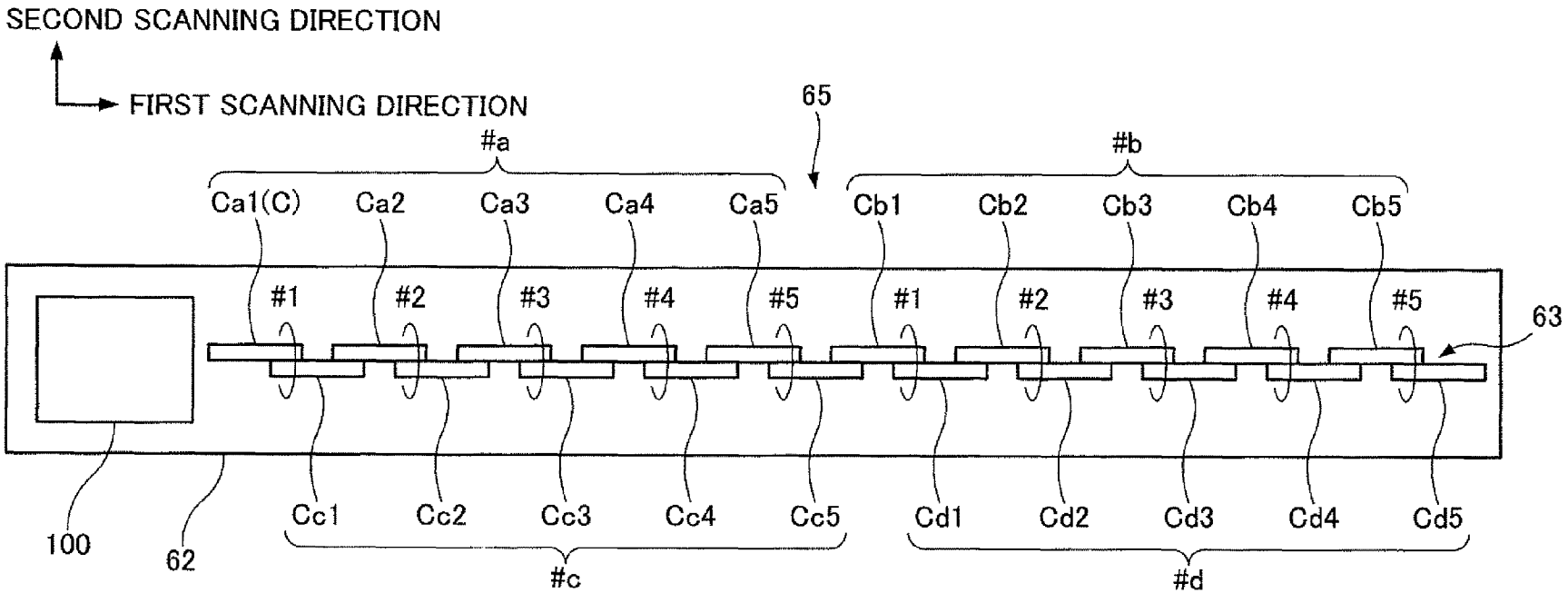
FIG. 3 is a top view of the light-emitting device in the first exemplary embodiment.

FIG. 3 is a top view of the light-emitting device 65 in the first exemplary embodiment.

As shown in FIG. 3, in the light-emitting device 65 according to the first exemplary embodiment, the light-emitting portion 63 is formed of five light-emitting chips Ca1 to Ca5 (a light-emitting chip group #a), five light-emitting chips Cb1 to Cb5 (a light-emitting chip group #b), five light-emitting chips Cc1 to Cc5 (a light-emitting chip group #c), five light-emitting chips Cd1 to Cd5 (a light-emitting chip group #d), all of which are arranged in a zigzag pattern in two lines in the first scanning direction on the circuit board 62. Here, the light-emitting chips Ca1 to Ca5 in the light-emitting chip group #a and the light-emitting chips Cc1 to Cc5 in the light-emitting chip group #c are arrayed in a zigzag pattern in which each adjacent two of the light-emitting chips face each other, while the light-emitting chips Cb1 to Cb5 in the light-emitting chip group #b and the light-emitting chips Cd1 to Cd5 in the light-emitting chip group #d are arrayed in a zigzag pattern in which each adjacent two of the light-emitting chips face each other.

Note that the light-emitting chips Ca1 to Ca5, Cb1 to Cb5, Cc1 to Cc5 and Cd1 to Cd5 may have the same configuration. Accordingly, when the light-emitting chips Ca1 to Ca5, Cb1 to Cb5, Cc1 to Cc5 and Cd1 to Cd5 are not individually distinguished, they are denoted by a light-emitting chip C.

In the first exemplary embodiment, the light-emitting portion 63 includes four light-emitting chip groups (the light-emitting chip groups #a, #b, #c and #d), as described above. Specifically, the light-emitting chip group #a includes the five light-emitting chips Ca1 to Ca5, the light-emitting chip group #b includes the five light-emitting chips Cb1 to Cb5, the light-emitting chip group #c includes the five light-emitting chips Cc1 to Cc5, and the light-emitting chip group #d includes the five light-emitting chips Cd1 to Cd5.

In the following description, the light-emitting chip group will be sometimes referred to simply as a group.

Furthermore, in the first exemplary embodiment, the light-emitting chips C belonging to the four light-emitting chip groups (the light-emitting chip groups #a, #b, #c and #d) are divided into five light-emitting chip classes (light-emitting chip classes #1, #2, #3, #4 and #5), as will be described later (see FIG. 7 to be described later). Specifically, the light-emitting chip class #1 includes the light-emitting chip Ca1 in the light-emitting chip group #a, the light-emitting chip Cb1 in the light-emitting chip group #b, the light-emitting chip Cc1 in the light-emitting chip group #c, and the light-emitting chip Cd1 in the light-emitting chip group #d.

The light-emitting chip class #2 includes the light-emitting chip Ca2 in the light-emitting chip group #a, the light-emitting chip Cb2 in the light-emitting chip group #b, the light-emitting chip Cc2 in the light-emitting chip group #c, and the light-emitting chip Cd2 in the light-emitting chip group #d. Similarly, each of the other light-emitting chip classes (the light-emitting chip classes #3, #4 and #5) is also formed of the light-emitting chips C having the same number as that of the corresponding light-emitting chip class.

In the following description, the light-emitting chip class will be sometimes referred to simply as a class.

The light-emitting device 65 includes the signal generating circuit 100 that drives the light-emitting portion 63, as described above.

Although the number of the light-emitting chips C is twenty in total in the first exemplary embodiment, the configuration is not limited to this. Additionally, although the twenty light-emitting chips C are divided into the four light-emitting chip groups and the five light-emitting chip classes, the configuration is not limited to this, either.

Figure 4:
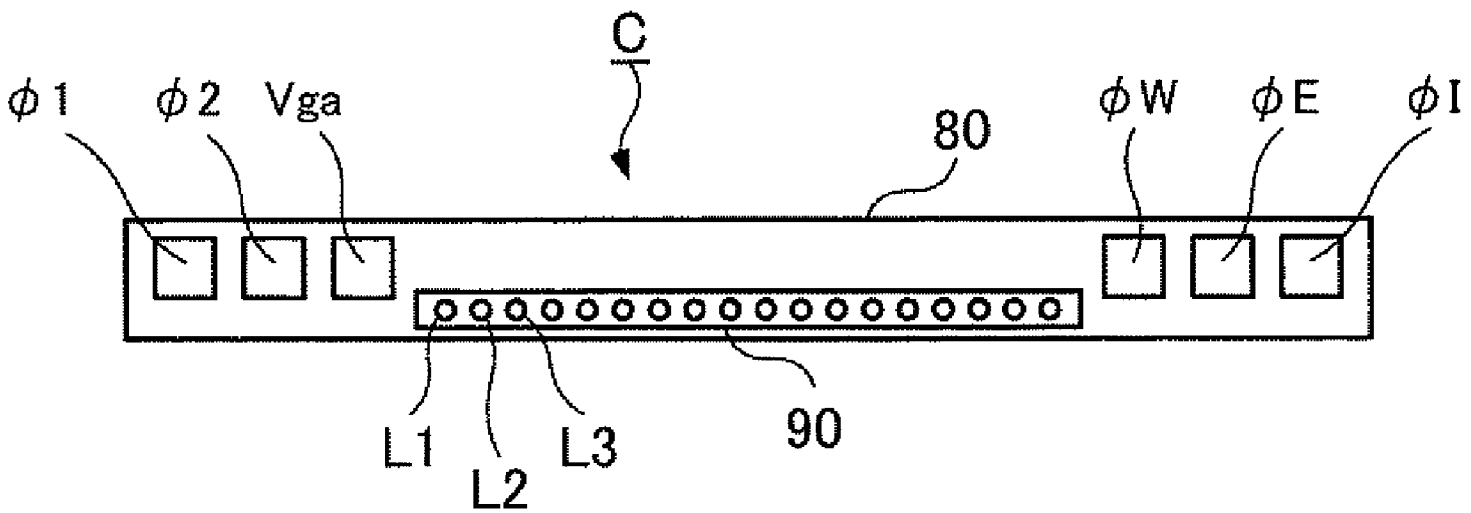
FIG. 4 is a diagram showing a configuration of terminals of the light-emitting chip.

FIG. 4 is a diagram showing a configuration of terminals of the light-emitting chip C.

The light-emitting chip C includes a light-emitting thyristor array 90 formed of the plural light-emitting elements (light-emitting thyristors L1, L2, L3 . . . in the first exemplary embodiment) provided in line along one of the longer sides on a substrate 80 (see FIGS. 9A and 9B to be described later). Additionally, the light-emitting chip C includes plural input terminals (a ϕ1 terminal, a ϕ2 terminal, a Vga terminal, a ϕW terminal, a ϕE terminal and a ϕI terminal) at both end portions, in a long-side direction, of the substrate 80. These input terminals are bonding pads for reading various control signals and the like. These input terminals are arranged in such a manner that the ϕ1 terminal, the ϕ2 terminal and the Vga terminal are arranged in this order from the left end portion of the substrate 80, and the ϕI terminal, the ϕE terminal and the ϕW terminal are arranged in this order from the right end portion of the substrate 80, when seen from the light-emitting thyristor array 90. The light-emitting thyristor array 90 is provided between the Vga terminal and the ϕW terminal.

Figure 5:
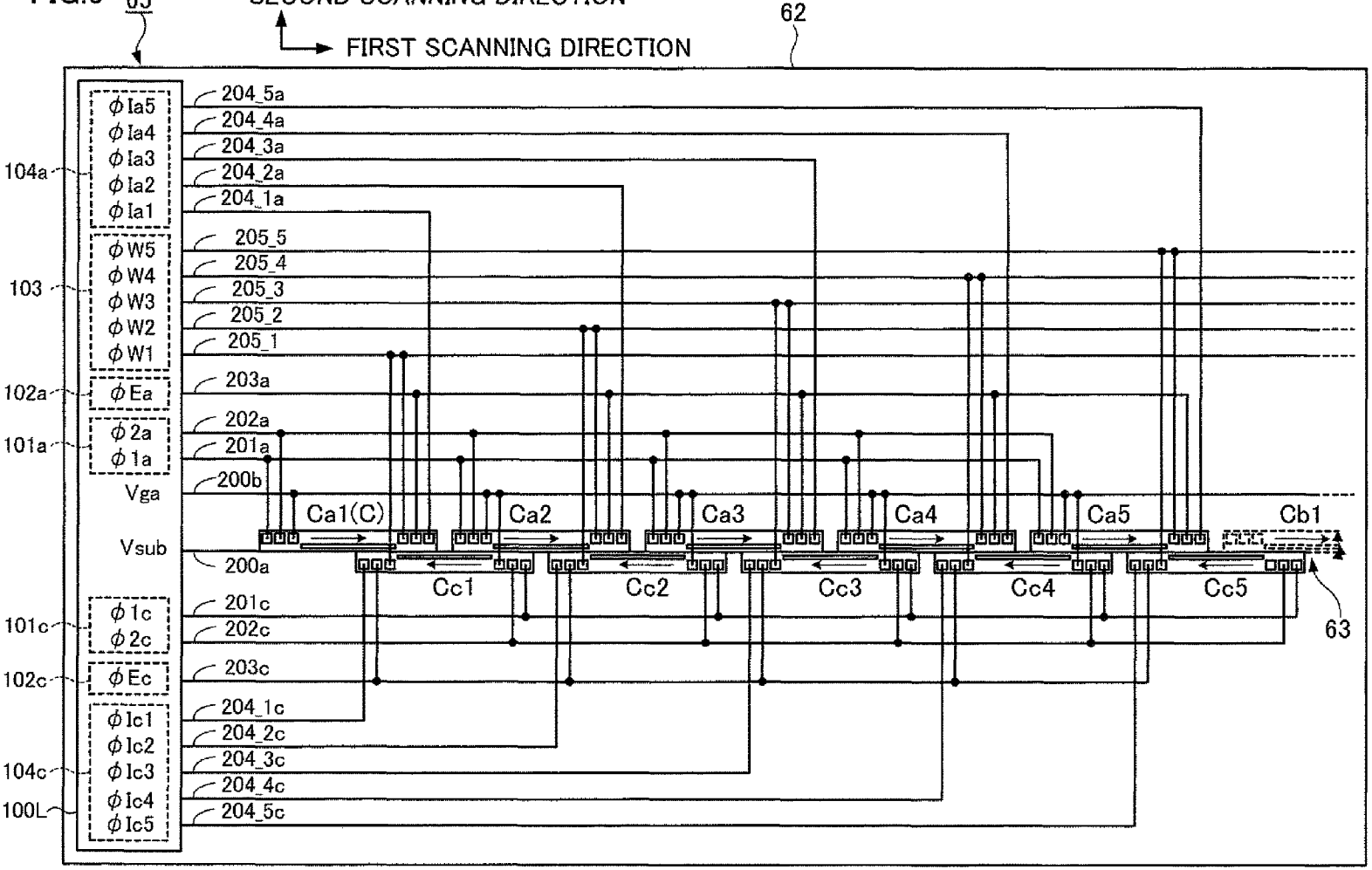
FIG. 5 is a diagram showing a wiring configuration (left half) on the circuit board of the light-emitting device in the first exemplary embodiment.
Figure 6:
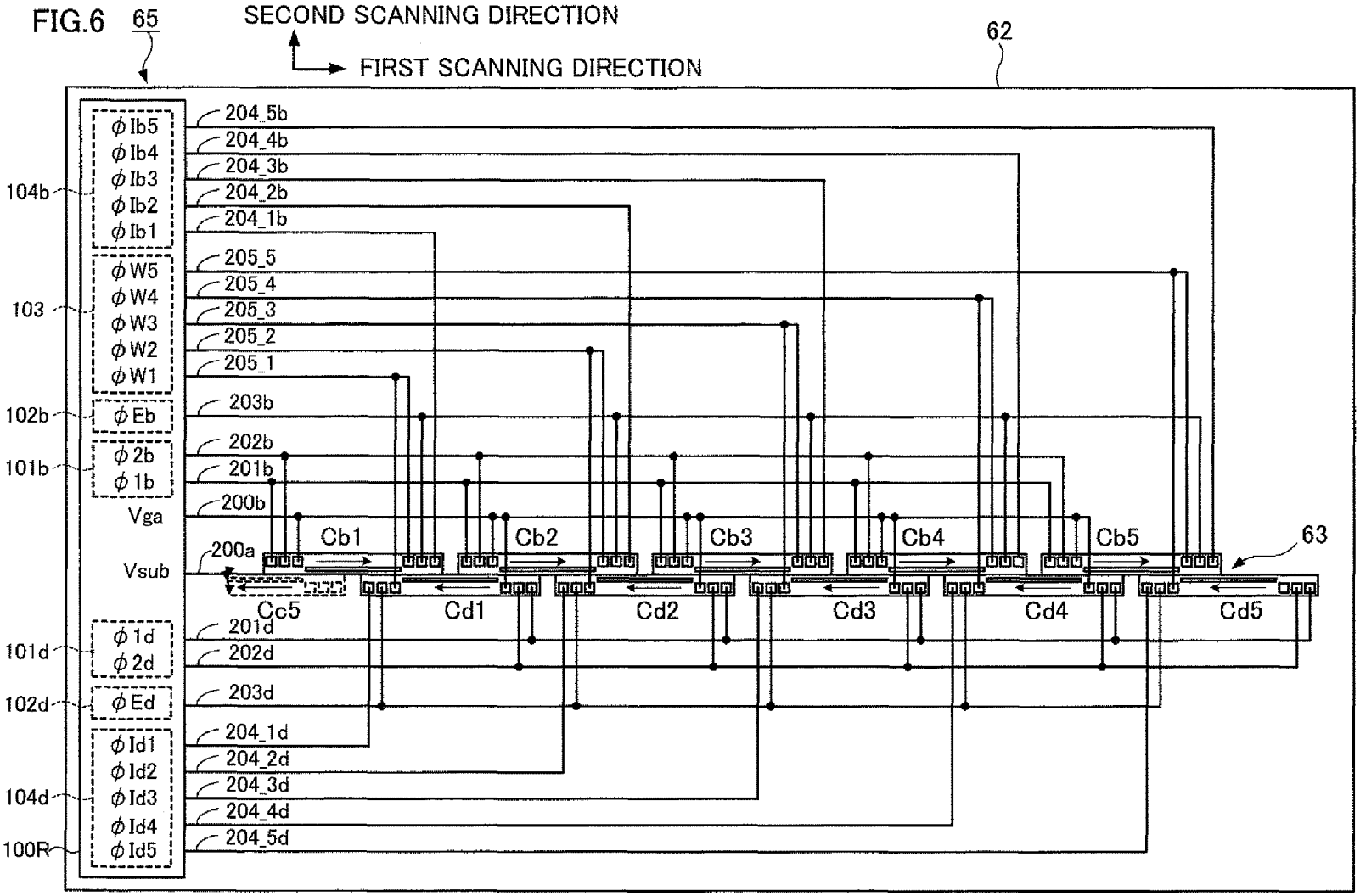
FIG. 6 is a diagram showing a wiring configuration (right half) on the circuit board of the light-emitting device in the first exemplary embodiment.

FIGS. 5 and 6 are diagrams showing a wiring configuration on the circuit board 62 of the light-emitting device 65 in the first exemplary embodiment. As described above, the circuit board 62 of the light-emitting device 65 has the signal generating circuit 100 and the plural light-emitting chips C (the light-emitting chips Ca1 to Ca5, Cb1 to Cb5, Cc1 to Cc5 and Cd1 to Cd5) forming the light-emitting portion 63 mounted thereon. Additionally, wirings are provided thereon to connect the signal generating circuit 100 and the light-emitting chips C (the light-emitting chips Ca1 to Ca5, Cb1 to Cb5, Cc1 to Cc5 and Cd1 to Cd5) with each other.

FIG. 5 shows the part of the light-emitting chips Ca1 to Ca5 and Cc1 to Cc5 (the left half of the light-emitting device 65 shown in FIG. 3), while FIG. 6 shows the part of the light-emitting chips Cb1 to Cb5 and Cd1 to Cd5 (the right half of the light-emitting device 65 shown in FIG. 3).

Note that FIGS. 5 and 6 show only a part related to the light-emitting chips Ca1 to Ca5 and Cc1 to Cc5, and the light-emitting chips Cb1 to Cb5 and Cd1 to Cd5, shown in the respective figures. FIGS. 5 and 6 also show wirings related to the light-emitting chips C shown in the respective figures. Furthermore, FIGS. 5 and 6 respectively show parts of the signal generating circuit 100 related to the light-emitting chips C shown in the respective figures, as a signal generating circuit 100L and a signal generating circuit 100R into which the signal generating circuit 100 is divided. However, a write signal generating part 103 that transmits write signals ϕW1 to ϕW5 to be described later, the Vga terminal and a Vsub terminal are doubly shown in the signal generating circuit 100L and the signal generating circuit 100R. Note that, hereinafter, the signal generating circuit 100L and the signal generating circuit 100R will not be distinguished from each other, and referred to as a signal generating circuit 100.

First, with reference to FIGS. 5 and 6, a description will be given of a configuration of the signal generating circuit 100.

To the signal generating circuit 100, image data subjected to the image processing and various kinds of control signals are inputted from the image output controller 30 and the image processor 40 (see FIG. 1), although the illustration thereof is omitted. Then, the signal generating circuit 100 performs rearrangement of the image data, correction of light amount and the like on the basis of the image data and the various kinds of control signals.

The signal generating circuit 100 includes a transfer signal generating part 101*a* that transmits a first transfer signal ϕ1*a* and a second transfer signal ϕ2*a* to the light-emitting chip group #a (the light-emitting chips Ca1 to Ca5) and a transfer signal generating part 101*c* that transmits a first transfer signal ϕ1*c* and a second transfer signal ϕ2*c* to the light-emitting chip group #c (the light-emitting chips Cc1 to Cc5), on the basis of the various kinds of control signals, as shown in FIG. 5. The signal generating circuit 100 also includes a transfer signal generating part 101*b* that transmits a first transfer signal ϕ1*b* and a second transfer signal ϕ2*b* to the light-emitting chip group #b (the light-emitting chips Cb1 to Cb5) and a transfer signal generating part 101*d* that transmits a first transfer signal ϕ1*d* and a second transfer signal ϕ2*d* to the light-emitting chip group #d (the light-emitting chips Cd1 to Cd5), on the basis of the various kinds of control signals, as shown in FIG. 6.

In the following description, when the first transfer signals ϕ1*a*, ϕ1*b*, ϕ1*c* and ϕ1*d* are not individually distinguished, they are called a first transfer signal ϕ1. When the second transfer signals ϕ2*a*, ϕ2*b*, ϕ2*c* and ϕ2*d* are not individually distinguished, they are called a second transfer signal ϕ2.

Moreover, the signal generating circuit 100 includes an enable signal generating part 102*a* that transmits an enable signal ϕEa to the light-emitting chip group #a (the light-emitting chips Ca1 to Ca5) and an enable signal generating part 102*c* that transmits an enable signal ϕEc to the light-emitting chip group #c (the light-emitting chips Cc1 to Cc5), on the basis of the various kinds of control signals, as shown in FIG. 5. The signal generating circuit 100 also includes an enable signal generating part 102*b* that transmits an enable signal ϕEb to the light-emitting chip group #b (the light-emitting chips Cb1 to Cb5) and an enable signal generating part 102*d* that transmits an enable signal ϕEd to the light-emitting chip group #d (the light-emitting chips Cd1 to Cd5), on the basis of the various kinds of control signals, as shown in FIG. 6.

In the following description, when the enable signals ϕEa, ϕEb, ϕEc and ϕEd are not individually distinguished, they are denoted by an enable signal ϕE.

Furthermore, the signal generating circuit 100 includes a light-up signal generating part 104*a* that transmits light-up signals ϕIa1 to ϕIa5 to the respective light-emitting chips Ca1 to Ca5 in the light-emitting chip group #a, and a light-up signal generating part 104*c* that transmits light-up signals ϕIc1 to ϕIc5 to the respective light-emitting chips Cc1 to Cc5 in the light-emitting chip group #c, as shown in FIG. 5. The signal generating circuit 100 also includes a light-up signal generating part 104*b* that transmits light-up signals ϕIb1 to ϕIb5 to the respective light-emitting chips Cb1 to Cb5 in the light-emitting chip group #b, and a light-up signal generating part 104*d* that transmits light-up signals ϕId1 to ϕId5 to the respective light-emitting chips Cd1 to Cd5 in the light-emitting chip group #d, as shown in FIG. 6.

In the following description, when the light-up signals ϕIa1 to ϕIa5 are not individually distinguished, they are denoted by a light-up signal ϕIa. Similarly, the other light-up signals ϕIb1 to ϕIb5, ϕIc1 to ϕIc5 and ϕId1 to ϕId5 are also denoted by light-up signals ϕIb, ϕIc and ϕId, respectively. Furthermore, when the light-up signals ϕIa, ϕIb, ϕIc and ϕId are not individually distinguished, they are denoted by a light-up signal ϕI.

Additionally, the signal generating circuit 100 includes the write signal generating part 103 as an example of a write signal supply unit that supplies the write signals ϕW1 to ϕW5 to the light-emitting chips C (Ca1 to Ca5, Cb1 to Cb5, Cc1 to Cc5 and Cd1 to Cd5), on the basis of the various kinds of control signals, as shown in FIGS. 5 and 6. Note that the write signal generating part 103 transmits the write signals ϕW1 to ϕW5 in common to the respective light-emitting chip classes (#1, #2, #3, #4 and #5). Specifically, the write signal generating part 103 transmits the write signal ϕW1 in common to the light-emitting chips C in the light-emitting chip class #1, and transmits the write signal ϕW2 in common to the light-emitting chips C in the light-emitting chip class #2. The same is true for the other light-emitting chip classes (#3, #4 and #5).

When the write signals ϕW1 to ϕW5 are not individually distinguished, they are denoted by a write signal ϕW.

Although shown separately in FIGS. 5 and 6, the transfer signal generating parts 101*a*, 101*b*, 101*c* and 101*d* are collectively referred to as a transfer signal generating part 101 as an example of a transfer signal supply unit. Similarly, although shown separately, the enable signal generating parts 102*a*, 102*b*, 102*c* and 102*d* are collectively referred to as an enable signal generating part 102 as an example of an enable signal supply unit. Furthermore, although shown separately, the light-up signal generating parts 104*a*, 104*b*, 104*c* and 104*d* are collectively referred to as a light-up signal generating part 104 as an example of a light-up signal supply unit.

Next, with reference to FIGS. 5 and 6, a description will be given of wirings that connect the signal generating circuit 100 and the light-emitting chips C (Ca1 to Ca5, Cb1 to Cb5, Cc1 to Cc5 and Cd1 to Cd5) with each other.

The circuit board 62 is provided with a power supply line 200*a* connected to the Vsub terminal (see FIGS. 8 and 9A to be described later) that is a back-side electrode 85 (see FIG. 98 to be described later) provided on a back-side of the light-emitting chip C. Through the power supply line 200*a*, a reference potential Vsub is supplied. In addition, the circuit board 62 is provided with a power supply line 200*b* connected to the Vga terminal provided to the light-emitting chip C. Through the power supply line 200*b*, a power supply potential Vga for power supply is supplied.

Moreover, as shown in FIG. 5, the circuit board 62 is provided with a first transfer signal line 201*a* and a second transfer signal line 202*a*. From the transfer signal generating part 101*a* of the signal generating circuit 100, the first transfer signal ϕ1*a* is transmitted through the first transfer signal line 201*a* to the ϕ1 terminal of each of the light-emitting chips Ca1 to Ca5 in the light-emitting chip group #a, and the second transfer signal ϕ2*a* is transmitted through the second transfer signal line 202*a* to the ϕ2 terminal of each of the light-emitting chips Ca1 to Ca5 in the light-emitting chip group #a. The first transfer signal ϕ1*a* and the second transfer signal ϕ2*a* are transmitted in common (in parallel) to the light-emitting chips Ca1 to Ca5 in the light-emitting chip group #a. The same is true for the other first transfer signals ϕ1*b*, ϕ1*c* and ϕ1*d* and the other second transfer signals ϕ2*b*, ϕ2*c* and ϕ2*d*. Thus, the detailed description thereof is omitted.

A pair of the first transfer signal ϕ1 and the second transfer signal ϕ2 is transmitted in common for each of the light-emitting chip groups.

Note that in FIGS. 5 and 6, each of the signal lines are indicated with a combination of a number and an alphabet indicating a group (for example, the first transfer signal line is indicated with 201*a* that consists of "201" and "a" indicating the light-emitting chip group #a).

The circuit board 62 is provided with an enable signal line 203*a* through which the enable signal ϕEa is transmitted from the enable signal generating part 102*a* of the signal generating circuit 100 to the ϕE terminal of each of the light-emitting chips Ca1 to Ca5 in the light-emitting chip group #a. The enable signal ϕEa is transmitted in common (in parallel) to the light-emitting chips Ca1 to Ca5 in the light-emitting chip group #a. The same is true for the other enable signals ϕEb to ϕEd. Thus, the detailed description thereof is omitted.

The enable signals ϕE are transmitted in common for the respective light-emitting chip groups.

Furthermore, the circuit board 62 is provided with light-up signal lines 204_1*a* to 204_5*a* through which the light-up signals ϕIa1 to ϕIa5 are transmitted from the light-up signal generating part 104*a* of the signal generating circuit 100 to the respective ϕI terminals of the light-emitting chips Ca1 to Ca5 in the light-emitting chip group #a. Specifically, the light-up signals ϕIa1 to ϕIa5 are individually transmitted to the respective light-emitting chips Ca1 to Ca5. The same is true for the other light-up signals ϕIb1 to ϕIb5, ϕIc1 to ϕIc5 and ϕId1 to ϕId5. Thus, the detailed description thereof is omitted.

The light-up signals ϕI are individually transmitted to the respective light-emitting chips C.

Furthermore, the circuit board 62 is provided with write signal lines 205_1 to 205_5 through which the write signals ϕW (ϕW1 to ϕW5) are transmitted in common from the write signal generating part 103 of the signal generating circuit 100 to each of the light-emitting chip classes (#1 to #5).

For example, the write signal line 205_1 is connected to the ϕW terminals of the light-emitting chip Ca1 in the light-emitting chip group #a, the light-emitting chip Cb1 in the light-emitting chip group #b, the light-emitting chip Cc1 in the light-emitting chip group #c and the light-emitting chip Cd1 in the light-emitting chip group #d, which belong to the light-emitting chip class #1, and transmits the write signal ϕW1 therethrough. Similarly, the write signal lines 205_2 to 205_5 are respectively connected to the ϕW terminals of the light-emitting chips C in the light-emitting chip classes #2 to #5, and respectively transmit the write signals ϕW2 to ϕW5 therethrough.

As described above, all the light-emitting chips C on the circuit board 62 are commonly supplied with the reference potential Vsub and the power supply potential Vga.

The transfer signals $\phi 1$ and $\phi 2$, and the enable signal $\phi E$ are transmitted in common for each of the light-emitting chip groups (#a to #d).

On the other hand, the write signals $\phi W$ are transmitted in common to the respective light-emitting chip classes (#1 to #5).

The light-up signals $\phi I$ are individually transmitted to the respective light-emitting chips C.

Figure 7:
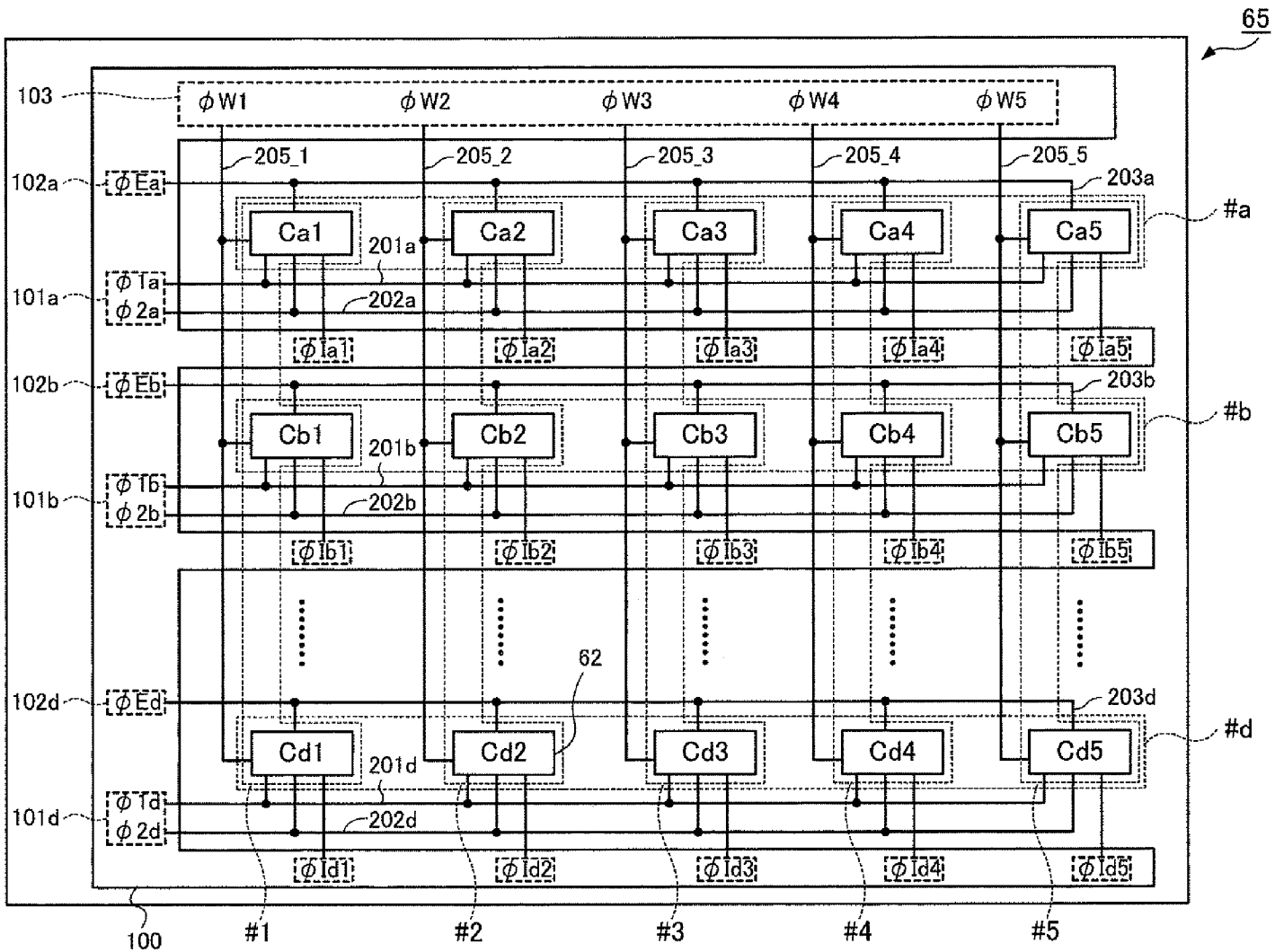
FIG. 7 is a diagram showing the light-emitting chips arranged as matrix elements, in the light-emitting device according to the first exemplary embodiment.

FIG. 7 is a diagram showing the light-emitting chips C arranged as matrix elements, in the light-emitting device 65 according to the first exemplary embodiment.

FIG. 7 shows the light-emitting chips C (the light-emitting chips Ca1 to Ca5, Cb1 to Cb5, Cc1 to Cc5 and Cd1 to Cd5) arranged as respective elements in a 4×5 matrix form, and shows only the wirings (signal lines) of signal (the transfer signals $\phi 1$ and $\phi 2$, the enable signals $\phi E$, the light-up signals $\phi I$ and the write signals $\phi W$) transmitted from the above-mentioned signal generating circuit 100 to the respective light-emitting chips C.

It is easily understood that the transfer signals $\phi 1$ and $\phi 2$, and the enable signal $\phi E$ are transmitted in common to each of the light-emitting chip groups (#a to #d), the write signals $\phi W$ are transmitted in common to the respective light-emitting chip classes (#1 to #5), and the light-up signals $\phi I$ are individually transmitted to the respective light-emitting chips C, as described above.

Here, a description will be given of the number of the wirings (signal lines) on the circuit board 62 in the first exemplary embodiment in which twenty light-emitting chips C are used. First, the number of wirings (signal lines) for the transfer signals $\phi 1$ and $\phi 2$ is eight for the four light-emitting chip groups (#a to #d), since there are two for each of the light-emitting chip groups. The number of wirings (signal lines) for the enable signals $\phi E$ is four for the four light-emitting chip groups (#a to #d), since there is one for each of the light-emitting chip groups. The number of wirings (signal lines) for the write signals $\phi W$ is five for the five light-emitting chip classes (#1 to #5), since there is one for each of the light-emitting chip classes. The number of wirings (signal lines) for the light-up signals $\phi I$ is twenty for the twenty light-emitting chips C, since there is one for each of the light-emitting chips C. In addition, there are the power supply line 200*a* for the reference potential Vsub and the power supply line 200*b* for the power supply potential Vga. Accordingly, the number of the wirings (signal lines) on the circuit board 62 in the first exemplary embodiment is thirty-nine.

If the number of the light-emitting chips C is M×N (M groups and N classes), the number of the wirings (signal lines) is as follows. The number of wirings (signal lines) for the transfer signals $\phi 1$ and $\phi 2$ is 2×M for the M light-emitting chip groups, since there are two for each of the light-emitting chip groups. The number of wirings (signal lines) for the enable signals $\phi E$ is M for the M light-emitting chip groups, since there is one for each of the light-emitting chip groups. The number of wirings (signal lines) for the write signals $\phi W$ is N for the N light-emitting chip classes, since there is one for each of the light-emitting chip classes. The number of wirings (signal lines) for the light-up signals $\phi I$ is M×N, since there is one for each of the light-emitting chips C. In addition, there are the power supply line 200*a* for the reference potential Vsub and the power supply line 200*b* for the power supply potential Vga. Accordingly, the number of the wirings (signal lines) on the circuit board 62 in which the number of the light-emitting chips C is M×N is (3×M+N+M×N+2).

Figure 8:
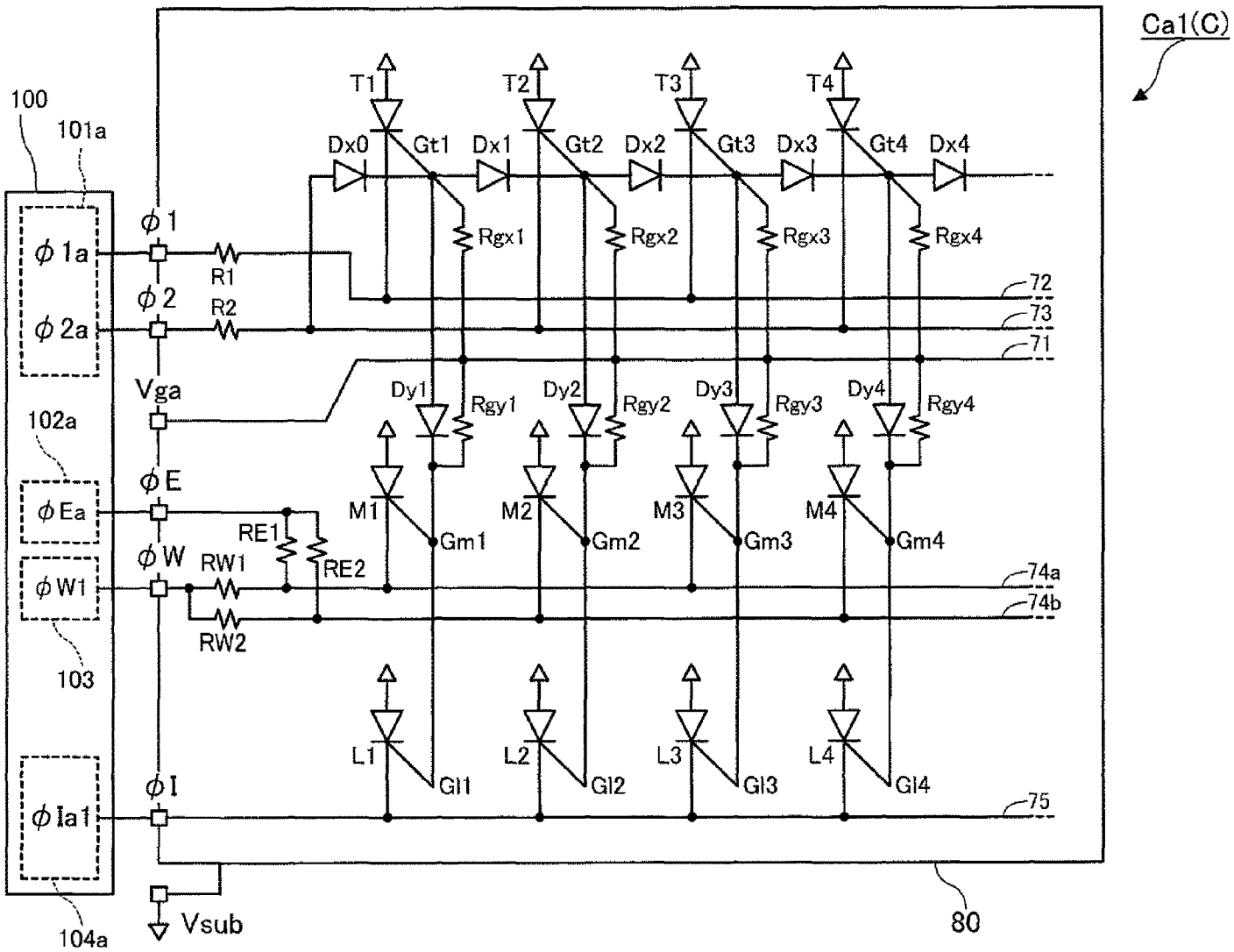
FIG. 8 is an equivalent circuit diagram for explaining a circuit configuration of the light-emitting chip that is a self-scanning light-emitting device array (SLED), in the first exemplary embodiment.

FIG. 8 is an equivalent circuit diagram for explaining a circuit configuration of the light-emitting chip C that is a self-scanning light-emitting device array (SLED), in the first exemplary embodiment. Note that, in FIG. 8, the input terminals (the Vga terminal, the $\phi 1$ terminal, the $\phi 2$ terminal, the $\phi E$ terminal, the $\phi W$ terminal and the $\phi I$ terminal) are shown on the left edge of the figure, unlike FIG. 4. However, each element described below except for the input terminals (the Vga terminal, the $\phi 1$ terminal, the $\phi 2$ terminal, the $\phi E$ terminal, the $\phi W$ terminal and the $\phi I$ terminal) is arranged based on the layout of each light-emitting chip C as shown in FIGS. 9A and 9B to be described later.

Here, the light-emitting chip C is described by using the light-emitting chip Ca1 as an example, and thus, the light-emitting chip C is denoted by the light-emitting chip Ca1 (C). The configuration of the other light-emitting chips C (Ca2 to Ca5, Cb1 to Cb5, Cc1 to Cc5 and Cd1 to Cd5) are the same as that of the light-emitting chip Ca1.

Note that the other signals, such as the first transfer signal $\phi 1$, are also denoted by the first transfer signal $\phi 1a$ ($\phi 1$) and the like, for example, which indicates the signal for the light-emitting chips Ca1 and the signals that are not distinguished from each other.

The light-emitting chip Ca1 (C) includes the light-emitting thyristor array (the light-emitting thyristor array 90 in FIG. 4) formed of the light-emitting thyristors L1, L2, L3 . . . as an example of light-emitting elements arrayed in line on the substrate 80 (see FIGS. 9A and 9B to be described later), as described above.

Moreover, the light-emitting chip Ca1 (C) includes: a transfer thyristor array formed of transfer thyristors T1, T2, T3 . . . as an example of transfer elements arrayed in line, similarly to the light-emitting thyristor array; and a memory thyristor array formed of memory thyristors M1, M2, M3 . . . as an example of memory elements similarly arrayed in line.

Here, when the light-emitting thyristors L1, L2, L3 . . . , the transfer thyristors T1, T2, T3 . . . and the memory thyristors M1, M2, M3 . . . are not individually distinguished, they are denoted by a light-emitting thyristor L, a transfer thyristor T and a memory thyristor M, respectively.

Note that the above-mentioned thyristors (the light-emitting thyristors L, the transfer thyristors T and the memory thyristors M) are semiconductor devices each having three terminals that are an anode terminal, a cathode terminal and a gate terminal.

Also, the light-emitting chip Ca1 (C) includes coupling diodes Dx1, Dx2, Dx3 . . . that are located between respective pairs of two adjacent transfer thyristors T1, T2, T3 . . . taken in an ascending order of the indices. The light-emitting chip Ca1 (C) also includes connection diodes Dy1, Dy2, Dy3 . . . between the respective transfer thyristors T1, T2, T3 . . . and the respective memory thyristors M1, M2, M3 . . . .

The light-emitting chip Ca1 (C) further includes power supply line resistances Rgx1, Rgx2, Rgx3 . . . and power supply line resistances Rgy1, Rgy2, Rgy3 . . . .

Similarly to the light-emitting thyristors L and the like, when the coupling diodes Dx1, Dx2, Dx3 . . . , the connection diodes Dy1, Dy2, Dy3 . . . , the power supply line resistances Rgx1 Rgx2, Rgx3 . . . and the power supply line resistances Rgy1, Rgy2, Rgy3 . . . are not individually distinguished, they are denoted by a coupling diode Dx, a connection diode Dy, a power supply line resistance Rgx and a power supply line resistance Rgy, respectively.

The light-emitting thyristors L1, L2, L3 . . . in the light-emitting thyristor array, the transfer thyristors T1, T2, T3 . . . in the transfer thyristor array and the memory thyristors M1, M2, M3 . . . in the memory thyristor array are arranged in an ascending order of the indices from the left in FIG. 8. Furthermore, the coupling diodes Dx1, Dx2, Dx3 . . . , the connection diodes Dy1, Dy2, Dy3 . . . , the power supply line resistances Rgx1 Rgx2, Rgx3 . . . and the power supply line resistances Rgy1, Rgy2, Rgy3 . . . are also arranged in an ascending order of the indices from the left in FIG. 8.

The light-emitting thyristor array, the transfer thyristor array and the memory thyristor array are arranged in the order of the transfer thyristor array, the memory thyristor array and the light-emitting thyristor array from the top to the bottom in FIG. 8.

FIG. 8 shows the part centered on the light-emitting thyristors L1 to L4, the memory thyristors M1 to M4 and the transfer thyristors T1 to T4. However, the number of the light-emitting thyristors L in the light-emitting thyristor array may be a predetermined number. If the number of the light-emitting thyristors L is 128, each number of the transfer thyristors T and the memory thyristors M is also 128. Similarly, each number of the connection diodes Dy, the power supply line resistances Rgx and the power supply line resistances Rgy is also 128. However, the number of the coupling diodes Dx is one less than that of the transfer thyristors T, namely, 127.

Note that each number of the transfer thyristors T and the memory thyristors M may be greater than that of the light-emitting thyristors L.

The light-emitting chip Ca1 (C) includes one start diode Dx0. The light-emitting chip Ca1 (C) further includes current limitation resistances R1 and R2 to prevent an excess current from flowing through a first transfer signal line 72 for transmitting the first transfer signal $\phi 1a$ ($\phi 1$) and a second transfer signal line 73 for transmitting the second transfer signal $\phi 2a$ ($\phi 2$) to be described later. Furthermore, the light-emitting chip Ca1 (C) includes write resistances RW1 and RW2, and enable resistances RE1 and RE2.

Next, electrical connection of the elements in the light-emitting chip Ca1 (C) will be described.

The anode terminal of each transfer thyristor T, the anode terminal of each memory thyristor M and the anode terminal of each light-emitting thyristor L are connected to the substrate 80 of the light-emitting chip Ca1 (C) (anode common).

These anode terminals are then connected to the power supply line 200*a* (see FIGS. 5 and 6) via the Vsub terminal that is the back-side electrode 85 (see FIG. 9B to be described later) provided on the back-side of the substrate 80. The reference potential Vsub is supplied to the power supply line 200*a*.

The cathode terminals of the odd-numbered transfer thyristors T1, T3 . . . are connected to the first transfer signal line 72 along the arrangement of the transfer thyristors T. The first transfer signal line 72 is then connected to the $\phi 1$ terminal, which is an input terminal of the first transfer signal $\phi 1a$ ($\phi 1$), via the current limitation resistance R1. The first transfer signal line 201*a* (see FIG. 5) is connected to the $\phi 1$ terminal to transmit the first transfer signal $\phi 1a$.

On the other hand, the cathode terminals of the even-numbered transfer thyristors T2, T4 . . . are connected to the second transfer signal line 73 along the arrangement of the transfer thyristors T. The second transfer signal line 73 is then connected to the $\phi 2$ terminal, which is an input terminal of the second transfer signal $\phi 2a$ ($\phi 2$), via the current limitation resistance R2. The second transfer signal line 202*a* (see FIG. 5) is connected to the $\phi 2$ terminal to transmit the second transfer signal $\phi 2a$.

The cathode terminals of the odd-numbered memory thyristors M1, M3 . . . are connected to a first write signal line 74*a* along the arrangement of the memory thyristors M. The first write signal line 74*a* is then connected to the $\phi$W terminal, which is an input terminal of the write signal $\phi$W1, via the write resistance RW1. The write signal line 205_1 (see FIG. 5) is connected to the $\phi$W terminal to transmit the write signal $\phi$W1 ($\phi$W).

On the other hand, the cathode terminals of the even-numbered memory thyristors M2, M4 . . . are connected to a second write signal line 74*b* along the arrangement of the memory thyristors M. The second write signal line 74*b* is then connected to the $\phi$W terminal, which is the input terminal of the write signal $\phi$W1, via the write resistance RW2.

Also, the first write signal line 74*a* is connected to the $\phi$E terminal, which is an input terminal of the enable signal $\phi$Ea ($\phi$E), via the enable resistance RE1, between the cathode terminal of the memory thyristor M1 and the write resistance RW1. The enable signal line 203*a* (see FIG. 5) is connected to the $\phi$E terminal to transmit the enable signal $\phi$Ea ($\phi$E).

Furthermore, the second write signal line 74*b* is connected to the $\phi$E terminal via the enable resistance RE2, between the cathode terminal of the memory thyristor M2 and the write resistance RW2.

That is, the first write signal line 74*a* and the second write signal line 74*b* are connected to the $\phi$E terminal and the $\phi$W terminal, via a resistance network formed by the enable resistances RE1 and RE2 and the write resistances RW1 and RW2.

The cathode terminals of the light-emitting thyristors L are connected to a light-up signal line 75. The light-up signal line 75 is then connected to the $\phi$I terminal, which is an input terminal of the light-up signal $\phi$Ia ($\phi$I). The light-up signal line 204_1*a* (see FIG. 5) is connected to the $\phi$I terminal to transmit the light-up signal $\phi$Ia ($\phi$I).

The gate terminals Gt1, Gt2, Gt3 . . . of the transfer thyristors T are respectively connected to the same numbered gate terminals Gm1, Gm2, Gm3 . . . of the memory thyristors M1, M2, M3 . . . on one-to-one basis, via the connection diodes Dy1, Dy2, Dy3 . . . . Specifically, the anode terminals of the connection diodes Dy1, Dy2, Dy3 . . . are respectively connected to the gate terminals Gt1, Gt2, Gt3 . . . of the transfer thyristors T1, T2, T3 . . . . The cathode terminals of the connection diodes Dy1, Dy2, Dy3 . . . are respectively connected to the gate terminals Gm1, Gm2, Gm3 . . . of the memory thyristors M1, M2, M3 . . . . That is, the same numbered transfer thyristors T and the memory thyristors M are provided so as to correspond with each other.

On the other hand, the gate terminals Gm1, Gm2, Gm3 . . . of the memory thyristors M1, M2, M3 . . . are respectively connected to the same numbered gate terminals G11, G12, G13 . . . of the light-emitting thyristors L1, L2, L3 . . . on one-to-one basis. That is, the gate terminals Gm1, Gm2, Gm3 . . . of the memory thyristors M1, M2, M3 . . . have the same potential as the gate terminals G11, G12, G13 . . . . Thus, for example, the gate terminal Gm1 is denoted by a gate terminal Gm1 (G11) or a gate terminal G11 (Gm1). That is, the same numbered memory thyristors M and the light-emitting thyristors L are provided so as to correspond with each other.

In the first exemplary embodiment, the same numbered transfer thyristors T, the memory thyristors M and the light-emitting thyristors L are provided so as to correspond with one another.

Here, when the gate terminals Gt1, Gt2, Gt3 . . . , the gate terminals Gm1, Gm2, Gm3 . . . and the gate terminals G11, G12, G13 . . . are not individually distinguished, they are denoted by a gate terminal Gt, a gate terminal Gm and a gate terminal G1, respectively.

Thus, each of the connection diodes Dy is arranged in a direction so that a current flows from the gate terminal Gt of the transfer thyristor T to the gate terminal Gm of the memory thyristor M.

The gate terminals Gt of the transfer thyristors T are connected to a power supply line 71 via the respective power supply line resistances Rgx, which are provided so as to correspond to the respective transfer thyristors T. The power supply line 71 is then connected to the Vga terminal. The Vga terminal is connected to the power supply line 200*b* (see FIG. 5) to supply the power supply potential Vga.

The gate terminals Gm of the memory thyristors M are connected to the power supply line 71 via the respective power supply line resistances Rgy, which are provided so as to correspond to the respective memory thyristors M.

The coupling diodes Dx1, Dx2, Dx3 . . . are connected between respective pairs of two adjacent gate terminals Gt taken sequentially from the gate terminals Gt1, Gt2, Gt3 . . . of the transfer thyristors T1, T2, T3 . . . . That is, the coupling diodes Dx1, Dx2, Dx3 . . . are connected in series so as to be inserted between adjacent gate terminals Gt1 and Gt2, Gt2 and Gt3, Gt3 and Gt4 . . . , respectively. The coupling diode Dx1 is arranged in a direction so that a current flows from the gate terminal Gt1 to the gate terminal Gt2. The other coupling diodes Dx2, Dx3, Dx4 . . . are also arranged in the same manner.

The gate terminal Gt1 of the transfer thyristor T1 on one end side of the transfer thyristor array is connected to the cathode terminal of the start diode Dx0. The anode terminal of the start diode Dx0 is connected to the second transfer signal line 73.

In the first exemplary embodiment, the light-emitting chip Ca1 (C) includes the first write signal line 74*a* connected to the cathode terminals of the odd-numbered memory thyristors M, and the second write signal line 74*b* connected to the cathode terminals of the even-numbered memory thyristors M. By selecting the values of the enable resistances RE1 and RE2 and the write resistances RW1 and RW2, the potentials applied to the ϕE terminal and the ϕW terminal control the potentials of the first write signal line 74*a* and the second write signal line 74*b*. Thereby, an odd-numbered light-emitting thyristor L and the subsequent even-numbered light-emitting thyristor L may be lighted up in parallel (simultaneously), as will be described later.

Figure 9B:
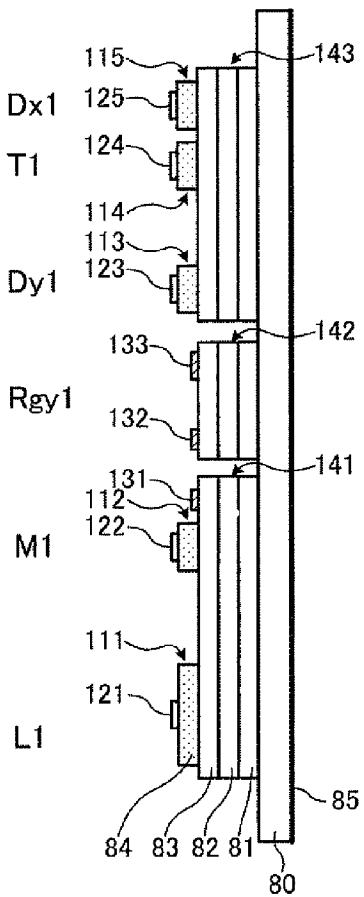
FIGS. 9A and 9B are a planar layout and a cross-sectional view of the light-emitting chip in the first exemplary embodiment.
Figure 9A:
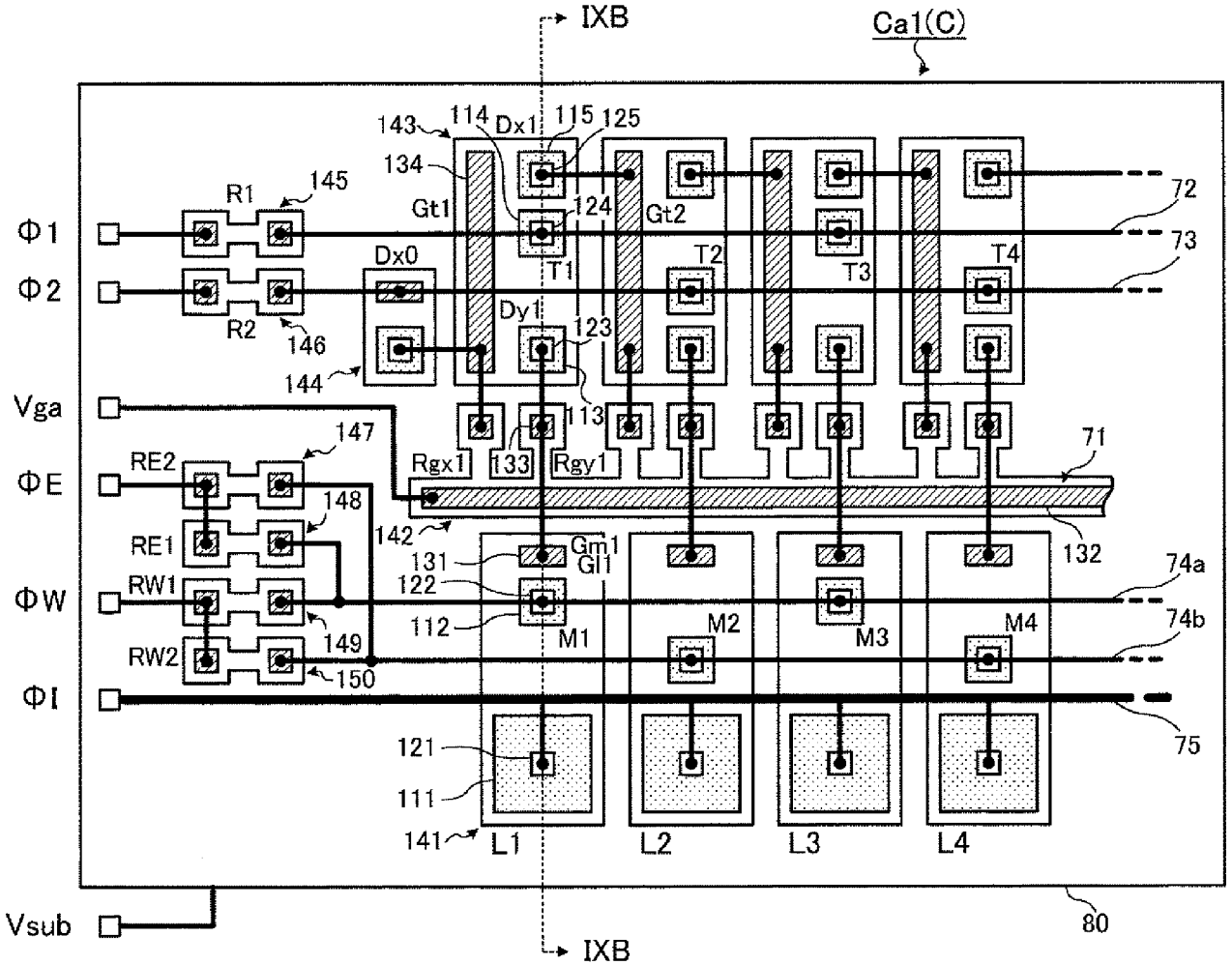

FIGS. 9A and 9B are a planar layout and a cross-sectional view of the light-emitting chip C in the first exemplary embodiment. Here, the light-emitting chip Ca1 is described as an example. FIG. 9A is a planar layout of the light-emitting chip Ca1 (C), and shows the part centered on the light-emitting thyristors L1 to L4, the memory thyristors M1 to M4 and the transfer thyristors T1 to T4. FIG. 9B is a cross-sectional view taken along the line IXB-IXB shown in FIG. 9A. Thus, FIG. 9B shows the cross sections of the light-emitting thyristor L1, the memory thyristor M1, the power supply line resistance Rgy1, the connection diode Dy1, the transfer thyristor T1 and the coupling diode Dx1 in the order from the bottom to the top of FIG. 9B. In FIGS. 9A and 9B, main elements and terminals are denoted by their names.

In FIG. 9A, wirings connecting the elements are shown with solid lines except for the power supply line 71. In FIG. 9B, illustration of wirings connecting the elements is omitted.

As shown in FIG. 9B, the light-emitting chip Ca1 (C) includes plural islands (a first island 141 to a tenth island 150) formed as follows. For example, with a composite semiconductor of GaAs, GaAlAs or the like, a p-type first semiconductor layer 81, an n-type second semiconductor layer 82, a p-type third semiconductor layer 83 and an n-type fourth semiconductor layer 84 are stacked in this order on the p-type substrate 80. The p-type first semiconductor layer 81, the n-type second semiconductor layer 82, the p-type third semiconductor layer 83, and the n-type fourth semiconductor layer 84 are then etched successively at peripheries. Thereby, the islands separated from one another are formed.

As shown in FIG. 9A, the first island 141 is provided with the light-emitting thyristor L1 and the memory thyristor M1.

The second island 142 includes a trunk extending from side to side in FIG. 9A and plural branches arising from the trunk as shown in FIG. 9A. The trunk is provided with the power supply line 71, and the branches are provided with the power supply line resistances Rgx and Rgy.

The third island 143 is provided with the transfer thyristor T1, the coupling diode Dx1 and the connection diode Dy1. The fourth island 144 is provided with the start diode Dx0. The fifth island 145, the sixth island 146, the seventh island 147, the eighth island 148, the ninth island 149 and the tenth island 150 are provided with the current limitation resistance R1, the current limitation resistance R2, the enable resistance RE2, the enable resistance RE1, the write resistance RW1 and the write resistance RW2, respectively.

In the light-emitting chip Ca1 (C), islands similar to the first island 141 and the third island 143 are formed in parallel. These islands are provided with the light-emitting thyristors L2, L3, L4 . . . , the memory thyristors M2, M3, M4 . . . , the transfer thyristors T2, T3, T4 . . . and the like, in a similar manner as the first island 141 and the third island 143. The description thereof is omitted.

Also, the back-side electrode 85 as the Vsub terminal is provided on the back-side of the substrate 80.

Here, the first island 141 to the tenth island 150 are described in detail with reference to FIGS. 9A and 9B.

The light-emitting thyristor L1 provided in the first island 141 has the anode terminal of the substrate 80, the cathode terminal of an n-type ohmic electrode 121 formed on a region 111 of the n-type fourth semiconductor layer 84, and the gate terminal G11 of a p-type ohmic electrode 131 formed on the p-type third semiconductor layer 83 which has been exposed after etching to remove the n-type fourth semiconductor layer 84. Light is emitted from the surface of the region 111 of the n-type fourth semiconductor layer 84 except the portion where the n-type ohmic electrode 121 is formed.

The memory thyristor M1 provided in the first island 141 has the anode terminal of the substrate 80, the cathode terminal of an n-type ohmic electrode 122 formed on a region 112 of the n-type fourth semiconductor layer 84, and the gate terminal Gm1 of the p-type ohmic electrode 131 on the p-type third semiconductor layer 83 which has been exposed after etching to remove the n-type fourth semiconductor layer 84. The p-type ohmic electrode 131 serves as the gate terminal G11 and the gate terminal Gm1.

The power supply line 71 provided in the second island 142 is formed of a p-type ohmic electrode 132 formed on the p-type third semiconductor layer 83 which has been exposed after etching to remove the n-type fourth semiconductor layer 84.

The power supply line resistances Rgx and Rgy provided similarly in the second island 142 are formed between two p-type ohmic electrodes formed on the p-type third semiconductor layer 83 which has been exposed after etching to remove the n-type fourth semiconductor layer 84. The power supply line resistances Rgx and Rgy use the p-type third semiconductor layer 83 between the two p-type ohmic electrodes as a resistance. For example, the power supply line resistance Rgy1 is formed between the p-type ohmic electrode 132 and a p-type ohmic electrode 133 provided on the p-type third semiconductor layer 83.

The transfer thyristor T1 provided in the third island 143 has the anode terminal of the substrate 80, the cathode terminal of an n-type ohmic electrode 124 formed on a region 114 of the n-type fourth semiconductor layer 84, and the gate terminal Gt1 of a p-type ohmic electrode 134 formed on the p-type third semiconductor layer 83 which has been exposed after etching to remove the n-type fourth semiconductor layer 84.

The connection diode Dy1 provided similarly in the third island 143 is formed so as to have the cathode terminal of an n-type ohmic electrode 123 provided on a region 113 of the n-type fourth semiconductor layer 84, and the anode terminal of the p-type ohmic electrode 134 formed on the p-type third semiconductor layer 83. The anode terminal of the connection diode Dy1 and the gate terminal Gt1 of the transfer thyristor T1 are the p-type ohmic electrode 134 in common.

Furthermore, the coupling diode Dx1 provided similarly in the third island 143 is formed so as to have the cathode terminal of an n-type ohmic electrode 125 provided on a region 115 of the n-type fourth semiconductor layer 84, and the anode terminal of the p-type ohmic electrode 134 formed on the p-type third semiconductor layer 83. The anode terminal of the coupling diode Dx1 and the gate terminal Gt1 of the transfer thyristor T1 are the p-type ohmic electrode 134 in common.

The start diode Dx0 provided in the fourth island 144 is formed so as to have the cathode terminal of an n-type ohmic electrode (with no reference numeral) formed on the n-type fourth semiconductor layer 84, and the anode terminal of a p-type ohmic electrode (with no reference numeral) formed on the p-type third semiconductor layer 83 which has been exposed after removing the n-type fourth semiconductor layer 84.

In a similar manner as the power supply line resistances Rgx1 and Rgy1, the current limitation resistance R1 provided in the fifth island 145, the current limitation resistance R2 provided in the sixth island 146, the enable resistance RE2 provided in the seventh island 147, the enable resistance RE1 provided in the eighth island 148, the write resistance RW1 provided in the ninth island 149 and the write resistance RW2 provided in the tenth island 150 use the p-type third semiconductor layer 83 as a resistance, which is located between a pair of p-type ohmic electrodes (with no reference numeral) formed on the p-type third semiconductor layer 83.

A connection relationship between the elements in FIG. 9A will be described.

The p-type ohmic electrode 131, which is the gate terminal G11 of the light-emitting thyristor L1 in the first island 141, is connected to the p-type ohmic electrode 133 of the power supply line resistance Rgy1 in the second island 142, and is further connected to the n-type ohmic electrode 123, which is the cathode terminal of the connection diode Dy1 in the third island 143. The n-type ohmic electrode 121, which is the cathode terminal of the light-emitting thyristor L1, is connected to the light-up signal line 75. The light-up signal line 75 is connected to the ϕI terminal. Although a description is omitted, the light-emitting thyristors L2, L3, L4 . . . are arranged in the same manner.

The n-type ohmic electrode 122, which is the cathode terminal of the memory thyristor M1 (the odd-numbered memory thyristor M) in the first island 141, is connected to the first write signal line 74*a*. The first write signal line 74*a* is then connected to the ϕW terminal via the write resistance RW1 provided in the ninth island 149.

The first write signal line 74*a* is connected to one terminal of the enable resistance RE1 provided in the eighth island 148 between the write resistance RW1 and the n-type ohmic electrode 122, which is the cathode terminal of the memory thyristor M1. The other terminal of the enable resistance RE1 is connected to the ϕE terminal.

On the other hand, an n-type ohmic electrode (with no reference numeral) that is the cathode terminal of the memory thyristor M2 (the even-numbered memory thyristor M) adjacently provided is connected to the second write signal line 74*b*. The second write signal line 74*b* is then connected to the ϕW terminal via the write resistance RW2 provided in the tenth island 150.

The second write signal line 74*b* is connected to one terminal of the enable resistance RE2 provided in the seventh island 147 between the write resistance RW2 and the n-type ohmic electrode (with no reference numeral), which is the cathode terminal of the memory thyristor M2. The other terminal of the enable resistance RE2 is connected to the ϕE terminal.

The p-type ohmic electrode 132, which is the power supply line 71 provided in the second island 142, is connected to the Vga terminal.

The p-type ohmic electrode (with no reference numeral) of the power supply line resistance Rgx1 provided in the second island 142 is connected to the p-type ohmic electrode 134, which is the gate terminal Gt1 of the transfer thyristor T1 provided in the third island 143.

The n-type ohmic electrode 124, which is the cathode terminal of the transfer thyristor T1 provided in the third island 143, is connected to the first transfer signal line 72. The first transfer signal line 72 is connected to the ϕ1 terminal via the current limitation resistance R1 provided in the fifth island 145.

The n-type ohmic electrode 125, which is the cathode terminal of the coupling diode Dx1 provided in the third island 143, is connected to a p-type ohmic electrode (with no reference numeral) that is the gate terminal Gt2 of the transfer thyristor T2 provided adjacent to the n-type ohmic electrode 125.

On the other hand, the p-type ohmic electrode 134, which is the gate terminal Gt1 of the transfer thyristor T1 provided in the third island 143, is connected to the n-type ohmic electrode (with no reference numeral) formed on the n-type fourth semiconductor layer 84, which is the cathode terminal of the start diode Dx0 provided in the fourth island 144.

The p-type ohmic electrode (with no reference numeral) formed on the p-type third semiconductor layer 83, which is the anode terminal of the start diode Dx0 provided in the fourth island 144, is connected to the n-type ohmic electrode (with no reference numeral) formed on the n-type fourth semiconductor layer 84, which is the cathode terminal of the even-numbered transfer thyristor T, as well as connected to the ϕ2 terminal via the current limitation resistance R2 provided in the sixth island 146.

Although a description is omitted here, the other light-emitting thyristors L, transfer thyristors T, memory thyristors M, coupling diodes Dx and connection diodes Dy are arranged in the same manner.

In this manner, the circuit configuration of the light-emitting chip Ca1 (C) shown in FIG. 8 is formed.

Next, an operation of the light-emitting device 65 will be described.

The light-emitting device 65 includes the light-emitting chip group #a (the light-emitting chips Ca1 to Ca5), the light-emitting chip group #b (the light-emitting chips Cb1 to Cb5), the light-emitting chip group #c (the light-emitting chips Cc1 to Cc5) and the light-emitting chip group #d (the light-emitting chips Cd1 to Cd5) (see FIGS. 3, 5, 6 and 7).

Moreover, these light-emitting chips C are divided into the light-emitting chip class #1 (the light-emitting chips Ca1, Cb1, Cc1 and Cd1), the light-emitting chip class #2 (the light-emitting chips Ca2, Cb1, Cc2 and Cd2), the light-emitting chip class #3 (the light-emitting chips Ca3, Cb3, Cc3 and Cd3), the light-emitting chip class #4 (the light-emitting chips Ca4, Cb4, Cc4 and Cd4) and the light-emitting chip class #5 (the light-emitting chips Ca5, Cb5, Cc5 and Cd5).

As shown in FIGS. 5 and 6, all the light-emitting chips C on the circuit board 62 are commonly supplied with the reference potential Vsub and the power supply potential Vga.

A pair of the transfer signals ϕ1 and ϕ2, and the enable signal ϕE are transmitted in common for each of the light-emitting chip groups. The write signals ϕW are transmitted in common to the respective light-emitting chip classes.

Figure 10:
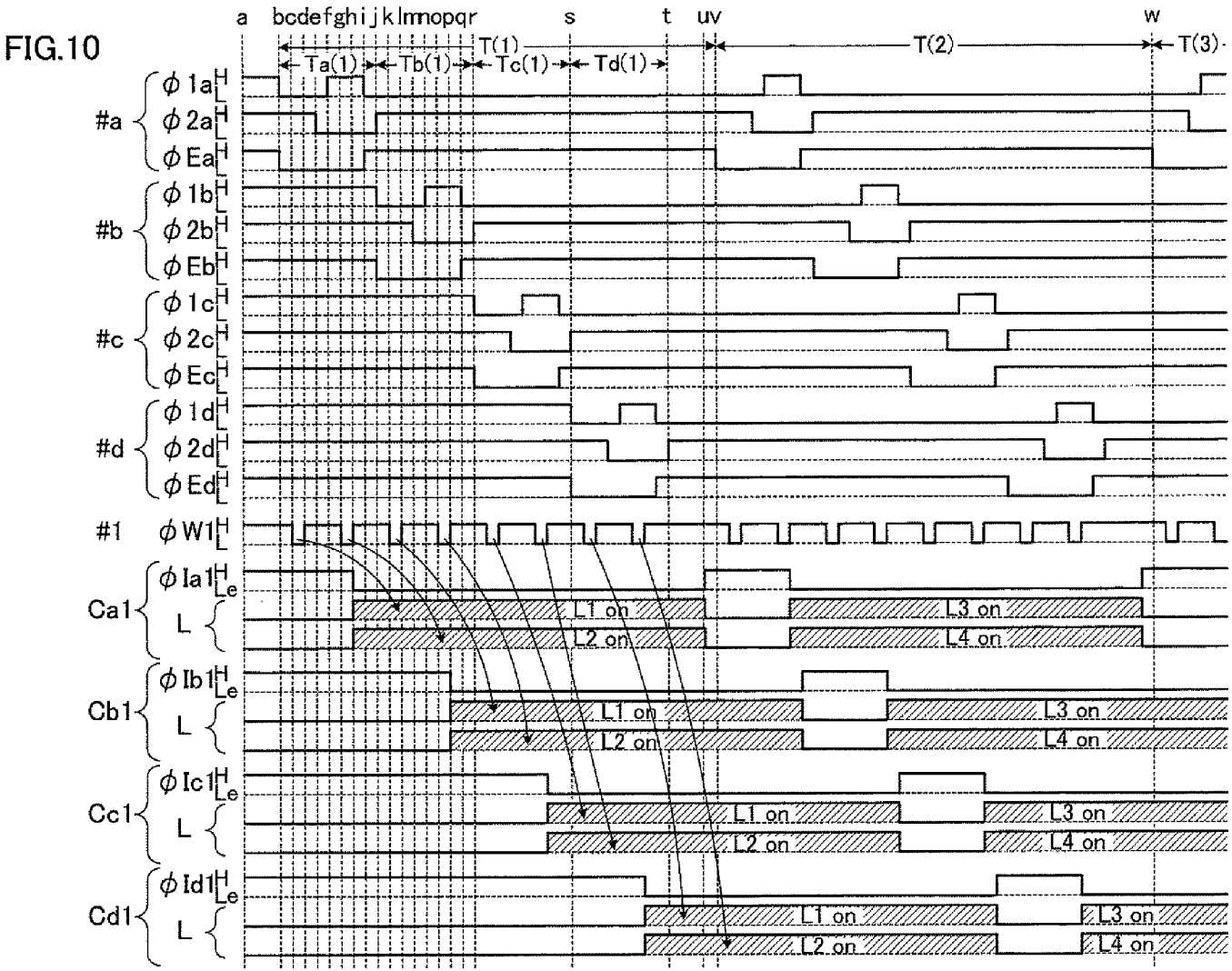
FIG. 10 is a timing chart for explaining the operation of the light-emitting device in the first exemplary embodiment.

FIG. 10 is a timing chart for explaining the operation of the light-emitting device 65 in the first exemplary embodiment.

FIG. 10 shows pairs of the transfer signals ϕ1 and ϕ2, and the enable signals ϕE transmitted in common for the respective light-emitting chip groups (#a, #b, #c and #d). FIG. 10 also shows the write signal ϕW1 transmitted to the light-emitting chip class #1. Furthermore, FIG. 10 shows the light-up signals ϕIa1, ϕIb1, ϕIc1 and ϕId1 respectively transmitted to the light-emitting chips Ca1, Cb1, Cc1 and Cd1 belonging to the light-emitting chip class #1. Additionally, FIG. 10 shows the light-emitting thyristors L lighted up with these signals, in the light-emitting chips Ca, Cb1, Cc1 and Cd1.

That is, FIG. 10 is a timing chart explaining the operation of the light-emitting chips Ca1, Cb1, Cc1 and Cd1 belonging to the light-emitting chip class #1.

Note that the other light-emitting chip classes #2 to #5 operate similarly to the light-emitting chip class #1, because the transfer signals ϕ1 and ϕ2, and the enable signals ϕE are common for the light-emitting chip classes #1 to #5. Accordingly, the description of the other light-emitting chip classes #2 to #5 is omitted.

In the first exemplary embodiment, two light-emitting thyristors L at the maximum that are an odd-numbered light-emitting thyristor L and the subsequent even-numbered light-emitting thyristor L may be lighted up in parallel. Specifically, all the following may be allowed: two light-emitting thyristors L are both lighted up; only one of the two light-emitting thyristors L is lighted up; and the two light-emitting thyristors L are both unlighted. In the timing chart of FIG. 10, all the light-emitting thyristors L are assumed to be lighted up (emit light).

Note that hereinafter control of lighting up and not lighting up of the light-emitting thyristors L is referred to as light-control.

Suppose that time elapses from a time point a to a time point w alphabetically in the timing chart of FIG. 10. The light-emitting thyristors L1 and L2 of each of the light-emitting chips Ca1, Cb1, Cc1 and Cd1 in the light-emitting chip class #1 are light-controlled in a period T(1) that is from a time point b to a time point v. The light-emitting thyristors L3 and L4 of each of the light-emitting chips Ca1, Cb1, Cc1 and Cd1 in the light-emitting chip class #1 are then light-controlled in a period T(2) that is from the time point v to the time point w. As shown in FIG. 10, a period (a light-up period) during which the light-emitting thyristors L1 and L2 of each of the light-emitting chips Ca1, Cb1, Cc1 and Cd1 are lighted up (emit light) overlaps with the period T(1) and the next period T(2). The same is true for the other light-emitting thyristors L.

Subsequently, the light-emitting thyristors L having numbers five or more are light-controlled.

In the first exemplary embodiment, the periods T(1), T(2) . . . have the same length, and are referred to as a period T when not differentiated from one another.

Note that the length of the period T may be variable as long as relationships among the signals described below are maintained.

The first transfer signals ϕ1 (ϕ1*a*, ϕ1*b*, ϕ1*c* and ϕ1*d*), the second transfer signals ϕ2 (ϕ2*a*, ϕ2*b*, ϕ2*c* and ϕ2*d*) and the enable signals ϕE (ϕEa, ϕEb, ϕEc and ϕEd) in the periods T(1), T(2) . . . repeat the same waveforms, unlike the write signal ϕW1 that varies depending on image data.

Accordingly, the period T(1) that is from the time point b to the time point v will be described below. Note that a period from the time point a to the time point b is a period in which the light-emitting chips C start the operation. Signals in this period will be described in a description of the operation.

A description will be given of the first transfer signals ϕ1 (ϕ1*a*, ϕ1*b*, ϕ1*c* and ϕ1*d*), the second transfer signals ϕ2 (ϕ2*a*, ϕ2*b*, ϕ2*c* and ϕ2*d*) and the enable signals ϕE (ϕEa, ϕEb, ϕEc and ϕEd).

The first transfer signal ϕ1*a* is a low-level potential (hereinafter, referred to as "L") at the time point b, changes from "L" to a high-level potential (hereinafter, referred to as "H") at a time point f, changes from "H" to "L" at a time point i, and is maintained at "L" at a time point u.

The second transfer signal ϕ2*a* is "H" at the time point b, changes from "H" to "L" at a time point e, changes from "L" to "H" at a time point j, and is maintained at "H" at the time point v.

The enable signal ϕEa changes from "H" to "L" at the time point b, changes from "L" to "H" at the time point i, and is maintained at "H" at the time point u.

Next, the first transfer signal ϕ1*b* is "H" at the time point b, changes from "H" to "L" at the time point j, changes from "L" to "H" at a time point n, changes from "H" to "L" at a time point q, and is maintained at "L" at the time point v.

The second transfer signal ϕ2*b* is "H" at the time point b, changes from "H" to "L" at a time point m, changes from "L" to "H" at a time point r, and is maintained at "H" at the time point v.

The enable signal ϕEb is "H" at the time point b, changes from "H" to "L" at the time point j, changes from "L" to "H" at the time point q, and is maintained at "H" at the time point v.

Now, compare the first transfer signal ϕ1*a*, the second transfer signal ϕ2*a* and the enable signal ϕEa being a set of signals transmitted to the light-emitting chip group #a with the first transfer signal ϕ1*b*, the second transfer signal ϕ2*b* and the enable signal ϕEb being a set of signals transmitted to the light-emitting chip group #b. Then, the waveforms of the first transfer signal ϕ1*b*, the second transfer signal ϕ2*b* and the enable signal ϕEb in the period from the time point j to the time point r are the same as those of the first transfer signal ϕ1*a*, the second transfer signal ϕ2*a* and the enable signal ϕEa in the period from the time point b to the time point j.

Specifically, the waveforms of the first transfer signal ϕ1*b*, the second transfer signal ϕ2*b* and the enable signal ϕEb being a set of signals transmitted to the light-emitting chip group #b correspond to those of the first transfer signal ϕ1*a*, the second transfer signal ϕa and the enable signal ϕEa being a set of signals transmitted to the light-emitting chip group #a in the period from the time point b to the time point j shifted to a delayed point on a time axis, namely, shifted so that the time point b overlaps with the time point j.

Similarly, the waveforms of the first transfer signal ϕ1*c*, the second transfer signal ϕ2*c* and the enable signal ϕEc being a set of signals transmitted to the light-emitting chip group #c correspond to those of the first transfer signal ϕ1*a*, the second transfer signal ϕ2*a* and the enable signal ϕEa being a set of signals transmitted to the light-emitting chip group #a whose time point b is shifted to the time point r.

Furthermore, the waveforms of the first transfer signal $\phi 1d$, the second transfer signal $\phi 2d$ and the enable signal $\phi$Ed being a set of signals transmitted to the light-emitting chip group #d correspond to those of the first transfer signal $\phi 1a$, the second transfer signal $\phi 2a$ and the enable signal $\phi$Ea being a set of signals transmitted to the light-emitting chip group #a whose time point b is shifted to a time point s.

A period from the time point b to the time point j is referred to as a period Ta(1) in which the signals are supplied to the light-emitting chip group #a; a period from the time point j to the time point r is referred to as a period Tb(1) in which the signals are supplied to the light-emitting chip group #b; a period from the time point r to the time point s is referred to as a period Tc(1) in which the signals are supplied to the light-emitting chip group #c; and a period from the time point s to a time point t is referred to as a period Td(1) in which the signals are supplied to the light-emitting chip group #d.

The first transfer signal $\phi 1a$ and the second transfer signal $\phi 2a$ do not have a period during which both of the signals are "H" except for the period from the time point a to the time point b. That is, the first transfer signal $\phi 1a$ and the second transfer signal $\phi 2a$ repeat a period during which one of the signals is "H" and the other is "L," and a period during which both of the signals are "L."

The enable signal $\phi$Ea is "L" in a period during which at least one of the first transfer signal $\phi 1a$ and the second transfer signal $\phi 2a$ is "L."

Next, the write signal $\phi$W1 will be described.

The write signal $\phi$W1 is "H" at the time point b, changes from "H" to "L" at a time point c, changes from "L" to "H" at a time point d, changes from "H" to "L" at a time point g, changes from "L" to "H" at a time point h, and is maintained at "H" at the finishing time point j of the period Ta(1). As will be described later in detail, "L" in the period from the time point c to the time point d is a signal designating the light-emitting thyristor L1 to light up, and "L" in the period from the time point g to the time point h is a signal designating the light-emitting thyristor L2 to light up.

Thereafter, the waveform of the write signal $\phi$W1 in the period Ta(1) is repeated in the periods Tb(1), Tc(1) and Td(1). Thus, the detailed description of these periods is omitted. The write signal $\phi$W1 is maintained at "H" at the finishing time point v of the period T(1).

Next, the light-up signals $\phi$I ($\phi$Ia, $\phi$Ib, $\phi$Ic and $\phi$Id) will be described. The light-up signals $\phi$I are signals supplying the light-emitting thyristors L with a current for lighting up (emitting light), as will be described later.

The light-up signal $\phi$Ia1 is "H" at the time point b, and changes from "H" to a potential of a light-up level (hereinafter, referred to as "Le") (−2.8 V<"Le"≦−1.4 V) at the time point h, changes from "Le" to "H" at the time point u, and is maintained at "H" at the time point v.

The light-up signals $\phi$Ib1, $\phi$Ic1 and $\phi$Id1 are obtained by shifting the light-up signals $\phi$Ia1 to respective delayed points on the time axis, similarly to the first transfer signals $\phi$1, the second transfer signals $\phi$2 and the enable signals $\phi$E. Thus, the detailed description of the light-up signals $\phi$Ib1, $\phi$Ic1 and $\phi$Id1 is omitted. The relationships between the other light-up signals $\phi$Ia2 to $\phi$Ia5, $\phi$Ib2 to $\phi$Ib5, $\phi$Ic2 to $\phi$Ic5 and $\phi$Id2 to $\phi$Id5 are similar to the relationship between the light-up signals $\phi$Ia1, $\phi$Ib1, $\phi$Ic1 and $\phi$Id1. Thus, the detailed description thereof is also omitted.

Note that a range of the potential "Le" (−2.8 V<"Le"≦−1.4 V) will be described later.

As will be described later, by changing the write signal $\phi$W to "L" in a period when the enable signal $\phi$E is "L," a light-emitting thyristor L being a control target of lighting up and not lighting up (to be light-controlled) is controlled to be allowed to light up (emit light) (to have a higher threshold voltage). Accordingly, for example, in the period from the time point b to the time point i during which the enable signal $\phi$Ea is "L," the write signal $\phi$W1 becomes "L" in the period from the time point c to the time point d to make the light-emitting thyristor L1 of the light-emitting chip Ca1 be allowed to light up (emit light), and becomes "L" in the period from the time point g to the time point h to make the light-emitting thyristor L2 be allowed to light up (emit light). Similarly, in the period from the time point j to the time point q during which the enable signal $\phi$Eb is "L," the write signal $\phi$W1 becomes "L" in a period from a time point k to a time point l to make the light-emitting thyristor L1 of the light-emitting chip Cb1 be allowed to light up (emit light), and becomes "L" in a period from a time point o to a time point p to make the light-emitting thyristor L2 be allowed to light up (emit light). As described above, the write signal $\phi$W1 has two periods of "L" in a period during which the enable signal $\phi$E is "L" in order to make two light-emitting thyristors L be allowed to light up in parallel.

Before describing the operation of the light-emitting chip C, a description will be given of the basic operation of a thyristor (the transfer thyristor T, the memory thyristor M or the light-emitting thyristor L). Each of the thyristors is a semiconductor device having three terminals: an anode terminal, a cathode terminal and a gate terminal.

In the following, as an example, the reference potential Vsub supplied to the Vsub terminal, which is the anode terminals of the thyristors, shown in FIGS. 8 and 9A is set to 0 V ("H"), and the power supply potential Vga supplied to the Vga terminal is set to −3.3 V ("L"). Further, as shown in FIGS. 9A and 9B, the thyristors are supposed to be formed by stacking p-type semiconductor layers and n-type semiconductor layers formed of GaAs, GaAlAs or the like. A diffusion potential (a forward potential) Vd of a pn junction is set to 1.4 V. The following description is given with these numeral values.

A thyristor with no current flowing between the anode terminal and the cathode terminal changes to an ON state (gets turned on) when a potential lower than a threshold voltage V (a negatively-large potential) is applied to the cathode terminal. When turned on, the thyristor is in a state (the ON state) where a current is flowing between the anode terminal and the cathode terminal. Here, the threshold voltage of the thyristor is a value obtained by subtracting the diffusion potential Vd from the potential of the gate terminal. Thus, when the potential of the gate terminal of the thyristor is −1.4 V, the threshold voltage is −2.8 V. Accordingly, the thyristor gets turned on when a voltage lower than −2.8 V is applied to the cathode terminal.

Then, the gate terminal of the thyristor in the ON state has a potential close to the potential of the anode terminal thereof. Since the anode terminal is set to 0 V ("H") here, the following description is given assuming that the potential of the gate terminal becomes 0 V ("H"). Further, the cathode terminal of the thyristor in the ON state has a potential equal to the diffusion potential Vd of the pn junction. Here, the potential of the cathode terminal becomes −1.4 V.

When turned on, the thyristor maintains the ON state until the potential of the cathode terminal reaches a potential higher than a potential needed to maintain the ON state. Since the potential of the cathode terminal of the thyristor in the ON state is −1.4 V, the thyristor changes to an OFF state (gets turned off) when a potential higher than −1.4 V is applied to the cathode terminal. For example, when the cathode terminal becomes "H" (0 V), the cathode terminal and the anode terminal have the same potential, so that the thyristor gets turned off.

On the other hand, when a potential lower than −1.4 V (a maintaining voltage) is continuously applied to the cathode terminal of the thyristor and a current that allows the thyristor to maintain the ON state is supplied, the thyristor maintains the ON state.

As described above, when changed to the ON state, the thyristor maintains a state where a current flows therethrough and does not change to the OFF state depending on the potential of the gate terminal. That is, the thyristor has a function to maintain (memorize or hold) the ON state.

The potential continuously applied to the cathode terminal to maintain the ON state of the thyristor may be higher than the potential applied to the cathode terminal to turn on the thyristor.

The light-emitting thyristor L lights up (emits light) when turned on, and is unlighted (does not light up) when turned off. The light emission output (light emission amount) of the light-emitting thyristor L in the ON state depends on a current flowing between the cathode terminal and the anode terminal.

Next, a description will be given of the enable resistances RE1 and RE2 and the write resistances RW1 and RW2.

The first write signal line 74*a* and the second write signal line 74*b* are connected to the ϕE terminal and the ϕW terminal, via the resistance network formed by the enable resistances RE1 and RE2 and the write resistances RW1 and RW2. Accordingly, the potentials of the first write signal line 74*a* and the second write signal line 74*b* depend on those of the ϕE terminal and the ϕW terminal, and the values of the enable resistances RE1 and RE2 and the write resistances RW1 and RW2.

In the first exemplary embodiment, these values are set as RE1=RE2=1 kΩ and RW1=RW2=2 kΩ, for example.

Table 1 shows the potentials of the first write signal line 74*a* and the second write signal line 74*b* that are set depending on the potentials of the ϕE terminal (the enable signal ϕE) (denoted by ϕE) and the ϕW terminal (the write signal ϕW1) (denoted by ϕW), in a case where no memory thyristors M are in the ON state.

Specifically, if both of the ϕE terminal and the ϕW terminal are at 0 V ("H"), the potentials of the first write signal line 74*a* and the second write signal line 74*b* are 0 V ("H"). If both of the ϕE terminal and the ϕW terminal are at −3.3 V ("L"), the potentials of the first write signal line 74*a* and the second write signal line 74*b* are −3.3 V ("L"). On the other hand, if one of the ϕE terminal and the ϕW terminal is at 0 V ("H") and the other is at −3.3 V ("L"), the potentials of the first write signal line 74*a* and the second write signal line 74*b* are −2.2 V or −1.1 V, which are potentials divided by the enable resistance RE1 (RE2) and the write resistance RW1 (RW2).

Note that if an odd-numbered memory thyristor M is in the ON state, the potential of the first write signal line 74*a* becomes −1.4 V. However, if an even-numbered memory thyristor M is in the OFF state, the potential of the second write signal line 74*b* is not affected by the odd-numbered memory thyristor M in the ON state, and has the potential shown in Table 1.

TABLE 1

| | | POTENTIAL OF ϕ E | |
|---|---|---|---|
| | | 0V ([H]) | −3.3V ([L]) |
| POTENTIAL OF ϕW | 0V ([H]) | 0V ([H]) | −2.2V |
| | −3.3V ([L]) | −1.1V | −3.3V ([L]) |

Now, the operation of the light-emitting device 65 will be described according to the timing chart shown in FIG. 10 with reference to FIGS. 5, 6 and 8.

(1) Time Point a

A description will be given of the state (initial state) of the light-emitting device 65 at the time point a when supply of the reference potential Vsub and the power supply potential Vga is started.

<Light-Emitting Device 65>

At the time point a in the timing chart shown in FIG. 10, the potential of the power supply line 200*a* is set to the reference potential Vsub of "H" (0 V), and the potential of the power supply line 200*b* is set to the power supply potential Vga of "L" (−3.3 V) (see FIGS. 5 and 6). Thus, the Vsub and Vga terminals of all the light-emitting chips C are set to "H" and "L" (see FIG. 8), respectively.

The transfer signal generating parts 101*a*, 101*b*, 101*c* and 101*d* of the signal generating circuit 100 set the first transfer signal ϕ1*a* and the second transfer signal ϕ2*a*, the first transfer signal ϕ1*b* and the second transfer signal ϕ2*b*, the first transfer signal ϕ1*c* and the second transfer signal ϕ2*c*, and the first transfer signal ϕ1*d* and the second transfer signal ϕ2*d* to "H," respectively.

Then, the first transfer signal lines 201*a*, 201*b*, 201*c* and 201*d* and the second transfer signal lines 202*a*, 202*b*, 202*c* and 202*d* are set to "H" (see FIGS. 5 and 6). Accordingly, the respective ϕ1 and ϕ2 terminals of the light-emitting chips C are set to "H." The potential of the first transfer signal line 72 connected to the ϕ1 terminal via the current limitation resistance R1 is also set to "H," and the potential of the second transfer signal line 73 connected to the ϕ2 terminal via the current limitation resistance R2 is also set to "H" (see FIG. 8).

Moreover, the light-up signal generating part 104 of the signal generating circuit 100 sets the light-up signals ϕI (ϕIa1 to ϕIa5, ϕIb1 to ϕIb5, ϕIc1 to ϕIc5 and ϕId1 to ϕId5) to "H." Then, the light-up signal lines 204_1*a* to 204_5*a*, 204_1*b* to 204_5*b*, 204_1*c* to 204_5*c* and 204_1*d* to 204_5*d* are also set to "H" (see FIGS. 5 and 6). Accordingly, the respective ϕI terminals of the light-emitting chips C are set to "H." The light-up signal line 75 connected to the ϕI terminal is also set to "H" (see FIG. 8).

Furthermore, the enable signal generating parts 102*a*, 102*b*, 102*c* and 102*d* of the signal generating circuit 100 set the enable signals ϕEa, ϕEb, ϕEc and ϕEd to "H," respectively. Then, the enable signal lines 203*a*, 203*b*, 203*c* and 203*d* are set to "H" (see FIGS. 5 and 6). Accordingly, the respective ϕE terminals of the light-emitting chips C are set to "H" (see FIG. 8).

The write signal generating part 103 of the signal generating circuit 100 sets the write signals ϕW1 to ϕW5 to "H." Then, the write signal lines 205_1 to 205_5 are set to "H" (see FIGS. 5 and 6). Accordingly, the respective ϕW terminals of the light-emitting chips C are set to "H" (see FIG. 8).

The ϕW terminal of the light-emitting chip C is connected to the first write signal line 74*a* via the write resistance RW1, and is connected to the second write signal line 74*b* via the write resistance RW2. The ϕE terminal of the light-emitting chip C is connected to the first write signal line 74*a* via the enable resistance RE1, and is connected to the second write signal line 74*b* via the enable resistance RE2. Since both of the ϕW and ϕE terminals of the light-emitting chip C are set to "H" (0 V) as shown in Table 1, the first write signal line 74*a* and the second write signal line 74*b* are also set to "H" (0 V) (see FIG. 8).

Next, according to the timing chart shown in FIG. 10 with reference to FIG. 8, a description will be given of the operation of the light-emitting chips C centered on the light-emitting chips Ca1, Cb1, Cc1 and Cd1 belonging to the light-emitting chip class #1. Note that the light-emitting chip Ca1 will be mainly described.

Although the potential of each terminal is assumed to change in a step-like manner in FIG. 10 and the following description, the potential of each terminal actually changes gradually. Thus, even while the potential of each terminal is changing, the thyristor changes its state, such as turn-on and turn-off, as long as the conditions described below are satisfied.

<Light-Emitting Chip Ca1>

Since the anode terminals of the transfer thyristors T, the memory thyristors M and the light-emitting thyristors L are connected to the Vsub terminal, these terminals are set to "H."

On the other hand, the cathode terminals of the odd-numbered transfer thyristors T1, T3 . . . are connected to the first transfer signal line 72 and are set to "H." The cathode terminals of the even-numbered transfer thyristors T2, T4 . . . are connected to the second transfer signal line 73 and are set to "H." Thus, both of the anode and cathode terminals of the transfer thyristors T are set to "H," and the transfer thyristors T are in the OFF state.

Similarly, the cathode terminals of the odd-numbered memory thyristor M1, M3 . . . are connected to the first write signal line 74*a* and are set to "H." The cathode terminals of the even-numbered memory thyristors M2, M4 . . . are connected to the second write signal line 74*b* and are set to "H." Thus, both of the anode and cathode terminals of the memory thyristors M are set to "H," and the memory thyristors M are in the OFF state.

Furthermore, the cathode terminals of the light-emitting thyristors L are connected to the light-up signal line 75 and are set to "H." Thus, both of the anode and cathode terminals of the light-emitting thyristors L are set to "H," and the light-emitting thyristors L are in the OFF state.

The gate terminals Gt of the transfer thyristors T are connected to the power supply line 71 via the respective power supply line resistances Rgx. The power supply line 71 is set to the power supply potential Vga of "L" (−3.3 V). Thus, the potentials of the gate terminals Gt are "L" except for the gate terminals Gt1 and Gt2 to be described later.

The gate terminals Gm of the memory thyristors M are connected to the power supply line 71 via the respective power supply line resistances Rgy. Thus, the potentials of the gate terminals Gm are "L" except for the gate terminal Gm1 to be described later.

Furthermore, the gate terminals G1 of the light-emitting thyristors L are connected to the respective gate terminals Gm. Thus, the potentials of the gate terminals G1 are "L" except for the gate terminal G11.

From the above description, the threshold voltages of the transfer thyristors T, the memory thyristors M and the light-emitting thyristors L except for the transfer thyristors T1 and T2, the memory thyristor M1 and the light-emitting thyristor L1 to be described later are a value (−4.7 V) that is obtained by subtracting the diffusion potential Vd (1.4 V) of the pn junction from the potentials (−3.3 V) of the respective gate terminals Gt, Gm and G1.

The gate terminal Gt1 at one end of the transfer thyristor array in FIG. 8 is connected to the cathode terminal of the start diode Dx0 as described above. The anode terminal of the start diode Dx0 is connected to the second transfer signal line 73, which is set to "H" (0 V). On the other hand, the cathode terminal of the start diode Dx0 (equivalent to the gate terminal Gt1) is connected to the power supply line 71 of "L" (−3.3 V) via the power supply line resistance Rgx1. Thus, a voltage is applied to the start diode Dx0 in the forward direction (forward bias). Accordingly, the potential of the cathode terminal (the gate terminal Gt1) of the start diode Dx0 is set to a value (−1.4 V) that is obtained by subtracting the diffusion potential Vd (1.4 V) of the start diode Dx0 from "H" (0 V) of the anode terminal of the start diode Dx0. Therefore, the threshold voltage of transfer thyristor T1 is set to −2.8 V that is obtained by subtracting the diffusion potential Vd (1.4 V) from the potential (−1.4 V) of the gate terminal Gt1.

The gate terminal Gt2 of the transfer thyristor T2 adjacent to the transfer thyristor T1 is connected to the gate terminal Gt1 via the coupling diode Dx1. Thus, the potential of the gate terminal Gt2 of the transfer thyristor T2 is set to −2.8 V that is obtained by subtracting the diffusion potential Vd (1.4 V) of the coupling diode Dx1 from the potential (−1.4 V) of the gate terminal Gt1. Therefore, the threshold voltage of the transfer thyristor T2 is set to −4.2 V.

Note that the threshold voltages of the transfer thyristors T having numbers three or more is −4.7 V as described above.

On the other hand, since the gate terminal Gm1 of the memory thyristor M1 is connected to the gate terminal Gt1 via the connection diode Dy1, the potential of the gate terminal Gm1 of the memory thyristor M1 is set to −2.8 V that is obtained by subtracting the diffusion potential Vd (1.4 V) of the connection diode Dy1 from the potential (−1.4 V) of the gate terminal Gt1. Therefore, the threshold voltage of the memory thyristor M1 is set to −4.2 V.

Note that the threshold voltages of the memory thyristors M having numbers two or more are −4.7 V as described above.

Also, the threshold voltages of the light-emitting thyristors L are −4.7 V as described above.

<Light-Emitting Chips Cb1, Cc1 and Cd1>

The initial state of the light-emitting chips Cb1, Cc1 and Cd1 is the same as that of the light-emitting chip Ca1. Thus, the detailed description thereof is omitted.

(2) Time Point b

At the time point b shown in FIG. 10, the first transfer signal cola and the enable signal ϕEa transmitted to the light-emitting chip group #a change from "H" (0 V) to "L" (−3.3 V). Thereby, the light-emitting device 65 enters an operating state.

<Light-Emitting Chip Ca1>

When the first transfer signal ϕ1*a* changes from "H" (0 V) to "L" (−3.3 V), the transfer thyristor T1 having a threshold voltage of −2.8 V gets turned on. However, since the threshold voltages of the odd-numbered transfer thyristors T having numbers three or more is −4.7 V, those transfer thyristors T may not change to the ON state. On the other hand, the transfer thyristor T2 having a threshold voltage of −4.2 V may not get turned on because the second transfer signal ϕ2*a* is "H" (0 V).

When the transfer thyristor T1 gets turned on, the potential of the gate terminal Gt1 becomes "H" (0 V) at the anode terminal thereof. The potential of the cathode terminal of the transfer thyristor T1 (the first transfer signal line 72 in FIG. 8) becomes −1.4 V that is obtained by subtracting the diffusion potential Vd (1.4 V) of the pn junction from "H" (0 V) at the anode terminal of the transfer thyristor T1.

When the anode terminal (the gate terminal Gt1) of the coupling diode Dx1 becomes "H" (0 V), the coupling diode Dx1 becomes forward biased because the potential of the cathode terminal thereof (the gate terminal Gt2) is −2.8 V. Thus, the potential of the cathode terminal (the gate terminal Gt2) of the coupling diode Dx1 becomes −1.4 V that is obtained by subtracting the diffusion potential Vd (1.4 V) from "H" (0 V) at the anode terminal thereof (the gate terminal Gt1). Accordingly, the threshold voltage of the transfer thyristor T2 becomes −2.8 V.

The potential of the gate terminal Gt3 connected to the gate terminal Gt2 of −1.4 V via the coupling diode Dx2 becomes −2.8 V. Accordingly, the threshold voltage of the transfer thyristor T3 becomes −4.2 V. Since the potentials of the gate terminals Gt of the transfer thyristors T having numbers four or more are at "L" of the power supply potential Vga, the threshold voltages of these transfer thyristors are maintained at −4.7 V.

On the other hand, when the transfer thyristor T1 gets turned on and the potential of the anode terminal (the gate terminal GU) of the connection diode Dy1 becomes "H" (0 V), the potential of the cathode terminal (the gate terminal Gm1) of the connection diode Dy1, which is forward biased, becomes −1.4 V. Accordingly, the threshold voltages of the memory thyristor M1 and the light-emitting thyristor L1 become −2.8 V.

Note that the potential of the gate terminal Gm2 of the memory thyristor M2 becomes −2.8 V, and the threshold voltages of the memory thyristor M2 and the light-emitting thyristor L2 become −4.2 V. The threshold voltages of the memory thyristor M having numbers three or more are maintained at −4.7 V.

However, since the first write signal line 74*a* and the second write signal line 74*b* are set to "H," none of the memory thyristors M get turned on. Since the light-up signal line 75 is set to "H," none of the light-emitting thyristors L get turned on either.

On the other hand, at the time point b, the enable signal ϕEa also changes from "H" (0 V) to "L" (−3.3 V). At this time, the write signal ϕW1 is maintained at "H" (0 V). Thus, the potentials of the first write signal line 74*a* and the second write signal line 74*b* are −2.2 V, according to Table 1. However, none of the memory thyristors M get turned on, because the threshold voltages of the memory thyristor M1, the memory thyristor M2 and the memory thyristors M having numbers three or more are −2.8 V, −4.2 V and −4.7 V, respectively.

That is, it is only the transfer thyristor T1 that gets turned on, at the time point b. The transfer thyristor T1 is in the ON state immediately after the time point b ("Immediately after" here refers to a time point when the thyristor is in a steady state after a change is made on the thyristor and the like due to a change of the potential of the signal at the time point b, and will be used similarly for the other time points). The other transfer thyristors T, and all the memory thyristors M and the light-emitting thyristors L are in the OFF state.

In the following, only the thyristors (the transfer thyristors T, the memory thyristors M, the light-emitting thyristors L) in the ON state are described, and the description of the thyristors (the transfer thyristors T, the memory thyristors M, the light-emitting thyristors L) in the OFF state is omitted.

Note that any one of the first transfer signal ϕ1*a* and the enable signal ϕEa may be first changed from "H" to "L," as long as the change is made between the time points b and c.

The change of the enable signal ϕEa from "H" (0 V) to "L" (−3.3 V) at the time point b is a step to transmit the enable signal ϕEa to enable selection of the light-emitting thyristors L (light-emitting elements) to be caused to light up.

<Light-Emitting Chips Cb1, Cc1 and Cd1>

The initial state of the light-emitting chips Cb1, Cc1 and Cd1 is maintained because the signals transmitted to the light-emitting chip group #b to which the light-emitting chip Cb1 belongs, the light-emitting chip group #c to which the light-emitting chip Cc1 belongs and the light-emitting chip group #d to which the light-emitting chip Cd1 belongs do not change.

As described above, the gate terminals (the gate terminals Gt, Gm and G1) of the thyristors (the transfer thyristors T, the memory thyristors M and the light-emitting thyristors L) are mutually connected to each other via the diodes (the coupling diodes Dx and the connection diodes Dy). Thus, when the potential of a certain gate terminal is changed, the potential of another gate terminal connected to the certain gate terminal via one forward-biased diode is changed. The threshold voltage of the thyristor having the gate terminal whose potential has been changed is then changed.

A more specific description is given. The potential of the gate terminal connected to the certain gate terminal having the changed potential of "H" (0 V) via the one forward-biased diode becomes −1.4 V, and the threshold voltage of the thyristor having the former gate terminal becomes −2.8 V. In this manner, when the threshold voltage becomes higher (smaller in its absolute value) than "L" (−3.3 V), the thyristor is allowed to get turned on.

On the other hand, the potential of another gate terminal connected to the certain gate terminal having the changed potential of "H" (0 V) via two forward-biased diodes becomes −2.8 V, and the threshold voltage of the thyristor having the former gate terminal becomes −4.2 V. Thus, since the threshold voltage is lower than "L" (−3.3 V), the thyristor may not get turned on but maintains the OFF state. Specifically, only the thyristor whose gate terminal is connected to the certain gate terminal having the changed potential of "H" (0 V) via the one forward-biased diode gets turned on by "L" (−3.3 V).

In the following, the description will be focused on the thyristors (the transfer thyristors T, the memory thyristors M and the light-emitting thyristors L) that are allowed to get turned on by the potential "L" (−3.3 V) or higher. The description of other changes will be omitted.

(3) Time Point c

At the time point c, the write signal ϕW1 transmitted to the light-emitting chip class #1 changes from "H" (0 V) to "L" (−3.3 V).

<Light-Emitting Chip Ca1>

The enable signal ϕEa has already changed from "H" to "L" at the time point b. Thus, the potentials of the first write signal line 74*a* and the second write signal line 74*b* are both "L" (−3.3 V), according to Table 1. Then, the memory thyristor M1 that has the cathode terminal connected to the first write signal line 74*a* and that has the threshold voltage of −2.8 V gets turned on. Thereby, the potential of the first write signal line 74*a* becomes −1.4 V. Also, the potential of the gate terminal Gm1 (the gate terminal G11) becomes "H" (0 V), and thus the threshold voltage of the light-emitting thyristor L1 becomes −1.4 V. At this time, the light-emitting thyristor L1 does not get turned on because the light-up signal ϕIa1 is "H" (0 V).

The potentials of the cathode terminal (the gate terminal Gm1) and the anode terminal (the gate terminal Gt1) of the connection diode Dy1 are both "H" (0 V). Thus, a change of the potential of the gate terminal Gm1 of the memory thyristor M1 to "H" (0 V) does not affect the gate terminal Gt1.

Immediately after the time point c, the transfer thyristor T1 and the memory thyristor M1 are in the ON state.

The change of the write signal ϕW1 from "H" (0 V) to "L" (−3.3 V) at the time point c is a step to transmit the write signal ϕW1 to set the memory thyristor M (memory element) to any one of the ON state (a memory state) and the OFF state (a non-memory state).

<Light-Emitting Chips Cb1, Cc1 and Cd1>

The write signal ϕW1 is commonly transmitted also to the light-emitting chips Cb1, Cc1 and Cd1 that form the light-emitting chip class #1. However, since the enable signals ϕEb, ϕEc and ϕEd respectively transmitted to the light-emitting chips Cb1, Cc1 and Cd1 are "H," the potentials of the first write signal lines 74*a* and the second write signal lines 74*b* in the light-emitting chips Cb1, Cc1 and Cd1 are −1.1 V, according to Table 1. However, since the threshold voltages of the memory thyristors M1 in the light-emitting chips Cb1, Cc1 and Cd1 are −4.2 V, the memory thyristors M1 do not get turned on.

(4) Time Point d

At the time point d, the write signal ϕW1 transmitted to the light-emitting chip class #1 changes from "L" (−3.3 V) to "H" (0 V).

<Light-Emitting Chip Ca1>

The memory thyristor M1 gets turned on at the time point c, and the potential of the first write signal line 74*a* is maintained at −1.4 V, which is the potential of the cathode terminal of the memory thyristor M1. Thus, since the enable signal ϕEa is "L" (−3.3 V), when the write signal ϕW1 changes to "H," the potential of the first write signal line 74*a* changes from "L" (−3.3 V) to −2.2 V according to Table 1. This potential is lower than −1.4 V, which is the potential of the cathode terminal of the memory thyristor M1 in the ON state. Thus, if a current to maintain the ON state of the memory thyristor M1 is supplied, the memory thyristor M1 maintains the ON state. Additionally, the potential of the first write signal line 74*a* is maintained at −1.4 V. On the other hand, the potential of the second write signal line 74*b* also changes to −2.2 V according to Table 1.

Accordingly, immediately after the time point d, the transfer thyristor T1 and the memory thyristor M1 are in the ON state.

Now, a description will be given of the current to maintain the ON state of the memory thyristor M1.

Since the memory thyristor M1 is in the ON state, the potential of the first write signal line 74*a* is −1.4 V. When the write signal ϕW 1 changes from "L" (−3.3 V) to "H" (0 V), the current flowing to the write resistance RW1 of 2 μL is 1.5 V/2 kΩ=0.75 mA. On the other hand, the current flowing from the ϕE terminal at "L" (−3.3 V) to the enable resistance RE1 of 1 kΩ is (3.3 V−1.5 V)/1 kΩ=1.8 mA. The difference 1.05 mA between these currents flows through the memory thyristor M1. Accordingly, if the current to maintain the ON state of the memory thyristor M1 is lower than this current (1.8 mA), the ON state of the memory thyristor M1 is maintained.

<Light-Emitting Chips Cb1, Cc1 and Cd1>

When the write signal ϕW1 changes from "L" to "H," the potentials of the first write signal line 74*a* and the second write signal line 74*b* in the light-emitting chips Cb1, Cc1 and Cd1 return from −1.1 V to "H" (0 V), according to Table 1.

(5) Time Point e

At the time point e, the second transfer signal ϕ2*a* transmitted to the light-emitting chip group #a changes from "H" (0 V) to "L" (−3.3 V).

<Light-Emitting Chip Ca1>

The transfer thyristor T2 having a threshold voltage of −2.8 V gets turned on. Then, the potential of the gate terminal Gt2 becomes "H" (0 V). Thereby, the potential of the gate terminal Gt3 connected to the gate terminal Gt2 via the forward-biased coupling diode Dx2 becomes −1.4 V, and the threshold voltage of the transfer thyristor T3 becomes −2.8 V. Similarly, the potential of the gate terminal Gm2 connected to the gate terminal Gt2 via the forward-biased connection diode Dy2 becomes −1.4 V, and the threshold voltages of the memory thyristor M2 and the light-emitting thyristor L2 become −2.8 V.

At this time, since the potential of the second write signal line 74*b* connected to the cathode terminal of the memory thyristor M2 is −2.2 V, the memory thyristor M2 does not get turned on. Since the light-up signal ϕIa1 is "H," the light-emitting thyristor L2 does not get turned on, either.

Accordingly, immediately after the time point e, the transfer thyristors T1 and T2, and the memory thyristor M1 are in the ON state.

<Light-Emitting Chips Cb1, Cc1 and Cd1>

The light-emitting chips Cb1, Cc1 and Cd1 are maintained in the state at the time point d, because the signals transmitted to the light-emitting chip group #b to which the light-emitting chip Cb1 belongs, the light-emitting chip group #c to which the light-emitting chip Cc1 belongs and the light-emitting chip group #d to which the light-emitting chip Cd1 belongs do not change.

(6) Time Point f

At the time point f, the first transfer signal ϕ1*a* transmitted to the light-emitting chip group #a changes from "L" to "H."

<Light-Emitting Chip Ca1>

The transfer thyristor T1 having been in the ON state gets turned off, because the potentials of the cathode terminal and the anode terminal both become "H." Thereby, the potential of the gate terminal Gt1 changes from "H" to "L" (−3.3 V), and the threshold voltage of the transfer thyristor T1 becomes −4.7 V. Additionally, the potential of the anode terminal (the gate terminal Gt1) of the coupling diode Dx1, whose cathode terminal (the gate terminal Gt2) is set to "H," becomes "L." Thereby, the coupling diode Dx1 becomes reverse-biased.

Similarly, the potential of the anode terminal (the gate terminal Gt1) of the connection diode Dy1, whose cathode terminal (the gate terminal Gm1) is set to 0 V, becomes "L" (−3.3 V). Thereby, the connection diode Dy1 also becomes reverse-biased. Thus, the gate terminal Gm1 (G11) is not affected by the gate terminal Gt1 whose potential has changed to "L" (−3.3 V).

Accordingly, immediately after the time point f, the transfer thyristor T2 and the memory thyristor M1 are in the ON state.

<Light-Emitting Chips Cb1, Cc1 and Cd1>

The light-emitting chips Cb1, Cc1 and Cd1 are maintained in the state immediately after the time point d, because the signals transmitted to the light-emitting chip group #b to which the light-emitting chip Cb1 belongs, the light-emitting chip group #c to which the light-emitting chip Cc1 belongs and the light-emitting chip group #d to which the light-emitting chip Cd1 belongs do not change.

(7) Time Point g

At the time point g, the write signal ϕW1 transmitted to the light-emitting chip class #1 changes from "H" (0 V) to "L" (−3.3 V), similarly to the time point c.

<Light-Emitting Chip Ca1>

The enable signal ϕEa has already changed from "H" to "L" at the time point b. Thus, the potential of the second write signal line 74*b* is "L" (−3.3 V), according to Table 1. Then, the memory thyristor M2 having a threshold voltage of −2.8 V gets turned on.

Note that the memory thyristor M1 maintains the ON state, and the potential of the first write signal line 74*a* is maintained at −1.4 V. However, the potential of the second write signal line 74*b* is not affected by that of the first write signal line 74*a*.

When the memory thyristor M2 gets turned on, the potential of the gate terminal Gm2 becomes "H" (0 V), and thus the threshold voltage of the light-emitting thyristor L2 becomes −1.4 V.

Accordingly, immediately after the time point g, the transfer thyristor T2, and the memory thyristors M1 and M2 are in the ON state.

<Light-Emitting Chips Cb1, Cc1 and Cd1>

The write signal ϕW1 is commonly transmitted also to the light-emitting chips Cb1, Cc1 and Cd1 that form the light-emitting chip class #1. Thus, similarly to the time point c, the potentials of the first write signal line 74*a* and the second write signal line 74*b* in the light-emitting chips Cb1, Cc1 and Cd1 are −1.1 V, according to Table 1. However, in the light-emitting chips Cb1, Cc1 and Cd1, the threshold voltages of the memory thyristors M1, and those of the memory thyristors M having numbers two or more are −4.2 V and −4.7 V, respectively. Thus, these memory thyristors M may not get turned on.

(8) Time Point h

At the time point h, the write signal ϕW1 transmitted to the light-emitting chip class #1 changes from "L" (−3.3 V) to "H" (0 V), and the light-up signal ϕIa1 changes from "H" (0 V) to "Le" (−2.8 V<"Le"≦−1.4 V).

<Light-Emitting Chip Ca1>

First, the change of the write signal ϕW1 from "L" (−3.3 V) to "H" (0 V) will be described.

Similarly to the time point d, the potential of the first write signal line 74*a* changes from "L" (−3.3 V) to −2.2 V. As described above, this potential is capable of maintaining the ON state of the memory thyristor M1, and thus the memory thyristor M1 maintains the ON state. Similarly, the potential of the second write signal line 74*b* changes from "L" (−3.3 V) to −2.2 V. This potential is capable of maintaining the ON state of the memory thyristor M2, and thus the memory thyristor M2 maintains the ON state. That is, even when the write signal ϕW1 changes from "L" (−3.3 V) to "H" (0 V), the ON state of the memory thyristors M1 and M2 is maintained.

Next, the change of the light-up signal cpIa 1 from "H" (0 V) to "Le" (−2.8 V<"Le"≦−1.4 V) will be described. Note that the light-up signal ϕIa1 changes from "H" (0 V) to "Le" (−2.8 V<"Le"≦−1.4 V) after the write signal ϕW1 changes from "L" to "H."

When the light-up signal ϕIa1 changes from "H" (0 V) to "Le" (−2.8 V<"Le"≦−1.4 V), the light-emitting thyristors L1 and L2, whose threshold voltages are both −1.4 V, get turned on and light up (emit light). At this time, since the light-up signal ϕIa1 supplies a current from a constant current source to be described later (see FIG. 13 to be described later), the light-up signal ϕIa1 inhibits the light-up signal line 75 from being fixed, by the light-emitting thyristors L1 and L2 in the ON state, at −1.4 V that is the potential of each cathode terminal thereof. Thus, the light-emitting thyristors L1 and L2 are both caused to turn on. Note that the potential "Le" (−2.8 V<"Le"≦−1.4 V) of the constant current source supplying the light-up signal ϕIa1 needs to be lower than −1.4 V that is the threshold voltage of each of the light-emitting thyristors L1 and L2, and be higher than −2.8 V to be described later.

The current supplied by the constant current source is controlled with image data, and is supplied according to the number of the light-emitting thyristors L to be caused to light up in parallel. Thus, even when two light-emitting thyristors L are lighted up in parallel, a current is supplied twice as compared with a case of lighting one light-emitting thyristor L, and thus the same light emission amount is obtained.

Immediately after the time point h, the transfer thyristor T2 and the memory thyristors M1 and M2 are in the ON state, while the light-emitting thyristors L1 and L2 are in the ON state and light up (emit light).

In the first exemplary embodiment, any one of the change of the write signal ϕW1 from "L" to "H" and that of the light-up signal ϕIa1 from "H" (0 V) to "Le" (−2.8 V<"Le"≦−1.4 V) may be first performed. If the change of the light-up signal ϕIa1 from "H" (0 V) to "Le" (−2.8 V<"Le"≦−1.4 V) is performed before the change of the write signal ϕW1 from "L" to "H" unlike the above, the change of the light-up signal ϕIa1 from "H" (0 V) to "Le" (−2.8 V<"Le"≦−1.4 V) causes the light-emitting thyristor L1, whose threshold voltage has already become −1.4 V, to turn on to light up (emit light). Thereafter, the change of the write signal ϕW1 from "L" to "H" causes the memory thyristor M2 to turn on and the threshold voltage of the light-emitting thyristor L2 to change to −1.4 V. Then, the light-up signal ϕIa1, which has already been at "Le," causes the light-emitting thyristor L2 to turn on to light up (emit light). In this manner, the starting time points of light-up (light emission) are shifted between the light-emitting thyristors L1 and L2.

Accordingly, the change of the write signal ϕW1 from "L" to "H" may be performed before the change of the light-up signal ϕIa1 from "H" (0 V) to "Le" (−2.8 V<"Le"≦−1.4 V).

The change of the light-up signal ϕIa1 from "H" (0 V) to "Le" (−2.8 V<"Le"≦−1.4 V) at the time point h is a step to transmit the light-up signal ϕIa1 for lighting up to the light-emitting thyristor L (light-emitting element) corresponding to the memory thyristor M (memory element) in the ON state (the memory state).

<Light-Emitting Chips Cb1, Cc1 and Cd1>

The light-emitting chips Cb1, Cc1 and Cd1 are maintained in the state immediately after the time point h, because the signals transmitted to the light-emitting chip group #b to which the light-emitting chip Cb1 belongs, the light-emitting chip group #c to which the light-emitting chip Cc1 belongs and the light-emitting chip group #d to which the light-emitting chip Cd1 belongs do not change.

(9) Time Point i

At the time point i, the first transfer signal ϕ1*a* transmitted to the light-emitting chip group #a changes from "H" to "L," and the enable signal ϕEa transmitted to the light-emitting chip group #a changes from "L" to "H."

<Light-Emitting Chip Ca1>

First, the change of the first transfer signal ϕ1*a* from "H" to "L" will be described. Note that the change of the first transfer signal ϕ1*a* from "H" to "L" is supposed to be performed before the change of the enable signal ϕEa from "L" to "H."

The transfer thyristor T3 having a threshold voltage of −2.8 V gets turned on. Then, the potential of the gate terminal Gt3 becomes "H" (0 V). Thereby, the potential of the gate terminal Gt4 connected via the forward-biased coupling diode Dx3 becomes −1.4 V, and thus the threshold voltage of the transfer thyristor T4 becomes −2.8 V. Similarly, the potential of the gate terminal Gm3 (G13) connected to the gate terminal Gt3 being at "H" (0 V) via the forward-biased connection diode Dy3 becomes −1.4 V, and thus the threshold voltages of the memory thyristor M3 and the light-emitting thyristor L3 both become −2.8 V. At this time, since the potential of the first write signal line 74*a* is maintained at −1.4 V by the memory thyristor M1 in the ON state, the memory thyristor M3 does not get turned on.

Additionally, since the light-up signal ϕIa1 is "Le" (−2.8 V<"Le"≦−1.4 V), the light-emitting thyristor L3 does not get turned on, and does not light up (emit light). The light-up level "Le" of the light-up signal ϕIa1 is set to a value higher than −2.8 V so that the light-emitting thyristor L3 does not get turned on.

Next, the change of the enable signal ϕEa from "L" to "H" will be described.

The write signal ϕW1 has already changed from "L" to "H" at the time point g. Thus, when the enable signal ϕEa changes from "L" to "H," the potentials of the first write signal line 74*a* and the second write signal line 74*b* both become "H" (0 V), according to Table 1. Then, since the potentials of the anode terminals and the cathode terminals of the memory thyristors M1 and M2 in the ON state become "H" (0 V), the memory thyristors M1 and M2 both get turned off. However, the potentials of the gate terminals Gm1 and Gm2 are set to 0 V by the light-emitting thyristors L1 and L2 in the ON state, and the threshold voltages of the memory thyristors M1 and M2 are both −1.4 V.

Accordingly, immediately after the time point i, the transfer thyristors T2 and T3 are in the ON state, while the light-emitting thyristors L1 and L2 are in the ON state and light up (emit light).

Note that any one of the change of the first transfer signal ϕ1*a* from "H" to "L" and that of the enable signal ϕEa from "L" to "H" may be first performed. If the change of the enable signal ϕEa from "L" to "H" is performed before the change of the first transfer signal ϕ1*a* from "H" to "L" unlike the above, the change of the enable signal ϕEa from "L" to "H" first causes the potential of the first write signal line 74*a* to be set to "H" (0 V), and then the memory thyristors M1 and M2 to turn off. Thereafter, the change of the first transfer signal ϕ1*a* from "H" to "L" causes the threshold voltage of the memory thyristor M3 to change to −2.8 V.

<Light-Emitting Chips Cb1, Cc1 and Cd1>

The light-emitting chips Cb1, Cc1 and Cd1 are maintained in the state immediately after the time point h, because the signals transmitted to the light-emitting chip group #b to which the light-emitting chip Cb1 belongs, the light-emitting chip group #c to which the light-emitting chip Cc1 belongs and the light-emitting chip group #d to which the light-emitting chip Cd1 belongs do not change.

(10) Time Point j

At the time point j, the second transfer signal ϕ2*a* transmitted to the light-emitting chip group #a changes from "L" to "H," and both of the first transfer signal ϕ1*b* and the enable signal ϕEb transmitted to the light-emitting chip group #b change from "H" (0 V) to "L" (−3.3 V).

<Light-Emitting Chip Ca1>

First, the change of the second transfer signal ϕ2*a*, transmitted to the light-emitting chip group #a, from "L" to "H" will be described.

The potentials of the cathode terminal and the anode terminal of the transfer thyristor T2 in the ON state both become "H" (0 V), and thus the transfer thyristor T2 gets turned off.

Immediately after the time point j, the transfer thyristor T3 is in the ON state, while the light-emitting thyristors L1 and L2 are in the ON state and light up (emit light).

The first transfer signal ϕ1*b* and the enable signal ϕEb transmitted to the light-emitting chip group #b are not signals for the light-emitting chip group #a to which the light-emitting chip Ca1 belongs. Thus, the first transfer signal ϕ1*b* and the enable signal ϕEb do not affect the light-emitting chip Ca1.

Similarly to the time point a, the start diode Dx0 becomes forward-biased, and the potential of the gate terminal Gt1 becomes −1.4 V. Thereby, the threshold voltage of the transfer thyristor T1 becomes −2.8 V. However, since the transfer thyristor T3 is in the ON state and the potential of the first transfer signal line 72 is −1.5 V, the transfer thyristor T1 does not get turned on. As described above, when the start diode Dx0 becomes forward-biased and the threshold voltage of the transfer thyristor T1 becomes −2.8 V, the potential of the first transfer signal line 72 is −1.5 V. Thus, the transfer thyristor T1 does not get turned on. Specifically, it is only at the time point b that the start diode Dx0 becomes forward-biased and the transfer thyristor T1 gets turned on. Here, at the time point b, the first transfer signal ϕ1 and the second transfer signal ϕ2 are both "H" (0 V), and the first transfer signal ϕ1 changes from "H" (0 V) to "L" (−3.3 V) if none of the transfer thyristors T are in the ON state.

<Light-Emitting Chip Cb1>

The change of the first transfer signal ϕ1*b* and the enable signal ϕEb, transmitted to the light-emitting chip group #b, from "H" (0 V) to "L" (−3.3 V) is similar to that in the light-emitting chip Ca1 at the time point b. Thus, the detailed description thereof is omitted.

<Light-Emitting Chips Cc1 and Cd1>

The light-emitting chips Cc1 and Cd1 are maintained in the state immediately after the time point h, because the signals transmitted to the light-emitting chip group #c to which the light-emitting chip Cc1 belongs and the light-emitting chip group #d to which the light-emitting chip Cd1 belongs do not change.

Thereafter, similarly to the light-emitting chip group #a in the period Ta(1), the light-emitting chip groups #b, #c and #d are sequentially driven in the periods Tb(1), Tc(1) and Td(1), respectively.

For example, consider the light-emitting chip Cb1 in the light-emitting chip group #b. At the time point j, the enable signal ϕEb changes from "H" (0 V) to "L" (−3.3 V), and thus the potentials of the first write signal line 74*a* and the second write signal line 74*b* both become −2.2 V. When the write signal ϕW1 changes from "H" (0 V) to "L" (−3.3 V) at the time point k, the memory thyristor M1 in the light-emitting chip Cb1 gets turned on. Then, even when the write signal ϕW1 changes from "L" (−3.3 V) to "H" (0 V) at the time point 1, the ON state of the memory thyristor M1 is maintained. Additionally, when the write signal ϕW1 changes from "H" (0 V) to "L" (−3.3 V) at the time point o, the memory thyristor M2 gets turned on, and thus the memory thyristors M1 and M2 are in the ON state. Thereafter, when the light-up signal ϕIb1 changes from "H" (0 V) to "Le" (−2.8 V<"Le"≦−1.4 V) at the time point p, the light-emitting thyristors L1 and L2 get turned on and light up (emit light). That is, the operation for the light-emitting chip Ca1 in the period Ta(1) is performed for the light-emitting chip Cb1 in the period Tb(1). In the periods Tc(1) and Td(1), a similar operation is performed for the respective light-emitting chips Cc1 and Cd1.

At the time point u, the light-emitting thyristors L1 and L2 in the light-emitting chips Ca1, Cb1, Cc1 and Cd1 are in the ON state, and light up (emit light). The description of the ON state of the other transfer thyristors T and memory thyristors M is omitted.

Hereinafter, a description will be given of the time point u and the subsequent time points.

(11) Time Point u

At the time point u, the light-up signal ϕIa1 supplied to the light-emitting chip Ca1 changes from "Le" to "H."

<Light-Emitting Chip Ca1>

When the light-up signal ϕIa1 changes from "Le" to "H," the potentials of the cathode terminals and the anode terminals of the light-emitting thyristors L1 and L2 in the ON state both become "H" (0 V), and thus the light-emitting thyristors L1 and L2 get turned off.

Then, the potentials of the gate terminals Gm1 (G11) and Gm2 (G12) change to "L" (−3.3 V) via the power supply line resistances Rgy1 and Rgy2, respectively. Thereby, the threshold voltages of the memory thyristors M1 and M2 and the light-emitting thyristors L1 and L2 become −4.7 V.

Immediately after the time point u, the transfer thyristor T3 is in the ON state. Thereby, the potential of the gate terminal Gt3 is "H" (0 V). On the other hand, since the transfer thyristor T2 is in the OFF state, the potential of the gate terminal Gt2 is "L" (−3.3 V). Thus, the coupling diode Dx2 is reverse-biased. Thereby, the gate terminal Gt2 is not affected by the gate terminal Gt3 being at "H" (0 V).

From the above description, the state at the time point v, which is immediately after the time point u, is similar to that at the time point b, although there is a difference in that the transfer thyristor T in the ON state is the transfer thyristor T1 (at the time point b) and the transfer thyristor T3 (at the time point v).

Therefore, in the period T(2) starting from the time point v, the light-emitting thyristors L3 and L4 are light-controlled, similarly to the light-emitting thyristors L1 and L2 in the period T(1). Thus, the detailed description thereof is omitted.

<Light-Emitting Chips Cb1, Cc1 and Cd1>

The light-emitting chips Cb1, Cc1 and Cd1 are maintained in the state immediately before the time point u until the time point v, because the signals transmitted to the light-emitting chip group #b to which the light-emitting chip Cb1 belongs, the light-emitting chip group #c to which the light-emitting chip Cc1 belongs and the light-emitting chip group #d to which the light-emitting chip Cd1 belongs do not change.

In the period T(2) starting from the time point v, the light-emitting thyristors L3 and L4 in the light-emitting chips Cb1, Cc1 and Cd1 are light-controlled, similarly to the light-emitting thyristors L1 and L2 in the period T(1).

Thereafter, all the light-emitting thyristors L in the light-emitting chips C are light-controlled in the same manner.

In the above description, all the light-emitting thyristors L1 to L4 in the light-emitting chips Ca1, Cb1, Cc1 and Cd1 are caused to light up (emit light). However, if some light-emitting thyristors L are not caused to light up (emit light), it is only necessary to maintain the write signal ϕW1 at "H" (0 V) when the write signal ϕW1 changes from "H" (0 V) to "L" (−3.3 V).

For example, if the light-emitting thyristor L2 in the light-emitting chip Ca1 is not caused to light up (emit light), the write signal ϕW1 is maintained at "H" (0 V) in the period from the time point g to the time point h. Then, since the potential of the second write signal line 74*b* is maintained at −2.2 V, the memory thyristor M2 having a threshold voltage of −2.8 V does not get turned on. Thus, the threshold voltage of the light-emitting thyristor L2 is maintained at −2.8 V. Accordingly, when the light-up signal ϕIa1 changes from "H" (0 V) to "Le" (−2.8 V<"Le"≦−1.4 V) at the time point h, the light-emitting thyristor L1, whose threshold voltage is set to −1.4 V by the memory thyristor M1 in the ON state, gets turned on and lights up (emits light). However, the light-emitting thyristor L2 does not get turned on.

In the first exemplary embodiment, two light-emitting thyristors L may be caused to light up (emit light) in parallel in one light-emitting chip C. The number (two, one or zero) of the light-emitting thyristors L to be caused to light up (emit light) is set by the write signal ϕW1. Note that in a case of one, the write signal ϕW1 designates which of the two light-emitting thyristors L is caused to light up (emit light).

The operation of the light-emitting chip C described above will be summarized below.

First, the operation of the transfer thyristors T is described.

In the light-emitting chip C of the first exemplary embodiment, the ON state of the transfer thyristor T is sequentially shifted by two phase transfer signals (the first transfer signal ϕ1 and the second transfer signal ϕ2).

That is, by setting one of the two phase transfer signals to "L" (−3.3 V), a transfer thyristor T having a threshold voltage being higher than "L" (−3.3 V) among the transfer thyristors T whose cathode terminals are supplied with one of the transfer signals, gets turned on. Then, the gate terminal Gt of the transfer thyristor T changed to the ON state is set to "H" (0 V), and thus the potential of the gate terminal Gt of another transfer thyristor T (an adjacent transfer thyristor T) connected via the forward-biased coupling diode Dx becomes −1.4 V. Thereby, the adjacent transfer thyristor T has an increased threshold voltage (from −4.2 V to −2.8 V in the first exemplary embodiment), and changes to the ON state at the timing when the other transfer signal changes to "L" (−3.3 V).

In short, the two phase transfer signals (the first transfer signal ϕ1 and the second transfer signal ϕ2) are transmitted in such a manner that the periods in which the respective signals are at "L" (−3.3 V) overlap with each other (period from the time point e to the time point f in FIG. 10), and thereby the transfer thyristors T are sequentially set to the ON state.

When the transfer thyristor T changes to the ON state and the gate terminal Gt is set to "H" (0 V), the potential of the gate terminal Gm of the memory thyristor M connected to the gate terminal Gt via the connection diode Dy becomes −1.4 V, and thus the threshold voltage of the memory thyristor M becomes −2.8 V.

That is, by changing to the ON state, the transfer thyristor T raises the threshold voltage of the memory thyristor M corresponding to the transfer thyristor T.

When the enable signal ϕE (ϕEa, ϕEb, ϕEc or ϕEd) is "L" and the write signal ϕW (ϕW1 to ϕW5) changes to "L," the potentials of the first write signal line 74*a* and the second write signal line 74*b* become "L" (−3.3 V), and the memory thyristor M having a threshold voltage of −2.8 V gets turned on.

When the memory thyristor M gets turned on, the potential of the gate terminal Gm of the memory thyristor M becomes "H" (0 V). Since the gate terminal G1 is connected to the gate terminal Gm, the threshold voltage of the light-emitting thyristor L becomes −1.4 V.

Thereafter, when the light-up signal ϕI (ϕIa1 to ϕIa5, ϕIb1 to ϕIb5, ϕIc1 to ϕIc5 or ϕId1 to ϕId5) changes from "H" (0 V) to "Le" (−2.8 V<"Le"≦−1.4 V), the light-emitting thyristor L having a threshold voltage of −1.4 V gets turned on and lights up (emits light).

Note that the light-up period during which the light-emitting thyristor L lights up (emits light) is the period during which the light-up signal ϕI (ϕIa1 to ϕIa5, ϕIb1 to ϕIb5, ϕIc1 to ϕIc5 or ϕId1 to ϕId5) is "Le" (−2.8 V<"Le"≦−1.4 V).

In the first exemplary embodiment, the write signals ϕW1 to ϕW5 are transmitted in common to the respective light-emitting chip classes (#1 to #5). However, as shown in FIG. 10, the enable signals ϕE (ϕEa, ϕEb, ϕEc and ϕEd) are transmitted to the respective light-emitting chip groups (#a, #b, #c and #d) in such a manner that the periods during which the respective enable signals ϕE are at "L" (−3.3 V) are shifted with each other. Thereby, information for the write signals ϕW (ϕW1 to ϕW5) to designate the light-emitting thyristors L to be caused to light up (emit light) is arrayed in chronological order so as to correspond to the light-emitting chip groups (#a, #b, #c and #d). Additionally, the information on the light-emitting thyristors L to be caused to light up (emit light) in the light-emitting chip C is obtained by using a combination of the write signal ϕW (ϕW1 to ϕW5) and the enable signal ϕE (ϕEa, ϕEb, ϕEc or ϕEd).

Specifically, as shown in FIG. 10, in a period during which the enable signal ϕE transmitted to a light-emitting chip group is "L" (−3.3 V), a period during which the write signal ϕW to the light-emitting chips C belonging to the light-emitting chip group is "L" (−3.3 V) is provided, and a period during which the write signal ϕW to the light-emitting chips C belonging to the other light-emitting chip groups is "L" (−3.3 V) is not provided. Note that periods during which the enable signals ϕE (ϕEa, ϕEb, ϕEc and ϕEd) transmitted to the respective light-emitting chip groups are "L" (−3.3 V) may overlap with each other on the time axis. In this manner, the write signals ϕW (ϕW1 to ϕW5) are transmitted in common to the respective light-emitting chip classes (#1 to #5), while the enable signals ϕE (ϕEa, ϕEb, ϕEc and ϕEd) are transmitted in common to the respective light-emitting chip groups (#a, #b, #c and #d).

On the other hand, as is appreciated from Table 1, even when the write signal ϕW becomes "L" (−3.3 V), the potential of any one of the first write signal line 74*a* and the second write signal line 74*b* is −1.1 V if the enable signal ϕE is "H" (0 V). Thus, even when the threshold voltage of the memory thyristor M is −2.8 V, the memory thyristor M does not get turned on. Similarly, even when the enable signal ϕE becomes "L" (−3.3 V), the potential of any one of the first write signal line 74*a* and the second write signal line 74*b* is −2.2 V if the write signal ϕW is "H" (0 V). Thus, even when the threshold voltage of the memory thyristor M is −2.8 V, the memory thyristor M does not get turned on.

That is, even when the write signal ϕW becomes "L" (−3.3 V), the light-emitting thyristors L in the light-emitting chip C in which the enable signal ϕE is not "L" (−3.3 V) are not selected. Additionally, even when the enable signal ϕE becomes "L" (−3.3 V), the light-emitting thyristors L in the light-emitting chip C in which the write signal ϕW is not "L" (−3.3 V) are not selected.

Note that if there is a memory thyristor M in the ON state, by maintaining the enable signal ϕE at "L" (−3.3 V), the potential of any one of the first write signal line 74*a* and the second write signal line 74*b* becomes −2.2 V. Since this potential is lower than the maintaining voltage of the memory thyristor M in the ON state (the potential −1.4 V of the cathode terminal), the memory thyristor M is maintained in the ON state. Thereby, the memory thyristor M connected to the first write signal line 74*a* and the memory thyristor M connected to the second write signal line 74*b* are both maintained in the ON state. In this manner, in the first exemplary embodiment, two light-emitting thyristors L at the maximum for each of the light-emitting chips C may be caused to light up (emit light) in parallel.

As described above, by sequentially changing to the ON state, the transfer thyristors T (transfer elements) designate the corresponding light-emitting thyristors L (the light-emitting thyristors L having the same numbers as the transfer thyristors T) (light-emitting elements) as selection targets that are light-emitting thyristors L (light-emitting elements) to be caused to light up (emit light).

The enable signal ϕE functions so as to enable the selection of the light-emitting thyristors L to be caused to light up for the light-emitting chips C in the light-emitting chip group. The write signal ϕW sets the memory thyristors M corresponding to the light-emitting thyristors L to be caused to light up, to the memory state or the non-memory state, in the light-emitting chips C in which the selection is enabled by the enable signal ϕE.

That is, by changing to the ON state, the memory thyristor M memorizes (latches) the position (number) of the light-emitting thyristor L to be caused to light up (emit light) that is selected by the write signal ϕW. In short, the ON state of the memory thyristor M is the state (the memory state) in which the position (number) of the light-emitting thyristor L to be caused to light up is memorized, while the OFF state of the memory thyristor M is the state (the non-memory state) in which the position (number) of the light-emitting thyristor L to be caused to light up is not memorized.

Although FIG. 10 shows only the write signal ϕW 1 for the light-emitting chip class #1, the write signals ϕW2 to ϕW5 for the other light-emitting chip classes #2 to #5 are respectively transmitted in parallel in the first exemplary embodiment. Thereby, the light-up (light emission) of the light-emitting thyristors L in all the light-emitting chips C (the light-emitting chips Ca1 to Ca5, Cb1 to Cb5, Cc1 to Cc5 and Cd1 to Cd5) in the light-emitting device 65 is individually controlled.

As described above, the number of the wirings (signal lines) on the circuit board 62 in the first exemplary embodiment where the twenty light-emitting chips C are used is thirty-nine.

Figure 11:
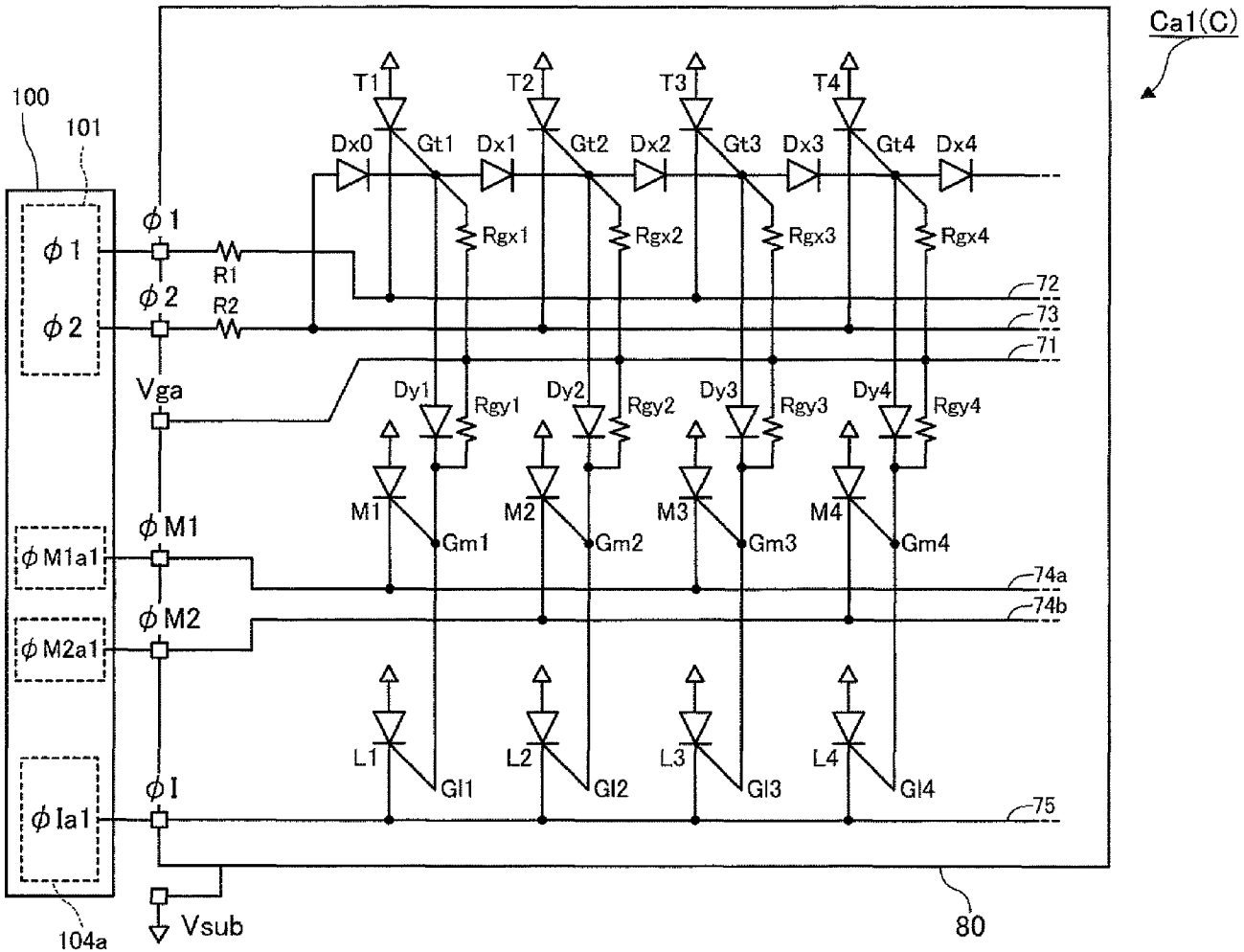
FIG. 11 is an equivalent circuit diagram for explaining a circuit configuration of the light-emitting chip that is a self-scanning light-emitting device array (SLED), in a case where the first exemplary embodiment is not employed.

FIG. 11 is an equivalent circuit diagram for explaining a circuit configuration of the light-emitting chip C that is a self-scanning light-emitting device array (SLED), in a case where the first exemplary embodiment is not employed. Note that FIG. 11 shows the light-emitting chip Ca1 as an example. The configuration of the other light-emitting chips Ca2 to Ca5, Cb1 to Cb5, Cc1 to Cc5 and Cd1 to Cd5 is the same as that of the light-emitting chip Ca1.

In the case shown in FIG. 11 where the first exemplary embodiment is not employed, the write resistances RW1 and RW2 and the enable resistances RE1 and RE2 shown in FIG. 8 in the first exemplary embodiment are not used. Specifically, the first write signal line 74*a* is connected to a ϕM1 terminal from which a first memory signal ϕM1 (a first memory signal ϕM1*a*1 in the light-emitting chip Ca1) is transmitted, while the second write signal line 74*b* is connected to a ϕM2 terminal from which a second memory signal ϕM2 (a second memory signal ϕM2*a*1 in the light-emitting chip Ca1) is transmitted.

Additionally, in the operation, instead of the enable signals ϕE and the write signal ϕW1 of the first exemplary embodiment shown in FIG. 10, the first memory signal ϕM1 (the first memory signal ϕM1*a*1 in the light-emitting chip Ca1) and the second memory signal ϕM2 (the second memory signal ϕM2*a*1 in the light-emitting chip Ca1) that are transmitted for each of the light-emitting chips C are used.

With reference to FIG. 10, a description will be given of the operation of the light-emitting chip C in the case where the first exemplary embodiment is not employed. For example, when the memory thyristor M1 is caused to turn on at the time point c in FIG. 10 in order to memorize that the light-emitting thyristor L1 is caused to light up (emit light), the first memory signal ϕM1*a*1 is changed from "H" (0 V) to "L" (−3.3 V). Similarly, when the memory thyristor M2 is caused to turn on at the time point g in FIG. 10 in order to memorize that the light-emitting thyristor L2 is caused to light up (emit light), the second memory signal ϕM2*a*1 is changed from "H" (0 V) to "L" (−3.3 V).

Then, the first memory signal ϕM1*a*1 and the second memory signal ϕM2*a*1 are maintained at "L" (−3.3 V) until the light-up signal ϕIa1 changes from "H" (0 V) to "L" (−3.3

V), and thereby the light-emitting thyristors L1 and L2 are caused to light up (emit light) in accordance with the change of the light-up signal ϕIa1 from "H" (0 V) to "L" (−3.3 V).

As described above, if the light-emitting chip C shown in FIG. 11 is used, the first memory signals ϕM1 and the second memory signals ϕM2 are individually transmitted to the respective light-emitting chips C.

Figure 12:
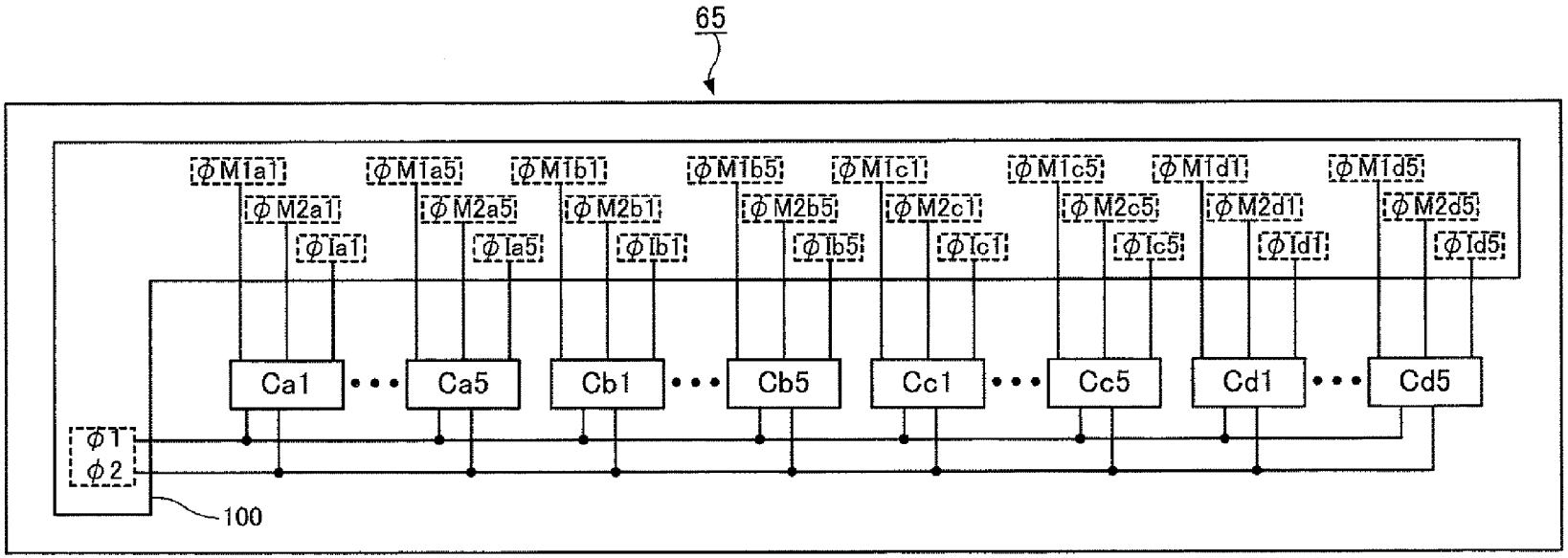
FIG. 12 is a diagram showing the light-emitting chips arranged as matrix elements, in the light-emitting device not employing the first exemplary embodiment.

FIG. 12 is a diagram showing the light-emitting chips C arranged as matrix elements, in the light-emitting device 65 not employing the first exemplary embodiment. Here, twenty light-emitting chips C are used similarly to the first exemplary embodiment.

In the light-emitting device 65 not employing the first exemplary embodiment, the light-emitting chips C are not divided into groups and classes. However, a description will be given with the reference numerals of the light-emitting chips C (the light-emitting chips Ca1 to Ca5, Cb1 to Cb5, Cc1 to Cc5 and Cd1 to Cd5) that are the same as those in the first exemplary embodiment.

The first memory signals ϕM1 (ϕM1*a*1 to ϕM1*a*5, ϕM1*b*1 to ϕM1*b*5, ϕM1*c*1 to ϕM1*c*5 and ϕM1*d*1 to ϕM1*d*5) and the second memory signals ϕM2 (ϕM2*a*1 to ϕM2*a*5, ϕM2*b*1 to ϕM2*b*5, ϕM2*c*1 to ϕM2*c*5 and ϕM2*d*1 to ϕM2*d*5) are individually transmitted to the respective light-emitting chips C.

On the other hand, in the case where the first exemplary embodiment is not employed, the first transfer signal ϕ1 and the second transfer signal ϕ2 are used in common for all the light-emitting chips C. Thereby, all the light-emitting chips C operate in parallel.

A description will be given of the number of the wirings (signal lines) on the circuit board 62 in the light-emitting device 65 not employing the first exemplary embodiment. First, consider a case where the number of the light-emitting chips C is twenty.

The number of wirings (signal lines) for the transfer signals ϕ1 and ϕ2 is two, since these wirings are common for all the light-emitting chips C. The number of wirings (signal lines) for the first memory signals ϕM1 and the second memory signals ϕM2 are forty for the twenty light-emitting chips C, since there are two for each of the light-emitting chips C. The number of wirings (signal lines) for the light-up signals ϕI is twenty for the twenty light-emitting chips C similarly to the first exemplary embodiment, since there is one for each of the light-emitting chips C. In addition, there are the power supply line 200*a* for the reference potential Vsub and the power supply line 200*b* for the power supply potential Vga. Accordingly, the number of the wirings (signal lines) on the circuit board 62 in the light-emitting device 65 using the twenty light-emitting chips C and not employing the first exemplary embodiment is sixty-four.

As described above, in the first exemplary embodiment, the number of the wirings (signal lines) on the circuit board 62 is reduced from sixty-four to thirty-nine.

If the number of the light-emitting chips C in the light-emitting device 65 not employing the first exemplary embodiment is M×N, the number of the wirings (signal lines) is as follows. The number of wirings (signal lines) for the transfer signals ϕ1 and ϕ2 is two, since these wirings are common for all the light-emitting chips C. The number of wirings (signal lines) for the first memory signals ϕM1 and the second memory signals ϕM2 are 2×M×N for the M×N light-emitting chips C, since there are two for each of the light-emitting chips C. The number of wirings (signal lines) for the light-up signals ϕI is M×N for the M×N light-emitting chips C, since there is one for each of the light-emitting chips C. In addition, there are the power supply line 200*a* for the reference potential Vsub and the power supply line 200*b* for the power supply potential Vga. Accordingly, the number of the wirings (signal lines) on the circuit board 62 in the light-emitting device 65 using the M×N light-emitting chips C and not employing the first exemplary embodiment is (3×M×N+4).

Then, in the first exemplary embodiment, the number of the wirings (signal lines) on the circuit board 62 is reduced from (3×M×N+4) to (3×M+N+M×N+2). That is, reduction of (2×M×N−3M−N+2) is achieved.

In the first exemplary embodiment, two light-emitting thyristors L at the maximum are caused to light up (emit light) in parallel. Thus, a supplied current of the light-up signal ϕI is set in accordance with the number of the light-emitting thyristors L to be caused to light up (emit light).

To the signal generating circuit 100, image data subjected to the image processing and various kinds of control signals are inputted from the image output controller 30 and the image processor 40 (see FIG. 1). At this time, light-up number signals DI1 and DI2 indicating the number of the light-emitting thyristors L to be caused to light up (emit light) in parallel are supplied as control signals (see FIG. 13 to be described later).

Figure 13:
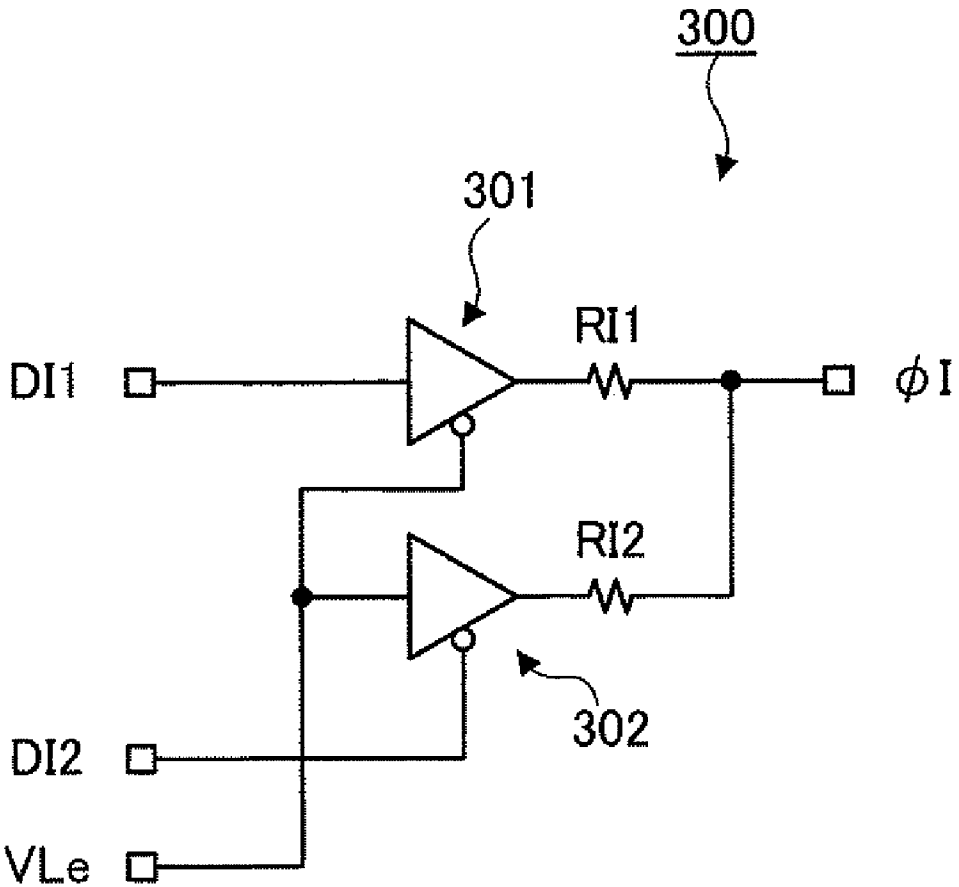
FIG. 13 is a diagram illustrating an example of a constant current source supplying the light-up signal $\phi I$.

FIG. 13 is a diagram illustrating an example of a constant current source 300 supplying the light-up signal ϕI in the first exemplary embodiment.

The constant current source 300 includes a first current buffer circuit 301, a second current buffer circuit 302 and current limitation resistances RI1 and RI2.

The first current buffer circuit 301 has an input terminal connected to a DI1 terminal to which the light-up number signal DI1 is inputted, and has an output terminal connected to the ϕI terminal (see FIG. 8) via the current limitation resistance RI1. The first current buffer circuit 301 is supplied with a light-up potential VLe so that the potential of the ϕI terminal is "Le" (−2.8 V<"Le"≦−1.4 V), which is the potential of the light-up level.

The second current buffer circuit 302 has an input terminal supplied with the light-up potential VLe, and has an output terminal connected to the ϕI terminal via the current limitation resistance RI2. The light-up number signal DI2 is inputted to the second current buffer circuit 302.

Table 2 shows the light-up number signals DI1 and DI2 and the states of the output terminals of the first current buffer circuit 301 and the second current buffer circuit 302.

TABLE 2

| NUMBER OF LIGHT-EMITTING THYRISTORS L TO LIGHT UP (EMIT LIGHT) | LIGHT-UP NUMBER SIGNAL DI1 | LIGHT-UP NUMBER SIGNAL DI2 | OUTPUT TERMINAL OF FIRST CURRENT BUFFER CIRCUIT | OUTPUT TERMINAL OF SECOND CURRENT BUFFER CIRCUIT |
|---|---|---|---|---|
| 0 | H | H | H | Z |
| 1 | L | H | Le | Z |
| 2 | L | L | Le | Le |

As shown in Table 2, if the number of the light-emitting thyristors L to be caused to light up (emit light) in parallel is zero, the light-up number signals DI1 and DI2 are both "H." If the number of the light-emitting thyristors L to be caused to light up (emit light) in parallel is one, the light-up number signal DI1 is "L" while the light-up number signal DI2 is "H." If the number of the light-emitting thyristors L to be caused to light up (emit light) in parallel is two, the light-up number signals DI1 and DI2 are both "L."

If the number of the light-emitting thyristors L to be caused to light up (emit light) in parallel is zero, the output terminal of the first current buffer circuit 301 is "H" while the output terminal of the second current buffer circuit 302 is in a high impedance state (hereinafter, referred to as "Z"). Thus, the potential of the ϕI terminal is "H."

Next, if the number of the light-emitting thyristors L to be caused to light up (emit light) in parallel is one, the output terminal of the first current buffer circuit 301 is "Le" while the output terminal of the second current buffer circuit 302 is "Z." Thus, the potential of the ϕI terminal is "Le." Note that since only the output terminal of the first current buffer circuit 301 is set to "Le," a current corresponding to one light-emitting thyristor L is supplied to the ϕI terminal (Since the potential is negative, the current flows from the ϕI terminal).

If the number of the light-emitting thyristors L to be caused to light up (emit light) in parallel is two, the output terminals of the first current buffer circuit 301 and the second current buffer circuit 302 are both "Le." Thus, the potential of the ϕI terminal is "Le." Note that since the output terminals of the first current buffer circuit 301 and the second current buffer circuit 302 are both "Le," a current corresponding to two light-emitting thyristors L is supplied to the ϕI terminal (the current flows from the ϕI terminal).

In this manner, the current supplied to the ϕI terminal is controlled in accordance with the number of the light-emitting thyristors L to be caused to light up (emit light).

Note that the constant current source 300 shown in the first exemplary embodiment is only an example, and thus a different configuration may be employed.

As described above, the constant current source 300 is used in the first exemplary embodiment. However, resistances may be provided between the cathode terminals of the light-emitting thyristors L and the light-up signal line 75 in FIG. 8, and a constant voltage source may be used to cause to light up the plural light-emitting thyristors L in parallel.

Additionally, the gate terminals Gm of the memory thyristors M are directly connected to the gate terminals G1 of the light-emitting thyristors L, respectively. However, diodes whose anode and cathode terminals are respectively connected to the gate terminals Gm and G1 may be provided, and the light-up potential may be shifted from "Le" to "L" (−3.3 V) by setting, to −2.8 V, the threshold voltages of the light-emitting thyristors L when the potentials of the respective gate terminals Gm are changed to "H" (0 V).

Second Exemplary Embodiment

The configuration of the light-emitting chips C in the second exemplary embodiment is different from that in the first exemplary embodiment.

Figure 14:
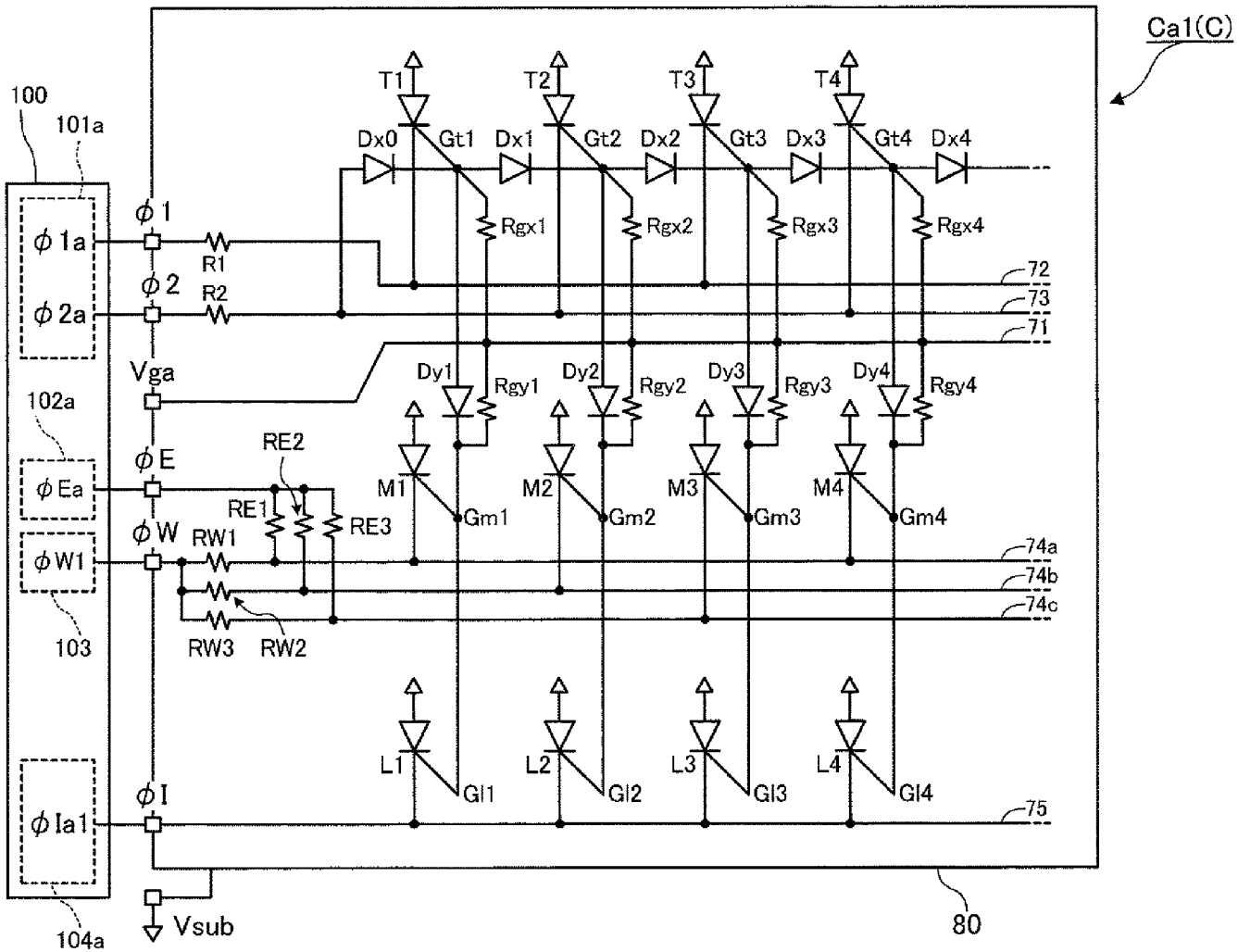
FIG. 14 is an equivalent circuit diagram for explaining a circuit configuration of the light-emitting chip that is a self-scanning light-emitting device array (SLED), in the second exemplary embodiment.

FIG. 14 is an equivalent circuit diagram for explaining a circuit configuration of the light-emitting chip C that is a self-scanning light-emitting device array (SLED), in the second exemplary embodiment. In FIG. 14, the light-emitting chip Ca1 is described as an example, and is denoted by the light-emitting chip Ca1 (C). The configuration of the other light-emitting chips Ca2 to Ca5, Cb1 to Cb5, Cc1 to Cc5 and Cd1 to Cd5 is the same as that of the light-emitting chip Ca1. In these light-emitting chips C, three light-emitting thyristors L at the maximum may be caused to light up (emit light) in parallel. The same reference numerals are given to the same components as those in the light-emitting chip C shown in FIG. 8, and the detailed description thereof is omitted.

In the light-emitting chip Ca1 (C) of the second exemplary embodiment, the cathode terminal of the every third memory thyristor M1, M4, M7 . . . (M7 is not shown) along the arrangement of the memory thyristors M is connected to the first write signal line 74*a*. The first write signal line 74*a* is then connected to the ϕW terminal, which is the input terminal of the write signal ϕW1, via the write resistance RW1. The write signal line 205_1 (see FIG. 6) is connected to the ϕW terminal to transmit the write signal ϕW1.

Similarly, the cathode terminal of the every third memory thyristor M2, M5, M8 . . . (M5 and M8 are not shown) is connected to the second write signal line 74*b*. The second write signal line 74*b* is then connected to the ϕW terminal, which is the input terminal of the write signal ϕW1, via the write resistance RW2.

Similarly, the cathode terminal of the every third memory thyristor M3, M6, M9 . . . (M6 and M9 are not shown) is connected to a third write signal line 74*c*. The third write signal line 74*c* is then connected to the ϕW terminal, which is the input terminal of the write signal ϕW1, via a write resistance RW3.

Also, the first write signal line 74*a* is connected to the ϕE terminal, which is the input terminal of the enable signal ϕEa, via the enable resistance RE1, between the cathode terminal of the memory thyristor M1 and the write resistance RW1. The enable signal line 203*a* (see FIG. 5) is connected to the ϕE terminal to transmit the enable signal ϕEa.

Furthermore, the second write signal line 74*b* is connected to the ϕE terminal via the enable resistance RE2, between the cathode terminal of the memory thyristor M2 and the write resistance RW2.

The third write signal line 74*c* is connected to the ϕE terminal via a enable resistance RE3, between the cathode terminal of the memory thyristor M3 and the write resistance RW3.

That is, the first write signal line 74*a*, the second write signal line 74*b* and the third write signal line 74*c* are connected to the ϕE terminal and the ϕW terminal, via a resistance network formed by the enable resistances RE1, RE2 and RE3 and the write resistances RW1, RW2 and RW3.

Also in the second exemplary embodiment, if the resistances are set as RE1=RE2=RE3=1 and RW1=RW2=RW3=2 kΩ, for example, the potentials of the first write signal line 74*a*, the second write signal line 74*b* and the third write signal line 74*c* are set depending on those of the ϕE terminal (the enable signal ϕE) and the ϕW terminal (the write signal ϕW1), similarly to the case shown in Table 1 described above.

The configuration of the other components in the light-emitting chip Ca1 (C) of the second exemplary embodiment is similar to that in the light-emitting chip C of the first exemplary embodiment shown in FIG. 8.

Although the detailed description is omitted, the light-emitting chip Ca1 (C) of the second exemplary embodiment may be configured so as to have the planar layout and the cross-section similar to those of the light-emitting chip Ca1 (C) of the first exemplary embodiment shown in FIGS. 9A and 9B.

An operation of the light-emitting device 65 using the light-emitting chips C of the second exemplary embodiment will be described.

Figure 15:
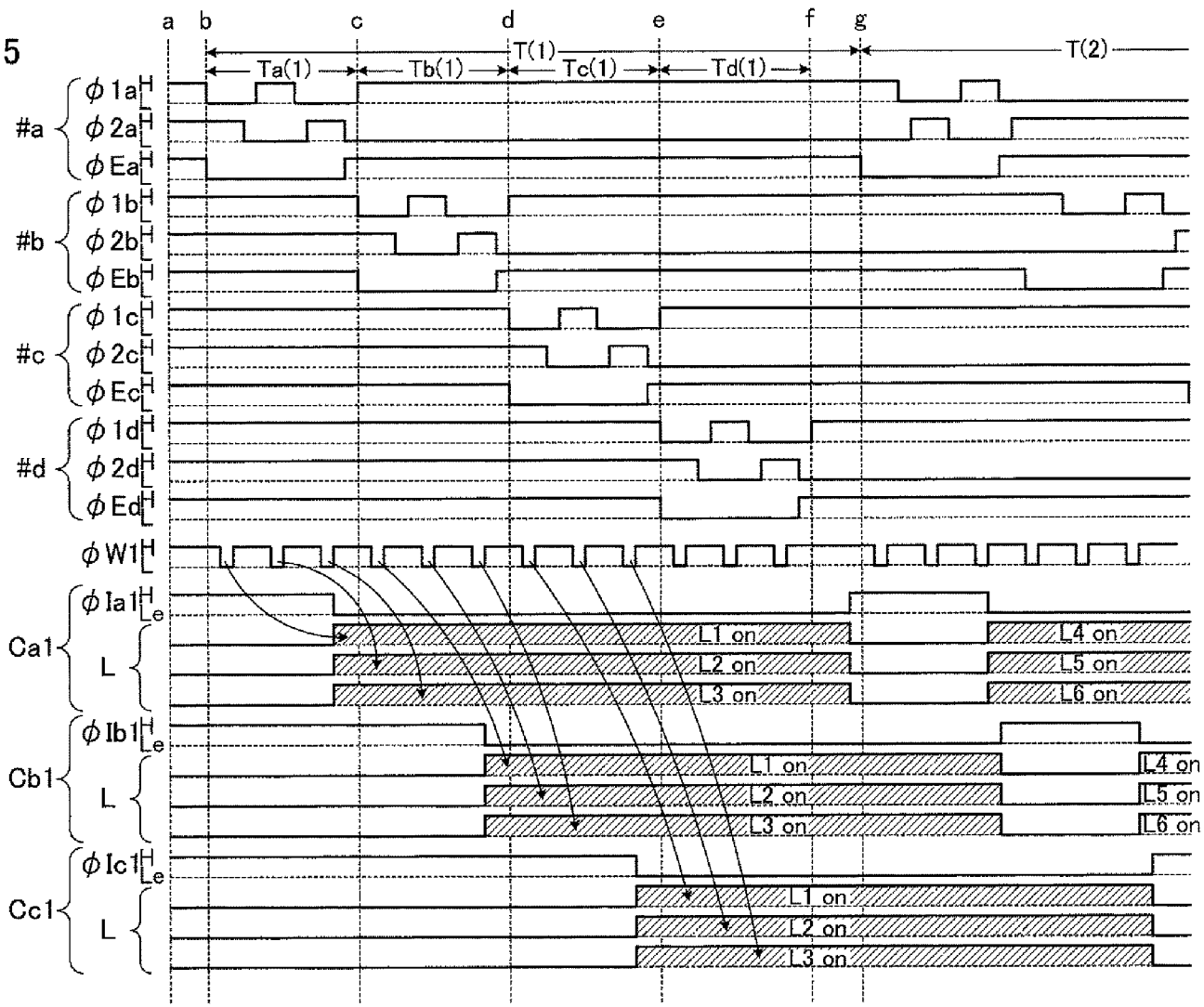
FIG. 15 is a timing chart for explaining the operation of the light-emitting device in the second exemplary embodiment.

FIG. 15 is a timing chart for explaining the operation of the light-emitting device 65 in the second exemplary embodiment.

FIG. 15 shows pairs of the transfer signals ϕ1 and ϕ2, and the enable signals ϕE transmitted for the respective light-emitting chip groups #a, #b, #c and #d, similarly to FIG. 10 in the first exemplary embodiment. FIG. 15 also shows the write signal ϕW1 transmitted to the light-emitting chip class #1. Furthermore, FIG. 15 shows the light-up signals ϕIa1, ϕIb1 and ϕIc1 respectively transmitted to the light-emitting chips Ca1, Cb1 and Cc1 belonging to the light-emitting chip class #1.

That is, FIG. 15 is a timing chart explaining the operation of the light-emitting chips Ca1, Cb1 and Cc1 among the light-emitting chips Ca1, Cb1, Cc1 and Cd1 belonging to the light-emitting chip class #1. Note that the operation of the light-emitting chip Cd1, although not shown, is similar to that of the other light-emitting chips Ca1, Cb1 and Cc1.

The other light-emitting chip classes #2 to #5 also operate similarly to the light-emitting chip class #1. Since the transfer signals ϕ1 and ϕ2, and the enable signals ϕE are common in each of the light-emitting chip classes #1 to #5, the other light-emitting chip classes #2 to #5 operate in parallel. Accordingly, the description of the other light-emitting chip classes #2 to #5 is omitted.

In the timing chart of FIG. 15, all the light-emitting thyristors L are assumed to be lighted up.

The period Ta(1) in the timing chart of the first exemplary embodiment shown in FIG. 10 has two periods during which the write signal ϕW1 becomes "L" (−3.3 V). In contrast, the period Ta(1) in the timing chart of the second exemplary embodiment shown in FIG. 15 has three periods during which the write signal ϕW1 becomes "L" (−3.3 V). That is, three light-emitting thyristors L at the maximum are caused to light up (emit light) in parallel.

Additionally, in the period Ta(1) in the timing chart of the first exemplary embodiment shown in FIG. 10, the transfer thyristors T1, T2 and T3 are sequentially changed to the ON state. In the period when only the transfer thyristor T1 is in the ON state (from the time point b to the time point e in FIG. 10), a period during which the write signal ϕW1 is "L" (−3.3 V) (from the time point c to the time point d in FIG. 10) is provided, and thereby the memory thyristor M1 is caused to turn on. Similarly, in the period when only the transfer thyristor T2 is in the ON state (from the time point f to the time point i in FIG. 10), a period during which the write signal ϕW1 is "L" (−3.3 V) (from the time point g to the time point h in FIG. 10) is provided, and thereby the memory thyristor M2 is caused to turn on. Specifically, by getting turned on, the memory thyristors M1 and M2 memorize (latch) the respective light-emitting thyristors L1 and L2 to be caused to light up (emit light).

On the other hand, in the period Ta(1) in the timing chart of the second exemplary embodiment shown in FIG. 15, the transfer thyristors T1, T2, T3 and T4 are sequentially changed to the ON state.

Additionally, in the periods during which only respective one of the transfer thyristors T1, T2 and T3 are in the ON state, the respective memory thyristors M1, M2 and M3 are caused to turn on, thereby to memorize (latch) the respective light-emitting thyristors L1, L2 and L3 to be caused to light up (emit light).

The other part of the operation is similar to that of the first exemplary embodiment described with FIG. 10, and thus, the detailed description thereof is omitted.

That is, in the second exemplary embodiment, the light-emitting chips C in the light-emitting device 65 of the first exemplary embodiment are changed, so that three light-emitting thyristors L at the maximum are caused to light up (emit light) in parallel.

Note that the constant current source 300 of the second exemplary embodiment, which supplies a current for lighting up (emitting light) to the ϕI terminal, may be obtained by adding, to the constant current source 300 shown in FIG. 13, another current buffer circuit having a similar configuration to the second current buffer circuit 302.

As in the case of the above, the number of the light-emitting thyristors L to be caused to light up (emit light) in parallel may be set to a value more than three.

Also in the second exemplary embodiment, the number of the wirings on the circuit board 62 in the light-emitting device 65 that uses the light-emitting chips C being capable of lighting up the plural light-emitting points (the light-emitting thyristors L) in parallel may be reduced.

Third Exemplary Embodiment

The configuration of the light-emitting chips C in the third exemplary embodiment is different from that in the first exemplary embodiment.

Figure 16:
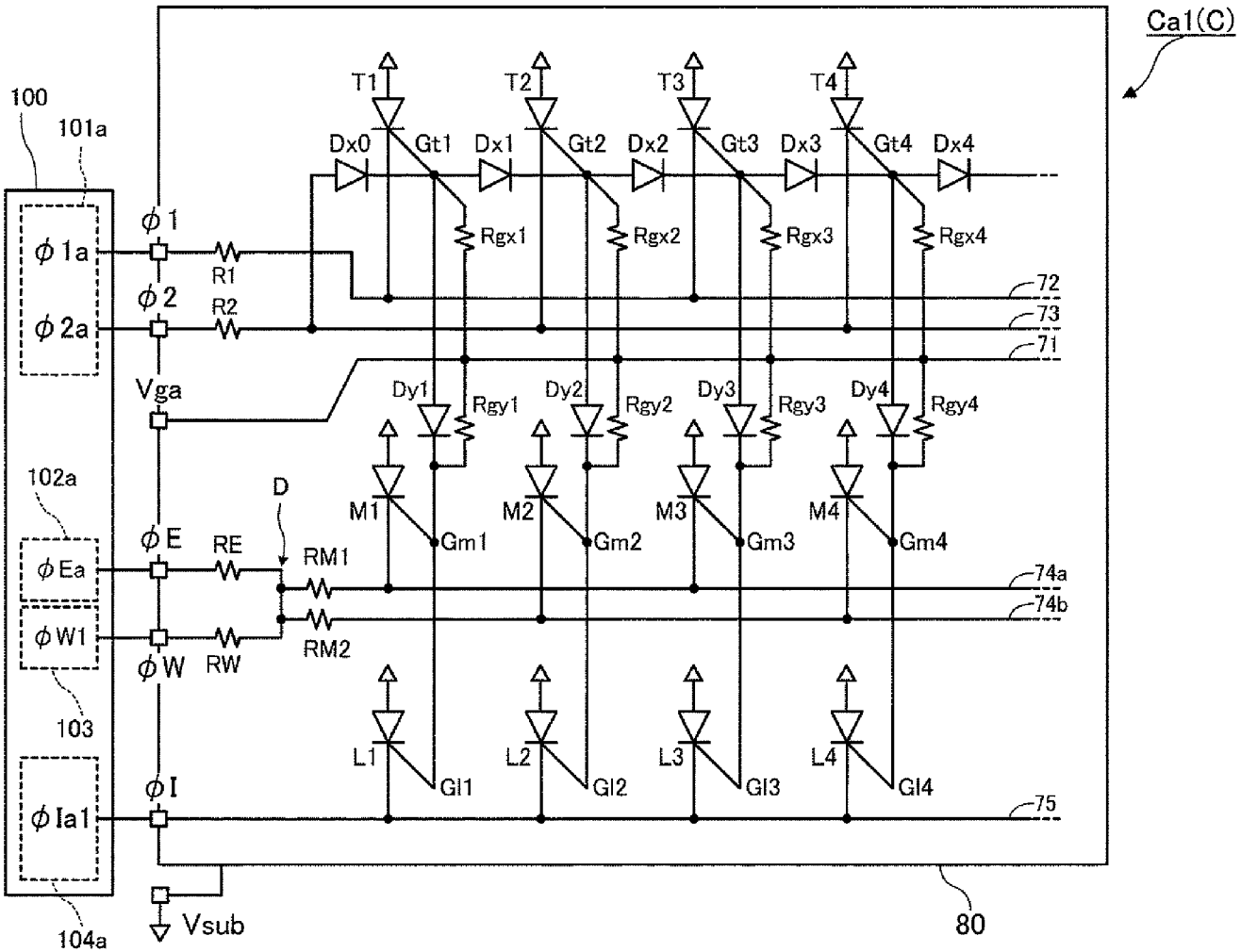
FIG. 16 is an equivalent circuit diagram for explaining a circuit configuration of the light-emitting chip that is a self-scanning light-emitting device array (SLED), in the third exemplary embodiment.

FIG. 16 is an equivalent circuit diagram for explaining a circuit configuration of the light-emitting chip C that is a self-scanning light-emitting device array (SLED), in the third exemplary embodiment. In FIG. 16, the light-emitting chip Ca1 is described as an example, and is denoted by the light-emitting chip Ca1 (C). The configuration of the other light-emitting chips Ca2 to Ca5, Cb1 to Cb5, Cc1 to Cc5 and Cd1 to Cd5 is the same as that of the light-emitting chip Ca1. Similarly to the first exemplary embodiment, each of the light-emitting chips C has such a configuration that two light-emitting thyristors L at the maximum may be caused to light up (emit light) in parallel. The same reference numerals are given to the same components as those in the light-emitting chip C shown in FIG. 8, and the detailed description thereof is omitted.

In the light-emitting chip Ca1 (C) of the third exemplary embodiment, the configuration of the resistance network provided between the first write signal line 74*a* and the second write signal line 74*b*, and the ϕW terminal and the ϕE terminal is different from that in the light-emitting chip Ca1 (C) of the first exemplary embodiment.

Specifically, the first write signal line 74*a* is connected to the ϕE terminal via a memory resistance RM1 and an enable resistance RE that are connected in series.

The second write signal line 74*b* is connected to the ϕW terminal via a memory resistance RM2 and a write resistance RW that are connected in series.

Additionally, the connection point between the memory resistance RM1 and the enable resistance RE is connected to the connection point between the memory resistance RM2 and the write resistance RW (at a connection point D).

In the third exemplary embodiment, the resistance values are set as RW=1 kΩ, RE=500 and RM1=RM2=1 kΩ, for example.

Although the detailed description is omitted, the light-emitting chip Ca1 (C) of the third exemplary embodiment may be configured so as to have the planar layout and the cross-section similar to those of the light-emitting chip Ca1 (C) of the first exemplary embodiment shown in FIGS. 9A and 9B.

Hereinafter, it will be described that the operation is similar to that of the first exemplary embodiment even when the light-emitting chips C of the third exemplary embodiment are used. Thus, the description will be given according to the timing chart shown in FIG. 10.

Table 3 shows the potential of the connection point D set by the potentials of the ϕE terminal (the enable signal ϕEa) and the ϕW terminal (the write signal ϕW1) when all the memory thyristors M in the light-emitting chip Ca1 (C) are supposed to be in the OFF state. Note that if all the memory thyristors M in the light-emitting chip Ca1 (C) are in the OFF state, the potentials of the first write signal line 74*a* and the second write signal line 74*b* are equal to the potential of the connection point D shown in Table 3. Accordingly, Table 3 shows the potentials of the first write signal line 74*a* and the second write signal line 74*b* when all the memory thyristors M in the light-emitting chip Ca1 (C) are in the OFF state. Table 3 is the same as Table 1.

TABLE 3

| | | POTENTIAL OF ϕ E | |
|---|---|---|---|
| | | 0V (⌈H⌋) | −3.3V (⌈L⌋) |
| POTENTIAL OF ϕW | 0V (⌈H⌋) | 0V (⌈H⌋) | −2.2V |
| | −3.3V (⌈L⌋) | −1.1V | −3.3V (⌈L⌋) |

Next, a description will be given of a case where one of the odd-numbered memory thyristors M is in the ON state. If one of the odd-numbered memory thyristors M is in the ON state, the potential of the first write signal line 74*a* is −1.4 V that is the potential of the cathode terminal of the memory thyristor M in the ON state. Accordingly, the potential of the connection point D is affected by that of the first write signal line 74*a* (−1.4 V).

Table 4 shows the potential of the connection point D set by the potentials of the ϕE terminal (the enable signal ϕEa) and the ϕW terminal (the write signal ϕW1) when one of the odd-numbered memory thyristors M is in the ON state. As is appreciated from FIG. 10, if one of the odd-numbered memory thyristors M is in the ON state, the potential of the ϕE terminal is "L" (−3.3 V). Accordingly, the potential of the connection point D is −2.0 V when the write signal ϕW1 is 0 V, while the potential of the connection point D is −2.83 V when the write signal ϕW1 is "L" (−3.3 V). Since none of the even-numbered memory thyristors M are in the ON state, the potential of the second write signal line 74*b* is equal to that of the connection point D.

TABLE 4

| | | POTENTIAL OF ϕ E | |
|---|---|---|---|
| | | 0V (⌈H⌋) | −3.3V (⌈L⌋) |
| POTENTIAL OF ϕW | 0V (⌈H⌋) | — | −2.0V |
| | −3.3V (⌈L⌋) | — | −2.83V |

Hereinafter, with reference to the timing chart of the first exemplary embodiment shown in FIG. 10 and Tables 3 and 4, it will be described that the light-emitting chips C of the third exemplary embodiment operate similarly to those of the first exemplary embodiment.

First, at the time point b, the enable signal ϕEa changes from "H" (0 V) to "L" (−3.3 V). Since none of the memory thyristors M are in the ON state, the potential of the connection point D is −2.2 V according to Table 3. The potentials of the first write signal line 74*a* and the second write signal line 74*b* are equal to the potential of the connection point D (−2.2 V).

At the time point b, the first transfer signal ϕ1*a* changes from "H" (0 V) to "L" (−3.3 V), the transfer thyristor T1 gets turned on, and thereby the threshold voltage of the memory thyristor M1 becomes −2.8 V. However, since the potential of the first write signal line 74*a* is −2.2 V, the memory thyristor M1 does not get turned on.

Next, at the time point c, the write signal ϕW1 changes from "H" (0 V) to "L" (−3.3 V). Then, as is appreciated from Table 3, the potential of the connection point D becomes −3.3 V, and thus the potential of the first write signal line 74*a* also becomes −3.3 V. Then, the memory thyristor M1 having a threshold voltage of −2.8 V gets turned on, and thereby the potential of the first write signal line 74*a* becomes −1.4 V. That is, the operation is the same as that in the first exemplary embodiment at the time point c.

At the time point d, the write signal ϕW1 changes from "L" (−3.3 V) to "H" (0 V). Then, as shown in Table 4, the potential of the connection point D becomes −2.0 V. This potential is lower than the maintaining voltage (the potential −1.4 V of the cathode terminal of the memory thyristor M in the ON state) that maintains the ON state of the memory thyristor M. Thus, the ON state of the memory thyristor M1 is maintained. That is, the operation is the same as that in the first exemplary embodiment at the time point d.

At the time point g, the write signal ϕW1 changes from "L" (−3.3 V) to "H" (0 V). Then, as shown in Table 4, the potential of the second write signal line 74*b* becomes −2.83 V. Thus, the memory thyristor M2, whose threshold voltage is set to −2.8 V by the transfer thyristor T2 having got turned on at the time point e, gets turned on.

On the other hand, in the light-emitting chip Cb1, when the write signal ϕW1 changes from "H" (0 V) to "L" (−3.3 V) at the time point c, the potential of the first write signal line 74*a* in the light-emitting chip Cb1 becomes −1.1 V, as shown in Table 3, because the enable signal ϕEb is "H" (0 V). However, the memory thyristor M1 having a threshold voltage of −4.2 V does not get turned on. That is, the operation is the same as that in the first exemplary embodiment at the time point c.

As has been described above, the operation of the light-emitting device 65 and the like is similar to that of the first exemplary embodiment even when the light-emitting chips C of the third exemplary embodiment are used.

Here, it is supposed that two light-emitting thyristors L at the maximum are caused to light up (emit light) in parallel. However, as described in the second exemplary embodiment, three or more light-emitting thyristors L may be caused to light up (emit light) in parallel.

Accordingly, also in the third exemplary embodiment, the number of the wirings on the circuit board 62 in the light-emitting device 65 that uses the light-emitting chips C being capable of lighting up the plural light-emitting points (the light-emitting thyristors L) in parallel may be reduced.

Fourth Exemplary Embodiment

The configuration of the light-emitting chips C in the fourth exemplary embodiment is different from that in the first exemplary embodiment.

Figure 17:
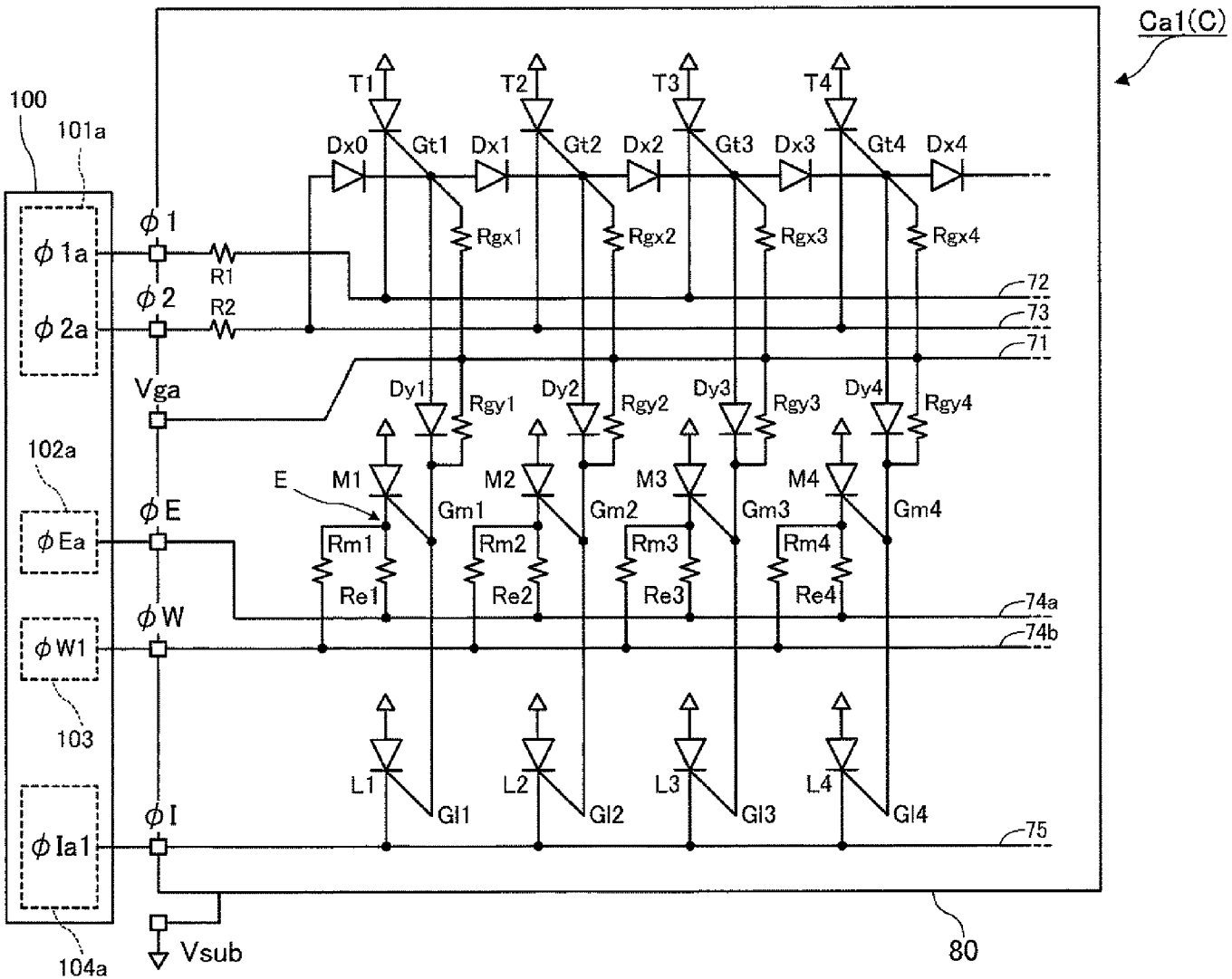
FIG. 17 is an equivalent circuit diagram for explaining a circuit configuration of the light-emitting chip that is a self-scanning light-emitting device array (SLED), in the fourth exemplary embodiment.

FIG. 17 is an equivalent circuit diagram for explaining a circuit configuration of the light-emitting chip C that is a self-scanning light-emitting device array (SLED), in the fourth exemplary embodiment. In FIG. 17, the light-emitting chip Ca1 is described as an example, and is denoted by the light-emitting chip Ca1 (C). The configuration of the other light-emitting chips Ca2 to Ca5, Cb1 to Cb5, Cc1 to Cc5 and Cd1 to Cd5 is the same as that of the light-emitting chip Ca1. Similarly to the first exemplary embodiment, each of the light-emitting chips C has such a configuration that two light-emitting thyristors L at the maximum may be caused to light up (emit light) in parallel. The same reference numerals are given to the same components as those in the light-emitting chip C shown in FIG. 8, and the detailed description thereof is omitted.

In the light-emitting chip Ca1 (C) of the fourth exemplary embodiment, the connection of the first write signal line 74*a* and the second write signal line 74*b* with the memory thyristors M, and the connection of the first write signal line 74*a* and the second write signal line 74*b* with the ϕE terminal and the ϕW terminal are different from those in the light-emitting chip Ca1 (C) of the first exemplary embodiment.

Specifically, the first write signal line 74*a* is connected to the ϕE terminal from which the enable signal ϕEa is supplied. Additionally, the cathode terminals of the memory thyristors M1, M2, M3 . . . are connected to the first write signal line 74*a* via enable resistances Re1, Re2, Re3 . . . , respectively.

On the other hand, the second write signal line 74*b* is connected to the ϕW terminal from which the write signal ϕW 1 is supplied. Additionally, the cathode terminals of the memory thyristors M1, M2, M3 . . . are connected to the second write signal line 74*b* via memory resistances Rm1, Rm2, Rm3 . . . , respectively.

When the enable resistances Re1, Re2, Re3 . . . and the memory resistances Rm1, Rm2, Rm3 . . . are not individually distinguished, they are denoted by an enable resistance Re and a memory resistance Rm, respectively.

In the fourth exemplary embodiment, the resistance values are set as Rm=1 kΩ and Re=500Ω, for example.

Although the detailed description is omitted, the light-emitting chip Ca1 (C) of the fourth exemplary embodiment may be configured so as to have the planar layout and the cross-section similar to those of the light-emitting chip Ca1 (C) of the first exemplary embodiment shown in FIGS. 9A and 9B.

Hereinafter, it will be described that the operation is similar to that of the first exemplary embodiment even when the light-emitting chips C of the fourth exemplary embodiment are used. Thus, the description will be given according to the timing chart shown in FIG. 10.

Table 5 shows the potential of a connection point E set by the potentials of the ϕE terminal (the enable signal ϕEa) and the ϕW terminal (the write signal ϕW1) when all the memory thyristors M in the light-emitting chip Ca1 (C) are supposed not to be in the ON state. Note that if all the memory thyristors M in the light-emitting chip Ca1 (C) are not in the ON state, the potentials of the first write signal line 74*a* and the second write signal line 74*b* are equal to the potential of the connection point E shown in Table 5. Accordingly, Table 5 shows the potentials of the first write signal line 74*a* and the second write signal line 74*b* when all the memory thyristors M in the light-emitting chip Ca1 (C) are not in the ON state. Table 5 is the same as Table 1.

TABLE 5

| | | POTENTIAL OF ϕ E | |
|---|---|---|---|
| | | 0V (⌈H⌋) | −3.3V (⌈L⌋) |
| POTENTIAL OF ϕW | 0V (⌈H⌋) | 0V (⌈H⌋) | −2.2V |
| | −3.3V (⌈L⌋) | −1.1V | −3.3V (⌈L⌋) |

Next, a description will be given of a case where one of the odd-numbered memory thyristors M is in the ON state. If one of the odd-numbered memory thyristors M is in the ON state, the potential of the ϕE terminal is "L" (−3.3 V). Accordingly, the potential of the first write signal line 74*a* is "L" (−3.3 V).

On the other hand, the potential of the cathode terminal of the memory thyristor M in the ON state is −1.4 V. However, since the second write signal line 74*b* is connected to the ϕW terminal, the potential of the second write signal line 74*b* is not affected by the memory thyristor M in the ON state, and changes according to the write signal ϕW1. Accordingly, even when one of the odd-numbered memory thyristors M is in the ON state, the potential of the connection point E set by the potentials of the ϕE terminal (the enable signal ϕEa) and the ϕW terminal (the write signal ϕW1) is the same as that shown in Table 5.

As has been described above, the operation of the light-emitting device 65 and the like is similar to that of the first exemplary embodiment even when the light-emitting chips C of the fourth exemplary embodiment are used.

Here, it is supposed that two light-emitting thyristors L at the maximum are caused to light up (emit light) in parallel. However, as described in the second exemplary embodiment, three or more light-emitting thyristors L may be caused to light up (emit light) in parallel.

Accordingly, also in the fourth exemplary embodiment, the number of the wirings on the circuit board 62 in the light-emitting device 65 that uses the light-emitting chips C being capable of lighting up the plural light-emitting points (the light-emitting thyristors L) in parallel may be reduced.

In the first to fourth exemplary embodiments, the transfer thyristors. T are driven by the first transfer signal ϕ1 and the second transfer signal ϕ2 in two phases. However, the transfer thyristors T may be driven by transmitting transfer signals in three phases to every three transfer thyristors T. Similarly, the transfer thyristors T may be driven by transmitting transfer signals in four or more phases.

Also, in the first to fourth exemplary embodiments, the gate terminals Gt of every adjacent pair of the transfer thyristors T are connected via the coupling diode Dx. However, this component only needs to be an electrical part operating in such a manner that a potential change at one terminal of the component causes a potential change at the other terminal thereof. Thus, a resistance or the like may be used instead of the coupling diode Dx.

Furthermore, in the first to fourth exemplary embodiments, each of the gate terminals Gt of the transfer thyristors T is connected to the corresponding gate terminal Gm of the memory thyristor M via the corresponding connection diode Dy. However, this component only needs to be an electrical part that causes a potential drop to shift a potential. Thus, a resistance or the like may be used instead of the connection diode Dy.

In the light-emitting chips C of the first to fourth exemplary embodiments, each of the gate terminals Gm of the memory thyristors M is connected to the corresponding gate terminal G1 of the light-emitting thyristor L. However, plural elements (here, referred to as holding elements or holding thyristors) each having a similar configuration to that of the memory thyristor M may be provided between the respective memory thyristors M and the respective light-emitting thyristors L so as to correspond to one another. In this case, each of the gate terminals Gm of the memory thyristors M is connected to the corresponding gate terminal of the holding thyristor via an electrical part such as a diode, and each of the gate terminals of the holding thyristors is connected to the corresponding gate terminal G1 of the light-emitting thyristor L. Additionally, the cathode terminals of the holding thyristors are connected to a newly provided signal line (a holding signal line).

A holding signal is transmitted through the holding signal line to cause the holding thyristor corresponding to the memory thyristor M in the ON state to turn on. Thereby, information on the position (number) of the light-emitting thyristor L is transmitted (transferred) from the memory thyristor M to the holding thyristor. Thereafter, the light-emitting thyristor L corresponding to the holding thyristor in the ON state is caused to light up (emit light).

In this manner, one-step or plural-step of elements (the holding elements) serving as a buffer that delivers the information on the position (number) of the light-emitting element to be caused to light up (emit light) from the corresponding memory element may be provided between the respective memory elements and the respective light-emitting elements.

Even in the light-emitting device 65 using such light-emitting chips C, the number of the wirings on the circuit board 62 may be reduced.

In the first to fourth exemplary embodiments, one self-scanning light-emitting device array (SLED) is assumed to be mounted on each light-emitting chip C. However, two or more SLEDs may be mounted on each light-emitting chip C. If two or more SLEDs are mounted, it is only necessary that each of the self-scanning light-emitting device arrays (SLEDs) is replaced with the light-emitting chip C.

Additionally, the above descriptions have been given with the assumption that the number of the light-emitting points (the light-emitting thyristors L) of the light-emitting thyristor array 90 in the light-emitting chip C is set to be 128. However, this number is arbitrarily settable.

In the first to fourth exemplary embodiments, the number of the light-emitting chips C forming each of the light-emitting chip groups is set to be the same, and the number of the light-emitting chips C forming each of the light-emitting chip classes is also set to be the same. However, these numbers may be different from each other. Additionally, in the first to fourth exemplary embodiments, light-emitting chips C forming a light-emitting chip class belong to different light-emitting chip groups, respectively. However, a light-emitting chip class may include light-emitting chips C belonging to the same light-emitting chip group.

Furthermore, in the first to fourth exemplary embodiments, the anode common thyristor (each of the transfer thyristors T, the memory thyristors M and the light-emitting thyristors L) whose anode terminal is commonly set as the substrate 80 has been described. However, the cathode common thyristor whose cathode terminal is set as the substrate 80 may be used instead by changing the polarity of the circuit.

Note that, the usage of the light-emitting device in the present invention is not limited to an exposure device used in an electrophotographic image forming unit. The light-emitting device in the present invention may be also used in optical writing other than the electrophotographic recording, displaying, illumination, optical communication and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light-emitting device comprising:

a plurality of light-emitting chips that each include a plurality of light-emitting elements and a plurality of memory elements provided respectively corresponding to the plurality of light-emitting elements, each of the memory elements memorizing a corresponding light-emitting element to be caused to light up, each of the plurality of light-emitting chips being capable of lighting up the light-emitting elements more than one, in parallel;

an enable signal supply unit that transmits an enable signal in common to light-emitting chips belonging to each of M groups into which the plurality of light-emitting chips are divided, where M is an integer more than one, the enable signal enabling selection of light-emitting elements to be caused to light up among the plurality of light-emitting elements;

a write signal supply unit that transmits a write signal in common to light-emitting chips belonging to each of N classes into which the plurality of light-emitting chips are divided, where N is an integer more than one, the write signal setting memory elements corresponding to the light-emitting elements to be caused to light up among the plurality of light-emitting elements, to any one of a memory state and a non-memory state, in the light-emitting chips in which the selection is enabled by the enable signal; and a light-up signal supply unit that transmits light-up signals for lighting up to light-emitting elements corresponding to memory elements in the memory state, for the plurality of light-emitting chips.

2. The light-emitting device according to claim 1, wherein each of the plurality of light-emitting chips includes transfer elements that are provided respectively corresponding to the plurality of memory elements, and that sequentially designate the plurality of light-emitting elements as selection targets being the light-emitting elements to be caused to light up, the light-emitting device further comprising a transfer signal supply unit that transmits transfer signals to the light-emitting chips belonging to each of the M groups in common, the transfer signals sequentially designating the light-emitting elements to be caused to light up among the plurality of light-emitting elements as selection targets.

3. The light-emitting device according to claim 2, wherein the write signal supply unit transmits the write signal in chronological order to the light-emitting chips belonging to each of the N classes in common, for each of the M groups.

4. The light-emitting device according to claim 3, wherein the light-up signal supply unit, the transfer signal supply unit and the enable signal supply unit respectively transmit the light-up signals, the transfer signals and the enable signal to each of the M groups, at respective time points for the M groups, the time points being shifted with respect to each other on a time axis.

5. The light-emitting device according to claim 2, wherein the light-up signal supply unit, the transfer signal supply unit and the enable signal supply unit respectively transmit the light-up signals, the transfer signals and the enable signal to each of the M groups, at respective time points for the M groups, the time points being shifted with respect to each other on a time axis.

6. The light-emitting device according to claim 1, wherein the write signal supply unit transmits the write signal in chronological order to the light-emitting chips belonging to each of the N classes in common, for each of the M groups.

7. A driving method of a light-emitting device including a plurality of light-emitting chips that each include a plurality of light-emitting elements and a plurality of memory elements provided respectively corresponding to the plurality of light-emitting elements, each of the memory elements memorizing a corresponding light-emitting element to be caused to light up, each of the plurality of light-emitting chips being capable of lighting up the light-emitting elements more than one, in parallel; the driving method comprising:

transmitting an enable signal in common to light-emitting chips belonging to each of M groups into which the plurality of light-emitting chips are divided, where M is an integer more than one, the enable signal enabling selection of light-emitting elements to be caused to light up among the plurality of light-emitting elements;

transmitting a write signal in common to light-emitting chips belonging to each of N classes into which the plurality of light-emitting chips are divided, where N is an integer more than one, the write signal setting memory elements corresponding to the light-emitting elements to be caused to light up among the plurality of light-emitting elements, to any one of a memory state and a non-memory state, in the light-emitting chips in which the selection is enabled by the enable signal; and transmitting light-up signals for lighting up to light-emitting elements corresponding to memory elements in the memory state, for the plurality of light-emitting chips.

8. A print head comprising:

an exposure unit that exposes an image carrier to form an electrostatic latent image; and an optical unit that focuses light emitted by the exposure unit on the image carrier, the exposure unit including:

a plurality of light-emitting chips that each include a plurality of light-emitting elements and a plurality of memory elements provided respectively corresponding to the plurality of light-emitting elements, each of the memory elements memorizing a corresponding light-emitting element to be caused to light up, each of the plurality of light-emitting chips being capable of lighting up the light-emitting elements more than one, in parallel;

an enable signal supply unit that transmits an enable signal in common to light-emitting chips belonging to each of M groups into which the plurality of light-emitting chips are divided, where M is an integer more than one, the enable signal enabling selection of light-emitting elements to be caused to light up among the plurality of light-emitting elements;

a write signal supply unit that transmits a write signal in common to light-emitting chips belonging to each of N classes into which the plurality of light-emitting chips are divided, where N is an integer more than one, the write signal setting memory elements corresponding to the light-emitting elements to be caused to light up among the plurality of light-emitting elements, to any one of a memory state and a non-memory state, in the light-emitting chips in which the selection is enabled by the enable signal; and a light-up signal supply unit that transmits light-up signals for lighting up to light-emitting elements corresponding to memory elements in the memory state, for the plurality of light-emitting chips.

9. An image forming apparatus comprising:

a charging unit that charges an image carrier;

an exposure unit that exposes the image carrier to form an electrostatic latent image;

an optical unit that focuses light emitted by the exposure unit on the image carrier;

a developing unit that develops the electrostatic latent image formed on the image carrier; and a transfer unit that transfers an image developed on the image carrier to a transferred body, the exposure unit including:

a plurality of light-emitting chips that each include a plurality of light-emitting elements and a plurality of memory elements provided respectively corresponding to the plurality of light-emitting elements, each of the memory elements memorizing a corresponding light-emitting element to be caused to light up, each of the plurality of light-emitting chips being capable of lighting up the light-emitting elements more than one, in parallel;

an enable signal supply unit that transmits an enable signal in common to light-emitting chips belonging to each of M groups into which the plurality of light-emitting chips are divided, where M is an integer more than one, the enable signal enabling selection of light-emitting elements to be caused to light up among the plurality of light-emitting elements;

a write signal supply unit that transmits a write signal in common to light-emitting chips belonging to each of N classes into which the plurality of light-emitting chips are divided, where N is an integer more than one, the write signal setting memory elements corresponding to the light-emitting elements to be caused to light up among the plurality of light-emitting elements, to any one of a memory state and a non-memory state, in the light-emitting chips in which the selection is enabled by the enable signal; and a light-up signal supply unit that transmits light-up signals for lighting up to light-emitting elements corresponding to memory elements in the memory state, for the plurality of light-emitting chips.

* * * * *